US007794341B2

(12) United States Patent
Tarng et al.

(10) Patent No.: US 7,794,341 B2
(45) **Date of Patent: *Sep. 14, 2010**

(54) GOLFRISBEE BASKET/SPORTING FOR RE-BOUNCING LIGHTWEIGHT GOLFRING/DISK

(75) Inventors: Min Ming Tarng, San Jose, CA (US); Mei Jech Lin, San Jose, CA (US); Eric Yu-Shiao Tarng, San Jose, CA (US); Alfred Yu-Chi Tarng, San Jose, CA (US); Angela Yu-Shiu Tarng, San Jose, CA (US); Jwu-Ing Nieh, San Jose, CA (US); Huang-Chang Tarng, San Jose, CA (US); Shun-Yu Nieh, San Jose, CA (US)

(73) Assignee: Tang System, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/074,143

(22) Filed: Feb. 29, 2008

(65) Prior Publication Data

US 2009/0143175 A1 Jun. 4, 2009

Related U.S. Application Data

(63) Continuation-in-part of application No. 11/210,306, filed on Aug. 24, 2005, now Pat. No. 7,422,531, and a continuation-in-part of application No. 10/842,739, filed on May 10, 2004, now Pat. No. 7,101,293, and a continuation-in-part of application No. 10/091,984, filed on Mar. 6, 2002, now abandoned, and a continuation-in-part of application No. 09/945,968, filed on Sep. 24, 2001, now abandoned.

(51) Int. Cl.
*A63B 67/00* (2006.01)
*A63B 67/02* (2006.01)

(52) U.S. Cl. ..... 473/465; 273/400; 473/446; 473/588; 446/46

(58) Field of Classification Search ..... 473/465, 473/588, 590, 446; 273/348.4, 400; 446/46, 446/47

See application file for complete search history.

(56) References Cited

U.S. PATENT DOCUMENTS 2,493,245 A * 1/1950 Hansen ..... 124/5

(Continued)

*Primary Examiner*—Gene Kim
*Assistant Examiner*—M Chambers

(57) ABSTRACT

The killer applications of golfrisbee are comprised of the golfball, golh club, golfrisbee disc and golfrisbee basket, golfrisbee target, grenade, water golh gun club, etc. Swiveling the golh club, the flying object is thrown to fly into the golfrisbee basket. The golfrisbee basket has either the wind-bell-chain or the wind-chime reverted umbrella structure to protect the golfrisbee from damage. The flying object has golfball, golfrisbee disk, golfring, disk-ring, boomerang, polygon boomerang, multi-boomerang ring, multi-boomerang disk-ring, golfishing, golh hunting practice, grenade, gun golh club, water grenade, water gun golh club, etc. The golfrisbee further comprises a slotted skirt made of rubber material to make it safe for playing in the park and the backbone made of the shock-resistant plastic material. The core technologies are the swiveling club throwing technology, wind-bell-chain or wind-chime reverted-umbrella golfrisbee basket and the universal direction wing flying disk. The golh killer applications comprise the course golh, park golh, snow golh, night golh, golfishing, golh-gun, golh-grenade and the baseball type golh sport named as basedisc.

20 Claims, 47 Drawing Sheets

U.S. PATENT DOCUMENTS 4,039,189 A * 8/1977 Headrick et al. ..... 273/400
4,809,988 A * 3/1989 Hunter ..... 273/400
5,032,098 A * 7/1991 Balogh et al. ..... 446/47
5,048,845 A * 9/1991 Dunipace ..... 273/400
5,209,490 A * 5/1993 Dallavecchia ..... 273/348.4
5,287,561 A * 2/1994 Spector ..... 2/209.11
5,366,403 A * 11/1994 Weiss ..... 446/46
5,411,265 A * 5/1995 Falco ..... 473/196
5,611,720 A * 3/1997 Vandermaas ..... 446/47
5,630,742 A * 5/1997 Honaker ..... 446/46
6,106,355 A * 8/2000 Hoerner ..... 446/46
6,193,620 B1 * 2/2001 Tarng ..... 473/465
6,468,165 B1 * 10/2002 Moore ..... 473/170
6,834,858 B1 * 12/2004 Reineke ..... 273/400
7,101,293 B2 * 9/2006 Tarng et al. ..... 473/446
7,422,531 B2 * 9/2008 Tarng et al. ..... 473/446
2003/0045200 A1 * 3/2003 Tarng et al. ..... 446/46

* cited by examiner

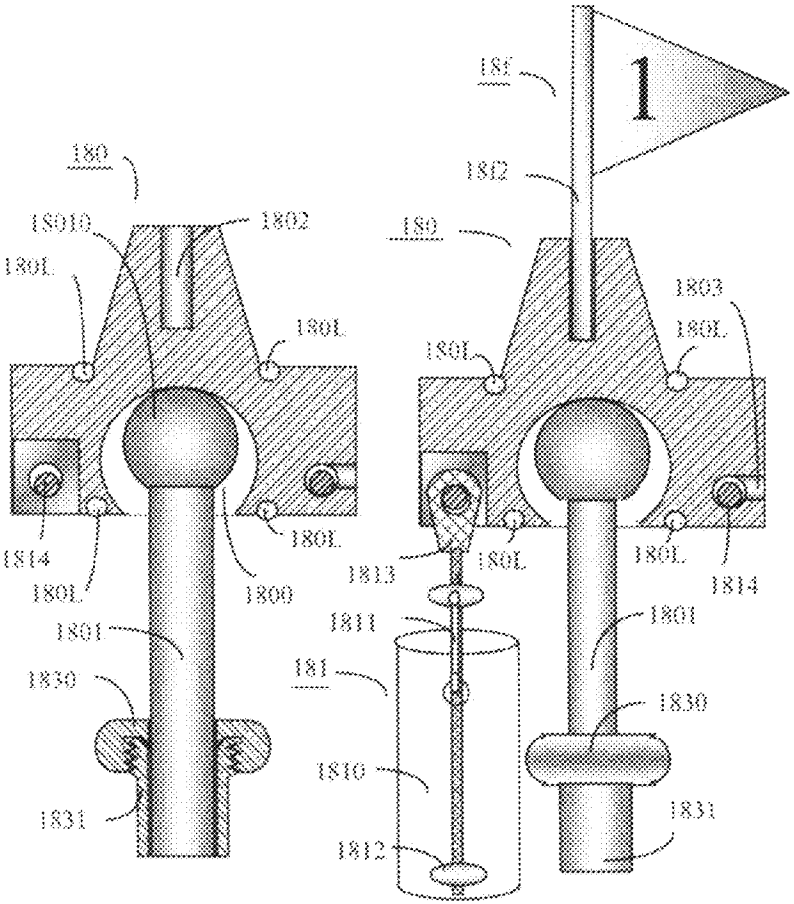
FIG.2L
FIG.2K
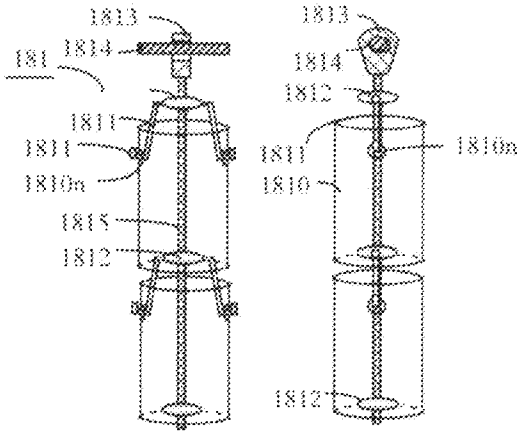
FIG.2M
FIG.2N
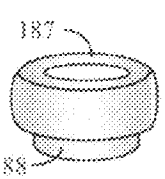
FIG.2P
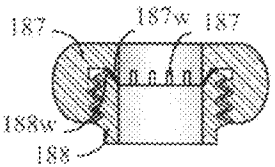
FIG.2O
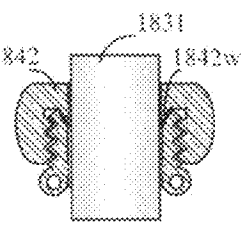
FIG.2R
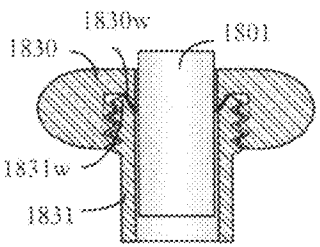
FIG.2Q

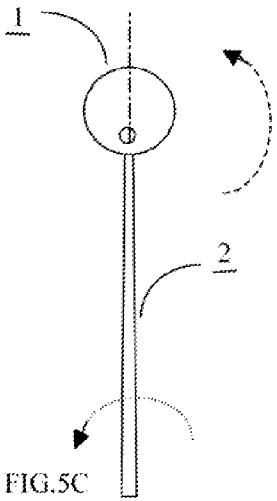
FIG.5A
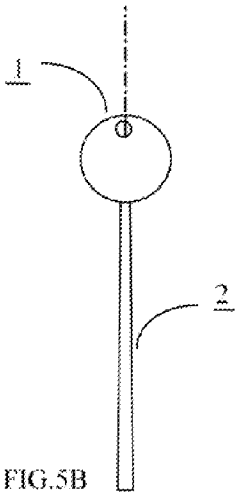
FIG.5B
FIG.5C
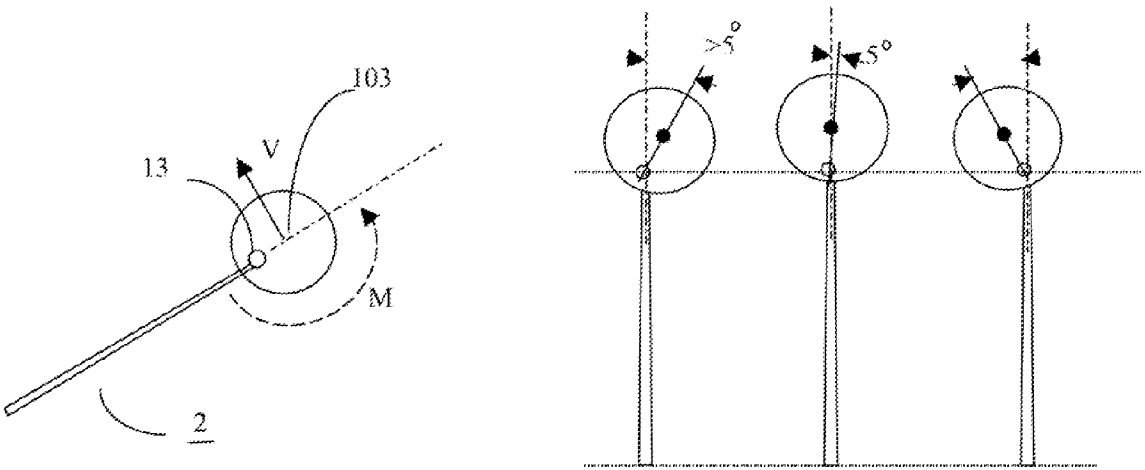
FIG.6A
FIG.6B
FIG.6C
FIG.6D 151
15
12
13

1511
1521
15
152
151
12
13

151
15a
12
13
153
151a 5
2
34p
34
36

60
69a
69b
69s 69a
69b
69s 690
690s
690n
690c 690
690a
690b 79
791
792
79n
79s 79
791
792
79n
79s 790
790s
790n
791
792

790
790s
790n
791
792

195
38

195
38

195
38

195
38

380
38
382

380
38
382

2p
196
38

2
37

2
38

2p
196
37
38

GOLFRISBEE BASKET/SPORTING FOR RE-BOUNCING LIGHTWEIGHT GOLFRING/DISK

This is a Continuation in Part application claims priority of U.S. patent application Ser. No. 09/945,968, filed Sep. 4, 2001, now abandoned, U.S. patent application Ser. No. 10/091,984, filed Mar. 6, 2002, now abandoned, Ser. No. 10/842,739, now U.S. Pat. No. 7,101,293, filed May 10, 2004 and U.S. patent application Ser. No. 11/210,306, filed Aug. 24, 2005 now U.S. Pat. No. 7,422,531 which herein incorporated by reference in its entirety.

BACKGROUND

1. Field of Invention

The golfrisbee sport is to launch the golfrisbee to fly into a portable golfrisbee basket. It also can push the golfrisbee to roll into a cavity. The golfrisbee emulates the human throwing process to launch the disk to fly. Swiveling golfrisbee pole to rotate golfrisbee disk to have blockless snapping take-off launching, the screw provides the blockless snapping lock, launch and take-off depending on the specified screw position. As the disk rotates due to the eccentric force, the disk automatically launches and takes off to fly at the specified position. The golfrisbeer swivels the club to launch the golfrisbee to fly. The golfrisbee is launched to fly with the waist force to swivel the club at very high speed. With the high-speed swiveling club, the golfrisbee flies much farther and higher than the hand-throwing flying disk does. The complicated throwing process of human brain and hand cooperation mechanism is emulated with the simple screw mechanism. With the screw means mechanism, we make the technology breakthrough in the swivel-to-launch technology. As the golfrisbeer swivels the club, the golfrisbee disk automatically rotates due to the eccentric force. As the club reaches the designated launching point, the golfrisbee automatically takes off and launches to fly in the sky. With the integrated multimedia device, the rainbow-like shining light and whistling harmonic sound make the golfrisbee much more fun to play with. Furthermore, reverse the club and upside down of the golfrisbee, the golfrisbee can be pushed to skid into the hole as the ice hockey does. Therefore, without any new special facility, the golfrisbee sport is the combination of the golf, flying disk, baseball, ice hockey, etc. Golfrisbee is a market-pull product and technology—the market is already there and no proper product. It provides the repeatable, accurate, far away throw with blockless snapping take-off of flying disk with the swiveling of pole. Therefore, the golfrisbee is proposed to be and will be the standard of the disk-golf sport.

Golh sport is to swivel the golh club to launch the golfrisbee disk to fly into the golfrisbee basket. The core technologies of golh sport are: golfrisbee 1, golh club 2 and golfrisbee basket 18. Being similar to golf history, originally, human uses the hand to throw the stone. To increase the throwing distance, people swivel the long pole/club to hit the stone/golf ball. Today, the disk-golfer still uses the hand to throw the flying disk to fly. To increase the flying distance, people should swivel the pole to launch the flying disk to fly. However, due to the technology barrier of swiveling to launch, the dream of disk-golf never becomes true. The process of launching disk to fly with the swiveling pole cannot have any blockade force of grabbing force or clamping force, etc. Just as the airplane taking off process, any grabbing or holding force will be constituted of the blocking blockade to the airplane that the airplane will be hit by the blocking blockade and fall to the ground as the disaster of airplane crash. It takes a long time to learn this lessen. It makes all the previous inventions of flying disk fail to work. So, until now, instead of launching the flying disk with the long pole, the disk-golfer still uses the hand to throw the flying disk. The throwing distance is short. The disk-golf is only adopted the form of golf. However, so far, there is no reality of disk golf, i.e., swiveling pole to launch the disk to fly for a long distance. Our invention is the first to make the dream of disc golf to come true.

The golfrisbee sport, as shown in FIG. 1, is to swivel the golfrisbee club to increase the throwing distance and flying height of the golfrisbee disk. The inventors make the technology breakthrough in the swivel-to-launch techniques to make the dream of Golfrisbee become true. To differentiate from the hand-throwing "disk-golf" game, we call this new game to be golfrisbee. The player of disk-golf is disk-golfer. The player of golfrisbee is golfrisbeer. In the golfrisbee sport, the golfrisbeer swivels the golfrisbee club to launch the golfrisbee disk to fly. For convenience, the golfrisbee disk is simply referred as golfrisbee. The golfrisbee club is simply referred as club or golh club. The sport of golfrisbee is also mentioned as golfrisbee for brevity.

The launching disk to fly process cannot have any grab or clamping force. In the taking off process, any grab or clamping force is constituted of the blocking holdup. The disk will be dragged by the blocking holdup and falling to crash on the ground. It takes a long time to learn this lessen that launch flying disk to fly cannot have any moving parts to clamp or grab the flying disk. The clamping and grabbing disk constituting of the holdup blockade makes a lot of previous inventions fail to work.

In our invention, there are no moving parts on the golfrisbee pole and there is no electrical motor and battery on the golfrisbee pole. The swivel of pole generates the eccentric force to rotate the disk. The rotating disk rotates on the golh club head and automatically take-off from the blockless snapping lock of the screw head. Due to the tangential speed of the swiveling pole, the flying disk has high swiveling speed. As the flying disk takes off from the golh club head, it launches to fly in the sky immediately. All the disk power of rotation and fly in the above process comes from the hand swiveling. There is no need for the electrical motor and battery at all.

My invention doesn't need the battery and electrical motor at all. Due to the eccentric force caused by the eccentric alignment of the pivotal axis and rotational axis, swiveling the pole, the disk will rotate automatically. With the fast swiveling movement and the automatic rotation of disk, the disk will take off to fly. This pole throwing disk process is just as the same as human using the hand to throw the disk to fly. With our new invention, the disk golfer can throw the flying disk more than 1500 feet to 2000 feet away. It breaks the Guinness' record of the farthest distance the human can throw. The process is accurate and repeatable and throwing much far away than human's hand does. It is compatible to and superior to today's golf sport.

As shown in FIG. 1, golfrisbee is the hybrid game combining the sports of golf, flying disk, baseball, and hockey together to be a new game. The player swivels the golfrisbee club as the golfer or baseball player does. The golfrisbee disk is launched to fly as the flying disk does. The golfrisbee game rule is the same as golf. The disk can also be pushed to roll as the golf does or be pushed to skid as the hockey does on the ice. The golfrisbee combines the merits of golf, baseball, and flying disk. Even much better, it is safer and more fun to play. The golf and baseball are dangerous sports that they need special places to play, i.e., the golf course or baseball field. As the golf ball or baseball hits on the head of people, it will kill people. So, the dangerous golf sport is forbidden to play in the public park. However, you can play the flying disk in the park. The high fly disk is not dangerous. The flying disk drifts smoothly with soft-landing. It will not hurt anybody. You cannot see the golf ball as the golf ball flies high in the sky. However, for the golfrisbee player, you will enjoy seeing the flying disk drifting in the sky.

As shown in FIG. 1A, the golh is the hybrid golf sport constituted of golfrisbee 1 and golfball 15. The golh sport is to swivel the golh club 2 to launch the golfrisbee 1 to fly or throw the golfball 15 to the hole. Then putt the ball 151 to roll into the hole or portable hole 6 with the golh club. The golfrisbee 1 is to be thrown into the golfrisbee basket 18 with the golh club 2. The long drive is played with the golfrisbee disk 1 and golfball 15. The flying distance of the golfrisbee 1 is compatible with the conventional golf ball. For safety purpose, the golh can be limited to (1) outside green, drive with the golfrisbee; and (2) on the green, putt with the golf ball 151.

To fly the disk with the swivel of a pole, our invention is the only invention having no moving parts on the pole. The process is accurate and repeatable and throwing much farther away than human's hand does. Furthermore, the golfrisbee player no more throws and catches the golfrisbee disk with hand. Therefore, it is safe to add the advanced multimedia device and lifting blades to the golfrisbee disk. The golfrisbee disk can generate the high lift with harmonic sound and shiny rainbow light as the golfrisbee glides in the sky. With our new invention, the disk golfer can throw the flying disk more than 1500 feet to 2000 feet away. It breaks the Guinness' record of the farthest distance the human can throw. None of the previous patent can provide such kind unexpected results.

2. Description of Prior Art

The name of disk-golf is very similar to the name of golfrisbee. However, the name of the disk-golf is not proper. The disk-golf is not any kind of golf sport at all. The disk-golf does not use the club. The disc golf only uses the form of golf rule. Instead of swiveling club to increase the disk flying range, the disk-golfer still uses the hand to throw a disc from a tee pad to a basket on a pole. The disk-golf has to use the bundles of heavy steel chains to catch the flying disk. The score is based on the number of throws it takes to get the disc to fly in the basket.

No golf club, the golf is any more a golf sport. It is a stone-golf. It just throws the golf ball with hand. Stone-golf has no fun. The stone golf is an unfair game, either. For the stone-golf, the stone-golfer uses the hand to throw the stone to play golf. Whoever is stronger will win the game.

Using key words "disk-golf" to search on the Internet, it is easily to find out millions of web sites addressing on disk-golf. It is a hot sport. Therefore, Golfrisbee is a market-pull product and technology. The market is already there. However, there is no proper product and suitable technology to fit for the requirements of the demanding market. Definitely, our golfrisbee is the right market-pull product for the demanding market. The consumers have waited for our golfrisbee for a long time. However, due to the technology barrier of swiveling-to-fly, until now, no body can invent such a simple mechanism to emulate the complicated process of human's throwing disk to fly. Therefore, people have to accept the disk-golf sport as a poor substitutive solution. Disk Golfers suffered from the inability to have swiveling pole to launch the light-flying disk having long range flying capability. The present invention provides there features, thereby solving a long-felt need in this area. So far, the disk golfers still use the hand to throw the fly disk for more than 20 years. The industry cannot deliver the golf club to launch the flying disk. Now, with our new invention, the disk golfer can play the flying disk as the golfer does. Disk-golf is similar to stone-golf. No club, the disk-golf is no more disk-golf. The disk-golfer still throws the disk with hand. It has no fun, either. As our golfrisbee sport becomes popular, it is hardly believe that the disk-golf will survive any more.

Our first inventor had invented U.S. Pat. No. 6,193,620, the multi-media Frisbee-golf. It is the first patent to use the swivel techniques to launch a disk to fly. Comparing our invention with previous patents, our invention is to use a simple screw mechanism to emulate human's throwing disk process. In our invention, swiveling golfrisbee pole to rotate golfrisbee disk features to have blockless snapping take-off launching, there is no moving part on the golh club. In our new invention, the disk center is not coincident with the pivotal axis passing through the head of the pole. Swiveling the pole, the eccentricity of the disk center and the pivotal axis inducing the eccentric force will automatically rotate the disk to rotate. The rotation causes the disk to disengage with the screw of the pole to take off and fly. The flying disc flies horizontally with very small angle of attack that this is blockless snapping take off process that the disk will fly far away.

All the other patents have the moving parts inducing the friction to blockade the disk to launch to fly. Their patents have the moving parts to grasp or clamp the flying disk that the flying disk falls to ground like the crash of airplane. The grasping or clamping blockade force cause the disk cannot fly far away, cannot have accurate throw and cannot have the repeatable performance. Other inventions have very complex mechanical moving parts. Those moving parts either grasp or lock with biasing forces. There is no perfect releasing mechanical mechanism that the moving parts contribute the blocking blockades to the taking off disk. The taking off disk will turn over and falls to the ground in a very short distance.

We make the technology breakthrough in the emulation of human throwing flying disk to fly. It is the most efficient way to launch the flying disk with our golfrisbee club. Furthermore, we make the system integration of the swivel-to-launch technology with golf to be the sport of golfrisbee. The golfrisbee sport is similar to the golf. The golfer swivels the golf club to hit the ball to fly or push the ball to roll into the hole. The golfrisbeer swivels the golfrisbee club to launch the golfrisbee disk to fly or push the disk to roll or skid with club into the hole.

OBJECTS AND ADVANTAGES

Swivel-to-launch with club increases the flying distance of the disk. A new golfrisbee and a new golfrisbee sport are invented: swiveling golfrisbee pole to rotate golfrisbee disk to have blockless snapping take-off launching. It doesn't need any power device such as electrical motor and battery. During the swivel of pole, the eccentric force automatically rotates the disk to rotate and launch the disk to fly.

We have built a prototype for this invention. There is no moving mechanical part in our new invention. With the prototype, we make the demonstration for the golfrisbee. Our invention doesn't need any power device such as electrical motor and battery. During the swivel of pole, the eccentric force automatically rotates the disk to rotate and launch the disk to fly. Swiveling the golfrisbee club, the golfrisbee disk automatically rotates and takes off to fly in the sky without the electrical battery and electrical motor. The golfrisbee club is one integrate unit. Other inventions have very complex mechanical moving parts. Those moving parts either grasp or are biased with biasing forces to clamp the flying disk. However, there is no perfect releasing mechanical mechanism for those grasp and clamp. The moving parts contribute the blocking blockade to the flying disk during the taking off of flying disk. Due to the blocking blockade, the taking off disk will turn over in the air and falls to the ground in a very short distance.

Golfrisbee is the combination of the baseball, golf, flying disk, and hockey together to be a new sport. The golfrisbee is similar to golf. The golfrisbeer swivels the club to launch the golfrisbee to fly. However, the safe golfrisbee sport can play in the park. Even one single player still can play and practice the golfrisbee sport in the park safely. It converts the conventional disk-golf to be the golfrisbee. The integrated multimedia device can be embedded in the golfrisbee to have the attracting and interesting multimedia effect.

The inventors have built a prototype and made many experiments. As we expect, the golfrisbee disk flies much farther, much higher and much better than the hand-throwing flying disk. Furthermore, the flying performance of golfrisbee is steady and repetitive. The golfrisbee always makes the successful flight each time.

It is well known that the human player cannot repeat the same performance every time. The golfrisbee does not have the unsteady problems as hand-throwing flying disk has. The reason is the launching parameters such as angle, speed, direction, etc. have been cast in the golfrisbee. These parameters have very narrow working ranges. The human cannot repeat all these narrowly ranged parameters all the time. All these narrowly ranged parameters are calibrated and cast in the basic golfrisbee club and disk. As the golfrisbeer swivels the club, these parameters repeat the same values all the time. Therefore, the golfrisbee has much better performance than the hand-throwing flying disk.

My invention is the only invention having no moving parts to swivel the disk to fly with pole blockless snapping. The process is accurate and repeatable and throwing much far away than human's hand does. All the other patents have the moving parts inducing the friction to blockade the disk to launch to fly. Their patents have the moving parts to grasp or clamp the flying disk that the flying disk falls to ground like the crash of airplane. The grasping or clamping blockade force cause the disk cannot fly far away, cannot have accurate throw and cannot have the repeatable performance.

With our new invention, the disk golfer can throw the flying disk more than 1500 feet to 2000 feet away. It breaks the Guinness' record of the farthest distance the human can throw. The process is accurate and repeatable and throwing much far away than human's hand does. It is compatible to and superior to today's golf sport. None of the previous patent can provide such kind unexpected results.

Therefore, the adjustment of these parameters is very important. For the basic golfrisbee club and disk, the manufacture will use the model casting process to fix all the parameters to be the optimum values. The beginner golfrisbeer does not need to calibrate these parameters. For the customized golfrisbee, the expert golfrisbeer can make the fine tune and adjustment to his personal preference.

The golfrisbee does not need the special fixed disc golf basket as the disk-golf does. The golfrisbee disk can play as either hockey disk or flying disk. Therefore, the golfrisbee can share the same golf course with golf. The golfrisbee sport uses many different kinds of golfrisbee clubs and many different kinds of golfrisbee disks. As the golfrisbee becomes popular, a new industry will emerge. We create new market chances for the manufacturers and the owners of the golf courses

DRAWING FIGURES

FIG. 1 is the golfrisbee sport using the swivel of golh club to launch the golfrisbee disk to fly. As the golfrisbee disk falls into the portable golfrisbee disk basket, it is equivalent to the golfball rolls into the hole: (A) swiveling the golh club to fly the golfrisbee to the golfrisbee basket; (B) the golfrisbee hits on the flexible string and the cantilevers raise up to catch the golfrisbee; (C) the golfrisbee falls into the golfrisbee basket; (D) is the standing position of the portable golfrisbee basket; (E) is the portable pack form of the portable golfrisbee basket.

FIG. 2 (A) shows the wind-bell-chain reverted-umbrella type portable golfrisbee basket; (B) the golfrisbee basket has the wind-bell-chain hanger with multiple hooks to hang the golfrisbee; (C) is the wind-bell-chain of the golfrisbee basket; (D) is the wind-bell-chain hanger having multiple hooks; (E) is the sectional view of the reverted-umbrella type basket; (F) is the elevation view of the reverted-umbrella type basket; (G) is the sectional view of the stand; (H) is the elevation view of the stand; (I) is the elevation view of the wind-bell-chain; (J) is the sectional view of the alignment of the wind-bell-chain taken along the line J-J in FIG. 2I; (K) is the exposed sectional view of the wind-bell-chain hanger and support; (L) is the partial exposed elevation view of the wind-bell-chain hanger and support; (M) is the front view of the wind-bell-chain; (N) is the side view of the wind-bell-chain; (O) is the sectional view of a pole locker; (P) is the elevation view of a pole locker; (Q) the pole locker is applied to the extension pole; (R) the pole locker is applied to the stand; (S) is the fixed wind-bell-chain golfrisbee basket; (T) is the alternative design of the fixed golfrisbee basket;

FIG. 3 is the official standard golfrisbee basket adopted by PGFA (Professional GolFrisbee Association); (A) is the golfrisbee basket has the wind chime and foldable basket; (B) is the basket made of the web of portable golfrisbee basket; (C) is the alternative design of the basket made of the web of portable golfrisbee basket; (D) is the alternative design of the tripod of portable golfrisbee basket; (E) is the wind chime of the golfrisbee basket; (F) is the partial exposed section view of the wind chime of the golfrisbee basket; (G) is the alternative design of wind chime for the golfrisbee basket; (H) is the partial exposed section view of the alternative design of wind chime for the golfrisbee basket;

FIGS. 4 (A) and (B) are the mounting operations of the golfrisbee; (A) mounting the golfrisbee on the club head; (B) rotating golfrisbee half cycle with the club head being pivotal center to have the golfrisbee to be in the locked position; (C), (D) and (E) are the swivel of golh club to launch the golfrisbee to fly; (C) swiveling the golfrisbee club backward slowly; (D) swiveling the golfrisbee club forward fast to launch the golfrisbee disk; (E) at the designated launching point, the golfrisbee disk takes off and flies in the sky.

FIG. 5 is the mechanism study of the golfrisbee operation; (A) mounting the golfrisbee on the golh club; (B) rotating 180 degree to engage the golfrisbee with the golh club; (C) swivel the golh club to launch the golfrisbee to fly.

FIG. 6 is the detailed analysis of the launching of the golfrisbee; (A) is the vector analysis of the mechanism of the swiveling the golh club to launch the golfrisbee to fly; the golfrisbee has the tangent velocity V and the angular momentum M at the launching point; (B) is the golfrisbee is too early to launch the golfrisbee to fly; (C) is the optimum launching angle to launch the golfrisbee to fly; (D) is too late to launch the golfrisbee to fly.

FIG. 7 is to use the golfrisbee club to push the golfball or golfrisbee to roll into the holes; (7A) is to use the golh club to push the golfball to roll into the universal portable put & hole; (7B) is to use the golh club to push the golfrisbee to roll into the golfrisbee hole with the golfrisbee be mounted on the universal portable put & hole being put.

FIG. 8 is the universal portable put and hole means which is a portable put for golfrisbee and portable hole for golfball. The view of portable put and hole has a slot for the putting of golfrisbee; the disc is inserted in the slot to mount on the universal portable put and hole; (A) is the view of a portable put and hole having the hole for the golfball; (B) is the sectional view of the portable put for golfrisbee; (C) is the plug to convert the portable put to be the portable hole for the golfball and vice versa.

FIG. 9 is the basic set of golh including golh club, golfrisbee, golfball and dust cover; (A) is the elevation view of the golfrisbee disk; (B) is the side section view of the golfrisbee disk; (C) is the side view of the golfball; (D) is the side section view of the golfball; (E) is the right-hand golfrisbee club having the right hand screw on the club head; (F) is the section view of the right-hand golfrisbee club having the right-hand screw on the golh head; (G) is the left-hand golfrisbee club having the left hand screw on the club head. (H) is the section view of the left-hand golfrisbee club having the left-hand screw on the golh head.

FIG. 10 The killer applications of the golh club throwing golfball to the golh-grenade, golh-gun, water-golh-grenade and water-golh-gun; (A) is the golfball being thrown with the golh club as shown in FIG. 14D; (B) is the section view of the golfball with the fast release latch; (C) the golf-arrow is the golfball with the arrowhead; (D) is the golh club being swiveled to throw golfball; (E) is the golh-grenade; (F) is the block diagram of the smart golh-grenade; (G) is one implementation of the smart golh-grenade; (H) is the water-golh-grenade; (I) is the water golh-gun; (J) is the golh-gun; (K) is the alternative design and operation of the golh-gun.

FIG. 11 is the screwless golh club and screwless golfrisbee made of the fast release snapping means; (A) is the screwless golfrisbee; (B) is the side view of the screwless golh head; (C) is the front view of the screwless golh head; (D) is the bottom view of the screwless golfrisbee disk; the fast release snapping means of the screwless golh head is fit in screwless golfrisbee disk and rotate freely.

FIG. 12 is the exchangeable golh club head and golfrisbee screw; (A) is the sectional view of the golfrisbee disk; (B) is the side view of the right hand screw golh club; (C) is the side view of the left hand screw golh club; (D) is the bottom view of the golfrisbee having the exchangeable golfrisbee screw.

FIG. 13 is the basic golfrisbee made of fast release screw means; (A) is the sectional view of the basic golfrisbee disk; (B) is the side view of the basic golfrisbee club; (C) is the bottom view of the basic golfrisbee disk FIGS. 14 (A), (B), (C) and (D) are the analytical mechanism for the conventional single thread screw which fails to be the screw mechanism of the golfrisbee; (A) is the top view of the conventional single thread screw; (B) is the side view of the conventional single thread screw; (C) is the generation of the overturning momentum; (D) is the stall of the golfrisbee during the flight; (E), (F), (G) and (H) are the analytical mechanism for the dual-half ring screw which is essential to be the screw mechanism of the golfrisbee; (E) is the top view of the dual-half ring screw; (F) is the side view of the dual-half ring screw; (G) is the generation of the counting momentum to cancel the overturn momentum to keep the golfrisbee to be in the horizontal attitude during the launching process; (H) is the golfrisbee keep the horizontal attitude to fly in the sky without the stall generating by the overturning momentum.

FIG. 15 The comparison study of the golfrisbee screw mechanism with the conventional screw mechanism made of cap and bottle; (A) the complete scheme of the screw mechanism; (B) is the screw mechanism of the golfrisbee; (C) is the screw mechanism of the head of the golh club; (D) is the screw mechanism of the conventional cap; (E) is the screw mechanism of the conventional bottle.

FIG. 22 is the golf club with the alternative design of golh club head; (A) is the top view of the alternative design of the adjustable golh club head; (B) is the fast golf club; (C) is the combinatory golh club having the adjustable golh club head and the fast golh club head. (D) is the side view of the fast golh club head; (E) is the top view of fast golh club head; (F) is the fast golh club head holding the pole to throw the pole; (G) is the fast golh club head holding the golfrisbee ring; (H) swiveling the fast golh club, the golfrisbee ring pivotally rotates around the axle of fast golh club head; (I) the golfrisbee is released and slides over the slope to disengage with the fast golh club head; (J) is the golfrisbee ring taking off from the fast golh club head to fly.

FIG. 23 (A) is the sectional view of customized golfrisbee is the open platform for the different screw mechanism; (B) is the personalized golfrisbee is the open platform for both adjustable weight and different screw mechanism; (C) the adjustable weight is a unit package to be replaced; (D) the weight in the weight packet can be adjustable; (E) is the partial exposure view of the customized golfrisbee club.

FIG. 24 is the adjustable golfrisbee with the fitting cap position being adjustable from the middle to the rim; (A) is the sectional view taken at the line A-A in FIG. 12C; (B) is the motor enhanced golfrisbee club for the adjustable golfrisbee disk; (C) is the bottom view of the adjustable golfrisbee disk.

Figure 25A:
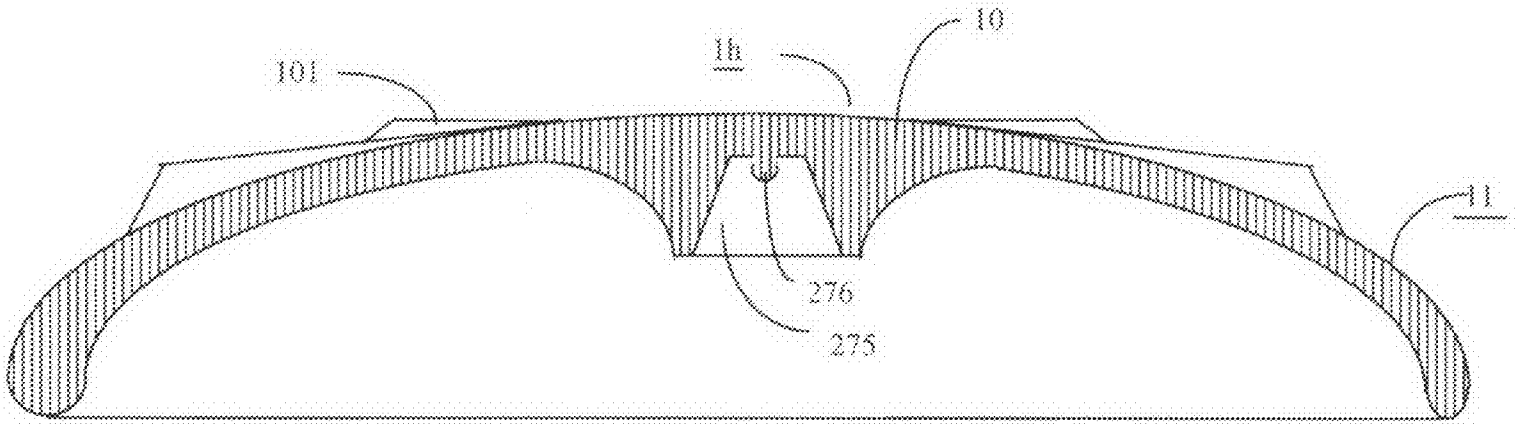
Figure 25B:
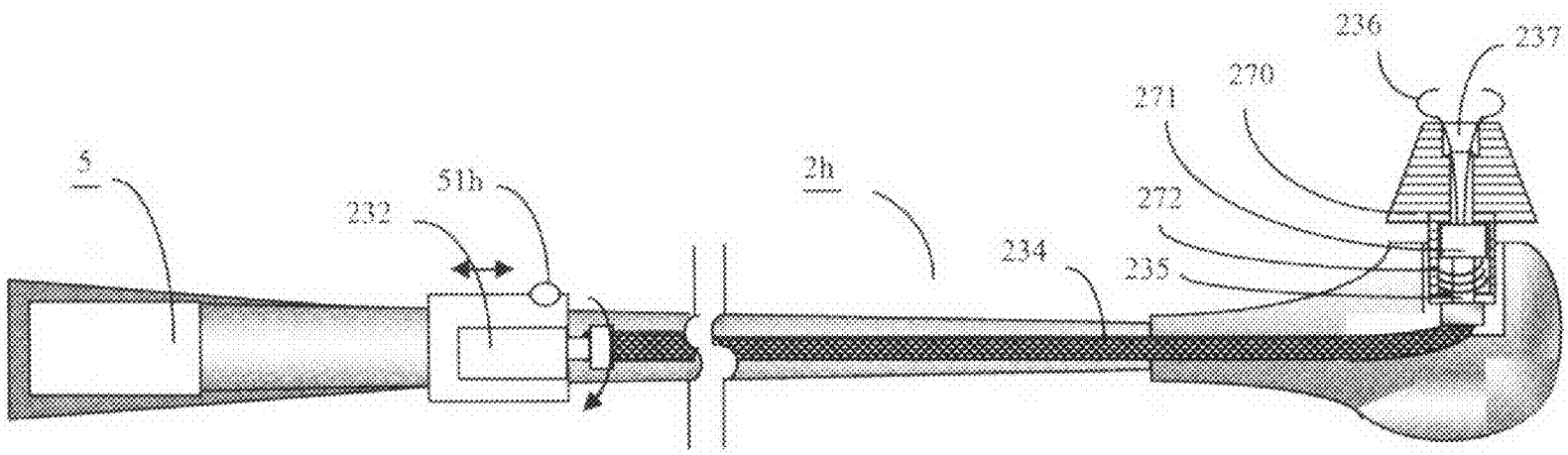

FIG. 25 is the partially exposed sectional view of the helicopter type of golfrisbee; (A) is the helicopter type golfrisbee; (B) is the helicopter type golfrisbee club.

Figure 26:
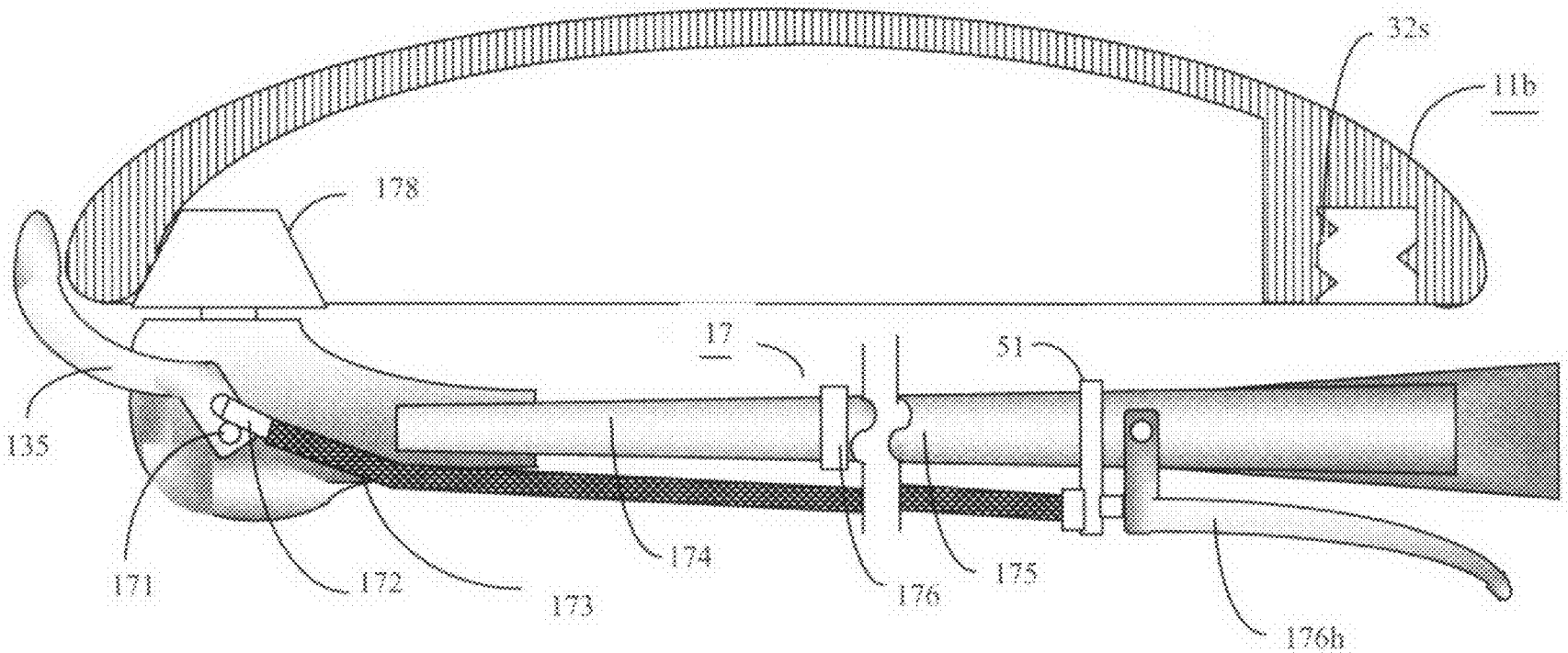

FIG. 26 is the partially exposed sectional view of the pick & throw golfrisbee club.

Figure 27A:
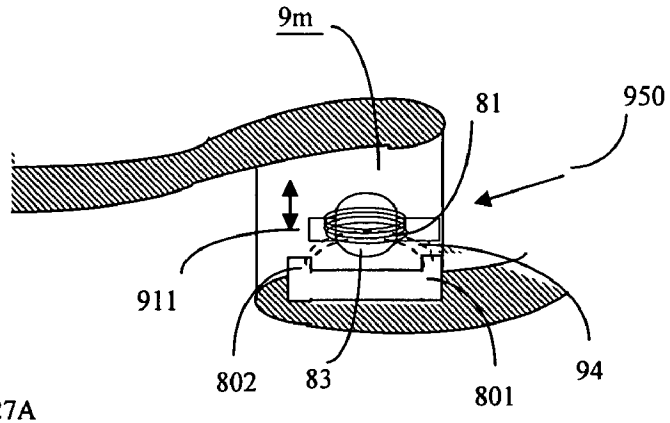
Figure 27C:
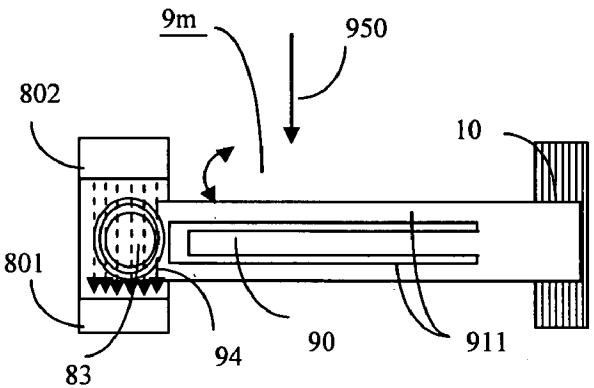
Figure 27B:
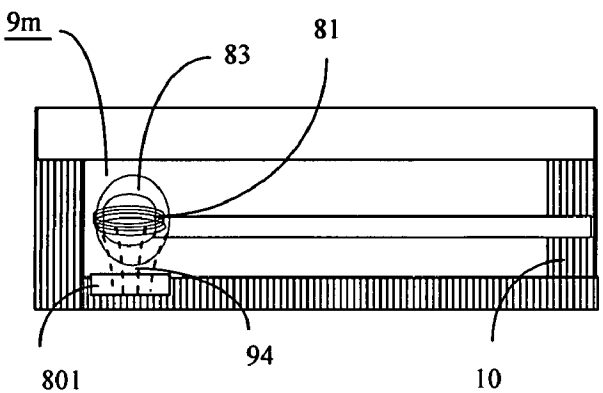

FIG. 27 is the integrated multimedia device for the golfrisbee; (A) is the sectional view of the integrated multimedia device; (B) is side view of the integrated multimedia device; (C) is the top view the integrated multimedia device.

FIG. 28 (A) is the partial exposed sectional view of the golh head with the dust cover; (B) is the top view of the golh head having the dust cover; (C) is the top view of the dust cover for the golh head.

Figure 29A:
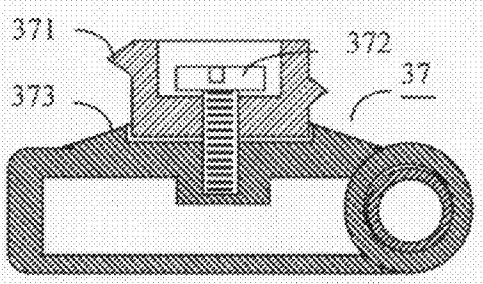
Figure 29B:
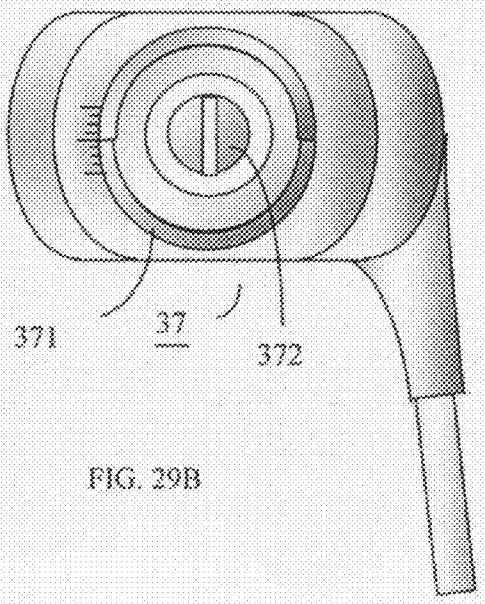

FIG. 29 is the section view of the alternative design of the adjustable golh club head; (A) is the section view; (B) is the top view of the golh club head.

FIG. 30 is golh club head. (A) is the top view of the golh club head; (B) is the elevation view of the launching screw; (C) is the partial elevation section view of the golh club head; (D) is the top view of the anti-skid teeth of golh club head and the bottom view of the launching screw; (E) is the elevational section view of the anti-skid teeth of golh club head and the launching screw; (F) is the top view of the anti-skid teeth of golh club head and the bottom view of the matching teeth of the launching screw of the alternative design; (G) is the elevational section view of the anti-skid teeth of golh club head and the teeth of the matching teeth of the launching screw.

FIG. 31 is the high fly long drive type golfrisbee. (A) is the flying trajectory of the high fly long drive type golfrisbee; (B) is the elevational view of the high fly long drive type golfrisbee; (C) is the side view of the high fly long drive type golfrisbee; (D) is the sectional view of the wing of the high fly long drive type golfrisbee.

FIG. 32 is the horizontally fly putting type golfrisbee. (A) is the flying trajectory of the horizontally fly putting type golfrisbee; (B) is the flying trajectory of the high fly putting type golfrisbee; (C) is the sectional view of the wing of the horizontally fly putting type golfrisbee.

FIG. 33 is the left dogleg type golfrisbee. (A) is the flying trajectory of the left dogleg type golfrisbee; (B) is the elevational view of the left dogleg type golfrisbee; (C) is left turn of the left dogleg type golfrisbee; (D) is the right side elevational view of the left dogleg type flying golfrisbee; (E) is the left side elevational view of the left dogleg type flying golfrisbee.

FIG. 34 is the right dogleg type golfrisbee. (A) is the flying trajectory of the right dogleg type golfrisbee; (B) is the elevational view of the right dogleg type golfrisbee; (C) is right turn of the right dogleg type golfrisbee; (D) is the right side elevational view of the right dogleg type flying golfrisbee; (E) is the left side elevational view of the right dogleg type flying golfrisbee;

FIG. 35 is the ring-ring pair of golfrisbee; (A) is the top view of ring-ring pair; (B) is the sectional view of ring-ring pair taken at the line E-E in FIG. 35A; (C) is the sectional view of the backbone module of the ring-ring pair; (D) is the sectional view of the rubber/foam plastic module of the ring-ring pair.

FIG. 36 is the ring-disk pair of golfrisbee; (A) is the top view of ring-disk pair; (B) is the sectional view of ring-disk pair taken at the line L-L in FIG. 50A; (C) is the sectional view of the backbone module of the ring-disk pair; (D) is the sectional view of the rubber/foam plastic module of the ring-disk pair.

FIG. 37 is the golfrisbee clamping fixture. (A) is the golfrisbee clamping fixture in the open position; (B) is the golfrisbee in the clamping position; (C) is the top fixing cover of the golfrisbee fixture; (D) is the top moving clamping plate of the golfrisbee fixture; (E) is the bottom fixing plate of the golfrisbee fixture; (F) is the block diagram of the temperature control of the golfrisbee fixture.

DESCRIPTION AND OPERATION

As shown in FIG. 1A, FIG. 1B, FIG. 1C, FIG. 2A, FIG. 2B, FIG. 2S, FIG. 2T and FIG. 3A golfrisbee sport includes a golfrisbee 1, golh club 2 and the throwing target of golfrisbee basket 4. Swiveling the golh club 2 to launch the golfrisbee 1 to fly into the throwing target of golfrisbee basket 4.

The flying disk is very difficult to launch to fly. The human throwing to fly is the only efficient way to launch the flying disk to fly. However, the human arm is short. The force of human arm is weak. Therefore, the flying distance is short. To increase force, we use the waist force. To increase speed, we swivel a golh club to launch the flying disk to fly. In other words, to increase the flying distance, as the golf does, we need swivel the club to launch the flying disk. It will increase both the swiveling force and speed. However, the golfrisbee basket and the disc golf basket cannot interchange or share each other. The golfrisbee is hit on the outside of the target flexible string 42 or the tube, etc of the shock absorbing mechanism. The conventional disc of disc golf is trapped inside the bundle of chains. The disc of disc golf has to hit on the bundle heavy steel chains hanging along the peripheral of the basket. The disc has to be small and heavy to be able to penetrate into the bundles of chain of disc golf basket to be caught inside of the bundles of the chain. The heavy disc of disc golf will hurt people that it cannot be played in the park as the conventional flying disc does. The disc of disc golf must be played in the disc golf course and it cannot be played in the park.

Figure 1A:
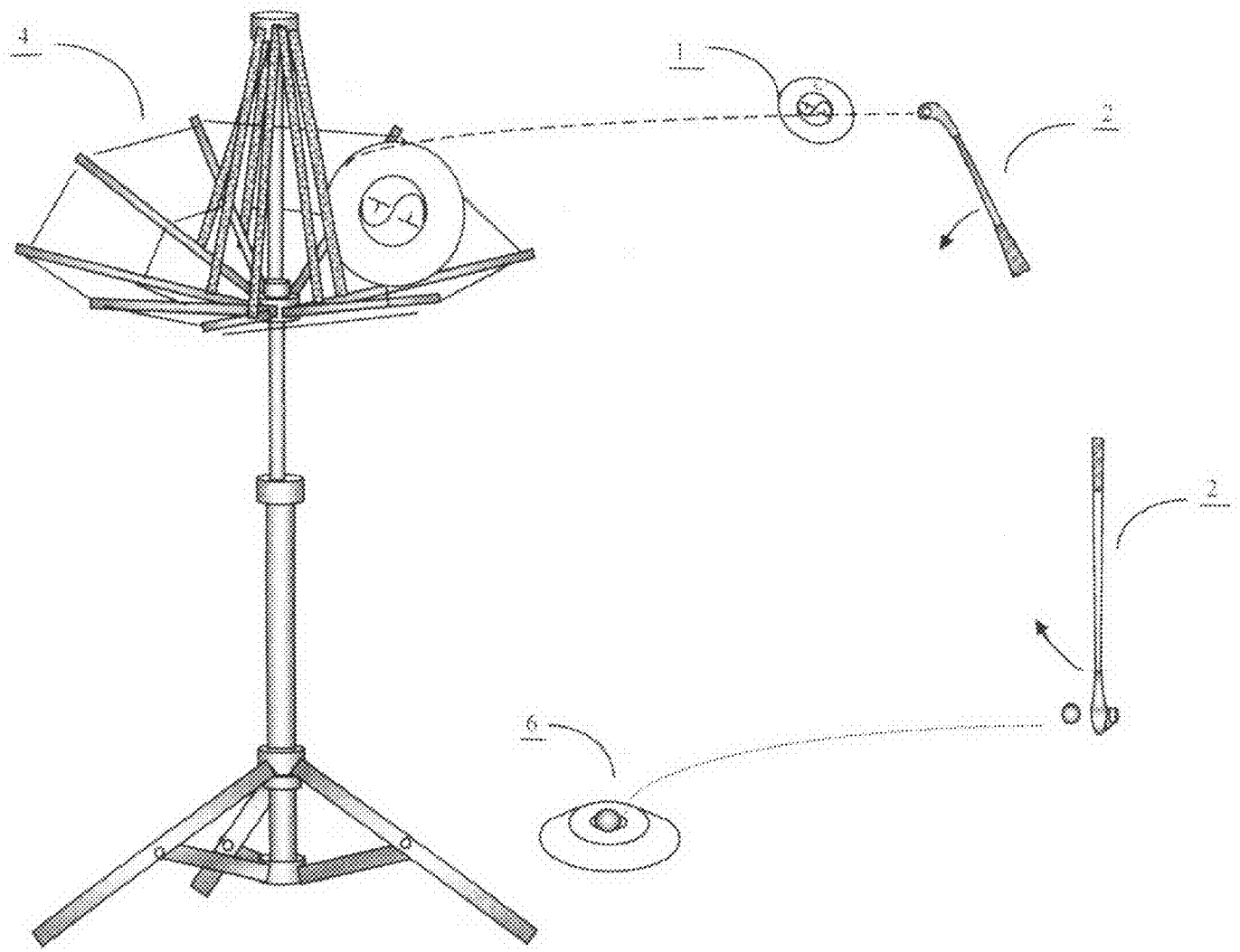
Figure 1B:
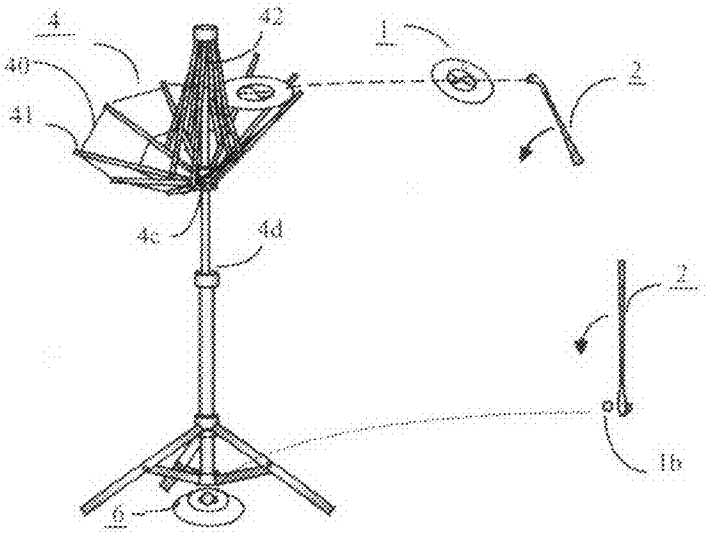
Figure 1C:
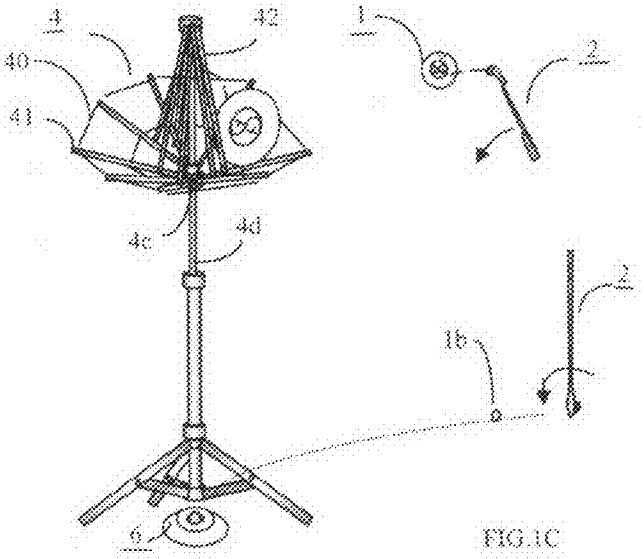
Figure 1E:
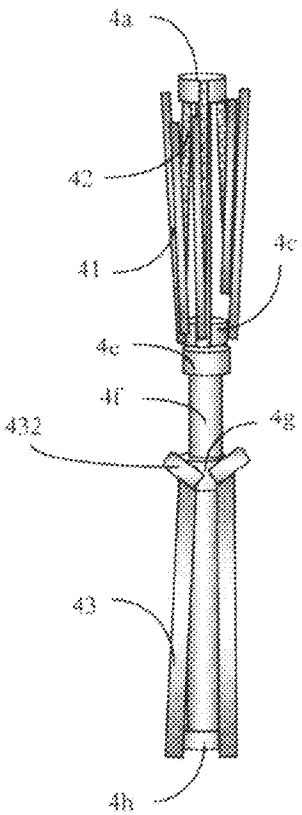
Figure 1D:
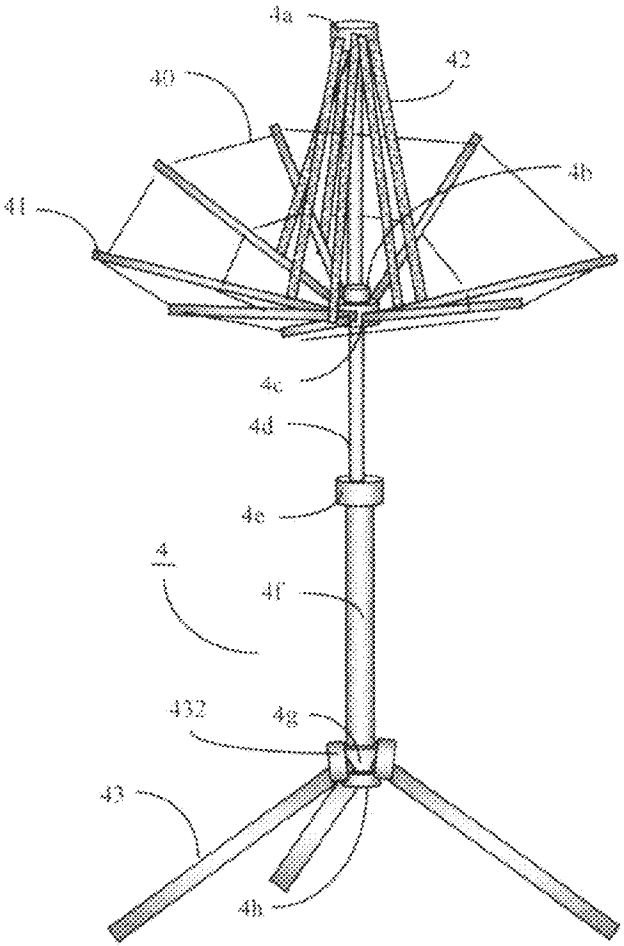
Figure 2B:
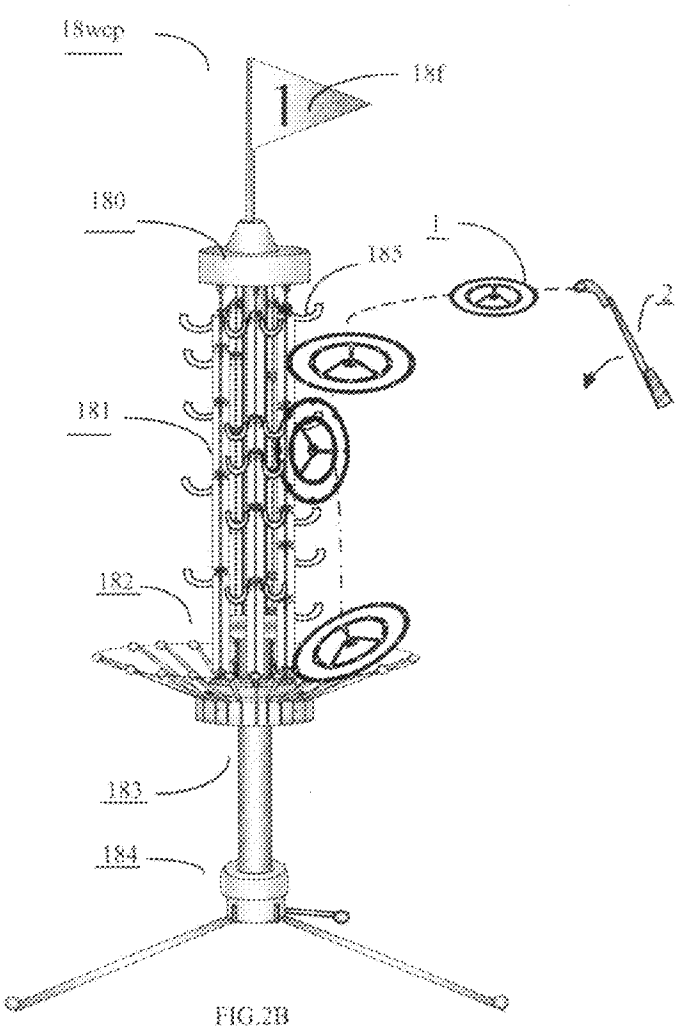
Figure 2A:
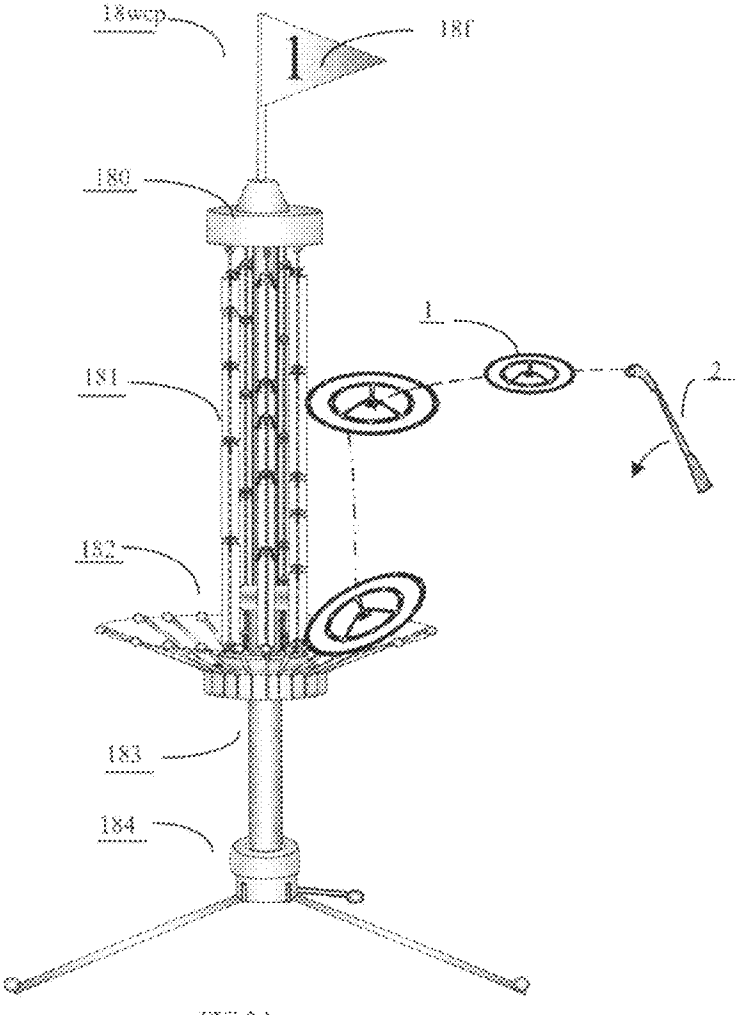
Figure 3S:
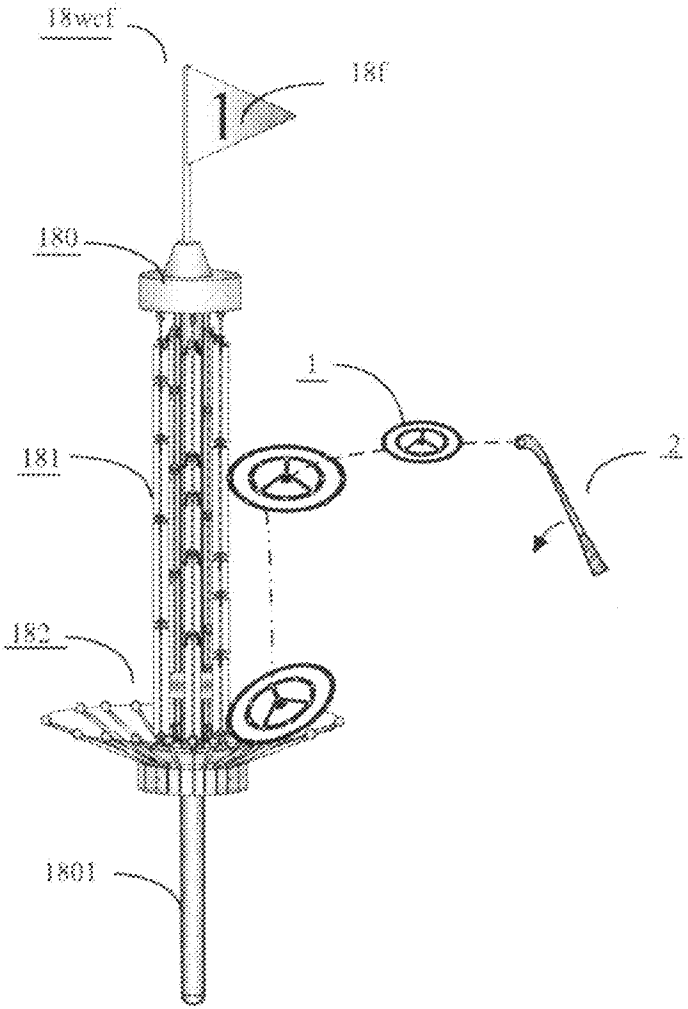
Figure 3B:
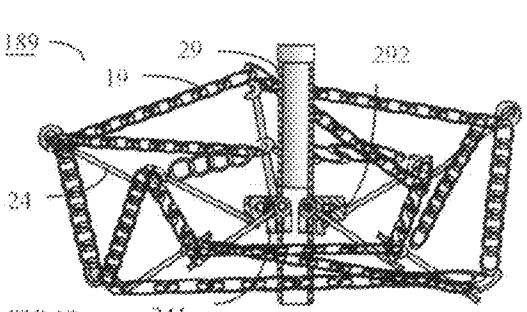
Figure 3C:
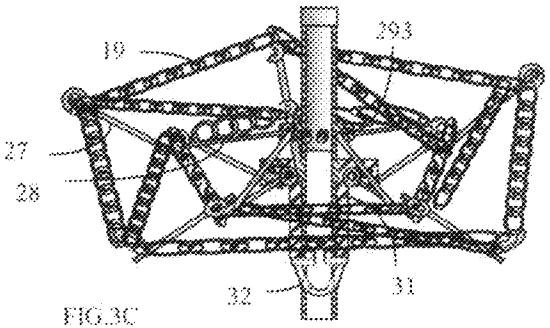
Figure 3D:
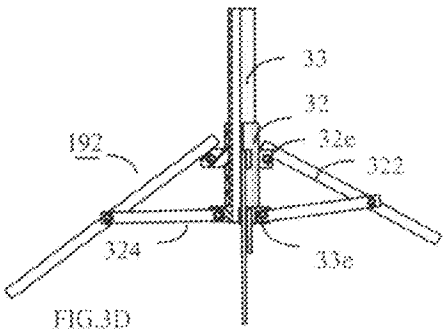
Figure 3A:
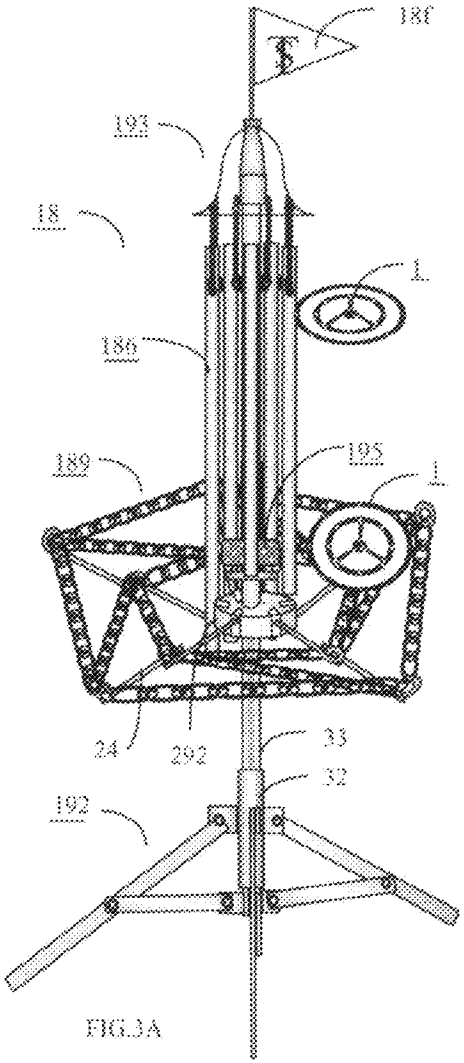

As shown in FIG. 1D. FIG. 2A and FIG. 3A, the golfrisbee basket 4 or golfrisbee basket 18 comprises a foldable basket. The foldable basket 4 or golfrisbee basket 18 have a plural of links 4*l* or 1821 or hooked link 24 with one end being pivotally hinged to a sliding/swiveling hinge 4*c* or 182 or 292 sliding/dangling mounted on the post 4*d* or 183 or 29. The link having an end being biased against to the sliding/swiveling hinge 4*c* or 182 or 292. An option is to have the plural of chain 189 or string 40 to be hooked to the links 4*l* or 1821 or hooked link 24 to form a support web. The foldable basket is opened with the weight of the links 4*l* or 1821 or hooked link 24 and the support web. The string 42 can be easily replaced with the tube 186. As shown in FIG. 1D, FIG. 2A, FIG. 2B, FIG. 3A and FIG. 3C, the golfrisbee basket 18 comprises wind-bell chimes 186, top hat 193, portable golfrisbee basket 4 and post 4*d*. The top hat 193 is installed on the top position of the post 4*d*. The wind-bell chimes comprises a plural of tubes 186 hanging below the top hat with strings around the post 4*d*, The portable golfrisbee basket 4 comprising a naturally spreading basket and a standing pole 4*d*. The naturally spreading basket comprises a net 40 and cantilever 41. The basket is for catching and holding disk being thrown in the portable golfrisbee basket, net being supported by the cantilevers 41 for spreading net 41 to catch and hold disk 1. The cantilever 41 can have the hooked end as shown in FIG. 3A and FIG. 3C. The cantilever 41 has middle hinges being hinged at end of said wind chiming tubes 186 and biased to the standing pole 4*d* with sliding ring 4*c* for supporting said cantilever 41 and net 40 and cantilevers 41 are free to rotate and falling to spread the net 40 naturally due to gravity. The cantilever 41 are retractable with pivotal rotation at middle hinges that said portable golfrisbee basket 4 being portable.

As shown in FIG. 2G, FIG. 2O, FIG. 2Q and FIG. 3D, etc, the portable golfrisbee basket 4 further comprising the extendable pole 4*d* sliding in one base pole 4*f* and being locked with a locking means 4*e*, The pole 4*d* has tripod hinged to one sliding ring 4*g*, locking the sliding ring with a locking means, Releasing the locking means 4*e*, the extendable pole slides into the base pole 4*f* for carry. The tripod standing on ground, releasing the locking means 4*e*, the tripod 43 is retractable to be portable.

As shown in FIG. 1, the golfrisbee and golfrisbee basket are designed to play in the park. So the long range flying golfrisbee is light and it will not hurt people. The golfrisbee is large that it can hit on the pole 4*d* of golfrisbee basket easily. The cantilever 41 and net 40 are light that it can easily raise up to grasp the golfrisbee 1 in the active catch process. Comparing the golfrisbee 1 with conventional disc golf, the golfrisbee 1 is light and large to hit on the outside of the small dimensional pole target 4*d* or the flexible string 42 of active golfrisbee basket 4, it can play in the park. The disc of disc golf is heavy and small to hit the large dimensional bundle heavy chain of passive disc golf basket and is caught inside the chain. It only can play in the golf course, not in the park. As shown in FIG. 1B, the portable golfrisbee basket 4 is for disk 1 to be thrown into the portable basket 4. The portable golfrisbee basket 4 comprises a net 40 for catching and holding disk 1 being thrown in portable golfrisbee basket 4. The cantilever 41 for spreading net 40 to catch and hold said disk 1 supports the net 40. Each cantilever 41 has one end being hinged to a standing pole 4*d* for supporting the cantilevers 41 and net 40. The cantilevers 41 are retractable with the pivotal rotation at hinges on the pole 4*d* that said portable golfrisbee basket 4 is portable. There are different ways to make the pivotal rotation at hinge on a flange means of the pole 4*d*. To be more compact as the golfrisbee basket 4 is folded, the portable basket 4 further comprises a sliding ring 4*c* sliding on the pole 4*d* for these cantilevers 41 being hinged at said sliding ring 4*c*. In the compact golfrisbee basket, the flanges means becomes the sliding ring 4*c*. The sliding ring 4*c* slides on the pole 4*d*. There is an angle bracket end of the cantilever 41. The hinge passes through the angle bracket end of the cantilever 41. Under the gravity force, the cantilever will fall and stop as the angle bracket end of the cantilever 41 biases against to the pole 4*d*. As the cantilever 41 falls due to the gravity, the net 40 automatically spreads apart. There is no need for the umbrella type rigid link to expand the cantilever 40. This is the reverted type umbrella type structure. The gravity will make the reverted type umbrella type automatically open. The angle bracket end of the cantilever 41 will automatically stop the fall of the cantilever as the angle bracket end being biased against the pole 4*d*.

To make the golfrisbee basket 4 to be the active grasping basket, the cantilever 41 has the middle portion been hinged and supported by the pole 4*d* with a flexible string 42. The cantilever 41 has the middle portion been hinged to the flexible strings 42. The flexible string has one end hinged to the middle of cantilever 41 and the other end is hinged to a top of pole 4*d*. As the flying disk 1 hits on the flexible string 42, it falls into net 40. As shown in FIG. 1B, the flexible strings 42 are for absorbing the impact of flying disk 1. As the disc hits on the flexible string 42, the cantilever 41 raised up by the flexible string 42 absorbing the energy of flying disc 1 and actively grasping the disc 1. As shown in FIG. 1C, the disc 1 falls together with cantilever 41 and net 40 to have the soft landing. The other passive disc golf basket does not have the active grasping and holding disc action.

As shown in FIG. 1A, FIG. 1B, FIG. 1C, FIG. 1D and FIG. 1E, the golfrisbee basket comprises of a portable golfrisbee basket 4 for disk 1 being thrown into it. The portable basket 4 is naturally spreading due to gravity capability. The portable golfrisbee basket 4 comprises a naturally spreading basket 41 and a standing pole 4*d*. The naturally spreading basket 4 comprises a net 40 and cantilever 41. The basket 4 for catching and holding the disk 1 is thrown in the portable golfrisbee basket 1. The net 40 is supported by the cantilevers 41 for spreading the net 40 to catch and hold the disk 1. The cantilevers 41 have one end been hinged and biased to the standing pole 4*d* for supporting the cantilever 41 and net 40 and the cantilevers are free to rotate and falling to spread net naturally due to gravity. The cantilever is retractable with pivotal rotation at hinges that said portable golfrisbee basket being portable.

In FIG. 1A, swiveling the golh club 2 to launch the golfrisbee 1 to fly into the portable golfrisbee basket 4. As shown in FIG. 1B, the golfrisbee hits on the flexible strings 42 and the cantilevers 41 rise up the net 40 to catch up the golfrisbee 1. This unique active grasping action of the golfrisbee basket is not only absorbs the kinetic energy of the golfrisbee but also grasps the golfrisbee. As shown in FIG. 1C, as the cantilever 41 and net 40 having grasped the golfrisbee 1, the golfrisbee 1, cantilever 41 and net 40 fall back due to gravity. Our golfrisbee is light that the golfrisbee will not hurt people. Our golfrisbee is wrapped with the soft rubber that the golfrisbee will not be destroyed by the basket. So our golfrisbee can have the pole 4*d* to be the target instead of the bundle heavy chains as the conventional disc golf basket does. Comparing with the other passive disc golf basket, our golfrisbee basket target pole 4*d* is as small as a hole size. It is as challenge as the putting of golf ball.

The standing pole 4*d* of the portable golfrisbee basket 1 comprises a sliding ring 4*c* for these cantilevers 42 being hinged at sliding ring 4*c*. The sliding ring 4*c* sliding on the pole 4*d* and cantilever 41 having one end being hinged to said sliding ring 4*c*. The portable golfrisbee basket 1 is the actively grasping basket with moveable cantilevers 41 and flexible net 40 to absorb kinetic energy of golfrisbee 1 and actively grasp the golfrisbee 1 to have the soft landing. The naturally spreading basket 1 further comprises flexible string 42 to absorb the momentum of throwing disc 1 to be an active grasping basket. The cantilever 41 having middle portion being hinged to an end of the flexible string 42 and other end of flexible string 42 is hinged to a top portion and supported by the pole to have soft hit on the flexible string 42. The flexible strings 42 or wind-bell chimes are for absorbing impact of the flying disk 1. As the flying disc 1 fly toward the standing pole target 4*d*. the flexible string 42 or wind-bell chimes pulls and raises up the cantilever 41 and net 40 to actively catching the flying disc 1. Then the cantilever 41 and net 40 falls back together to the naturally spreading position with disc to have soft landing in active grasping basket. As shown in FIG. 3A, at the end of the cantilever, there is the hook for both the hang-up of the net and golfring.

As shown in FIG. 1D and FIG. 1E, the portable golfrisbee basket 1 comprises an extendable pole 4*d* sliding in one base pole 4*f* and being locked with a locking 4*e*. The pole 4 has tripod 43 hinged to one sliding ring 4*g*, locking said sliding ring 4*g* with a lock. Releasing the lock, the extendable pole 4*d* slides into the base pole 4*f* for carry. As the tripod 43 standing on ground: releasing the lock, the tripod 43 is retractable to be portable.

As shown in FIG. 1D, the portable golfrisbee basket has the net 40 woven on the cantilever 41. The cantilevers 41 have the flexible strings 42 supported. The flexible strings 42 are hinged between the cantilevers and the top support 4*a* of the pole of the portable golfrisbee basket 4. The ends of the cantilevers are hinged at the free sliding ring 4*c*. There is a stop ring 4*b* to stop the upward slide of the free sliding ring 4*c*. The upper pole 4*d* can slide in the lower pole 4*f* and is locked with the locking ring 4*c*. As the screw of the locking ring 4*c* is tightening, the upper pole 4*d* is locked. The tripod 43 is hinged against the sliding ring 4*g* with the end bias 432 biasing against the sliding ring. The locking ring 4*h* is pivotally mounted at the end of the lower pole 4*f*. As the locking ring 4*h* is engaged with the sliding ring 4*g*, the portable golfrisbee basket 4 can stand as the tripod does. Under the gravity force, the golfrisbee basket 4 will spread out automatically. The flexible strings 42 or the wind-bell chimes and the cantilevers 41 can free move to absorb the impact of the golfrisbee. As shown in FIG. 1E, the portable golfrisbee basket can be easily packed up for carry. Just releases the engagement of the lock ring 4*h* and release the locking ring, the portable golfrisbee basket 4 can be packed up.

With the three basic golfrisbee baskets as shown in FIG. 1, FIG. 2 and FIG. 3, we can make the versatile combinations of the golfrisbee baskets. As shown in FIG. 2A and FIG. 3A, the golfrisbee basket comprises wind-bell chimes 181 or 186 top hat 180 and post 39. The top hat 180 is installed on the top position of the post 39. The wind-bell-chimes 181 or 186 comprises a plural of tubes 186 hanging below the top hat 180 around the post 39. The distance of the tubes 186 of the wind-bell chimes are so close, narrow and have the confined movement that no flying golfrisbee 1 is able to pass through the tubes 186 of the wind-bell chimes. It is to protect the golfrisbee 1 from hit on the post 39 to be destroyed by the post 39. As an optional, there is a free swiveling chime block 195 with a central hole to be passed by the post 39. The chime block 195 is hit by the tubes 186 of wind chiming. The post 39 passes through the dangling chime block 195. As the flying golfrisbee 1 hits on tubes 186 of the wind-bell chimes, the tubes 186 swivels to absorb the impact energy of the golfrisbee 1 and generating melody. As the tube 186 being hit by the flying golfrisbee 1 hits on the free swiveling chime block 195, the free swiveling chime block 195 continues moving and hitting the other said tubes 186. The other tubes 186 swivels back and forth and hit on the free swiveling chime block 195 again. This process continues until all the tubes 186 swivel and generate the harmonic melody. The flying golfrisbee energy is dissipated as the audio energy of music.

FIG. 2 shows the standard golfrisbee basket 18*wcp* approved by the PGFA (Professional GolFrisbee Association). This is a portable type golfrisbee basket 18*wcp* to have the golf course converted to be the golh course. Instead of using hand-throwing disk as the disk golfer does, the golher swings the golh club 2 to launch the golfrisbee 1 to fly into the golfrisbee basket 18. On the golh course, there are many golfrisbee baskets 18. The golfrisbee basket 18 corresponds to the hole in the golf course. In golh sport, the golher launches the golfrisbee 1 to fly into the basket directly with the golh club 2. For the course golh, there is no tee-time requirement for the golfrisbee. The golher can play golh in the course any time and any place.

Figure 2D:
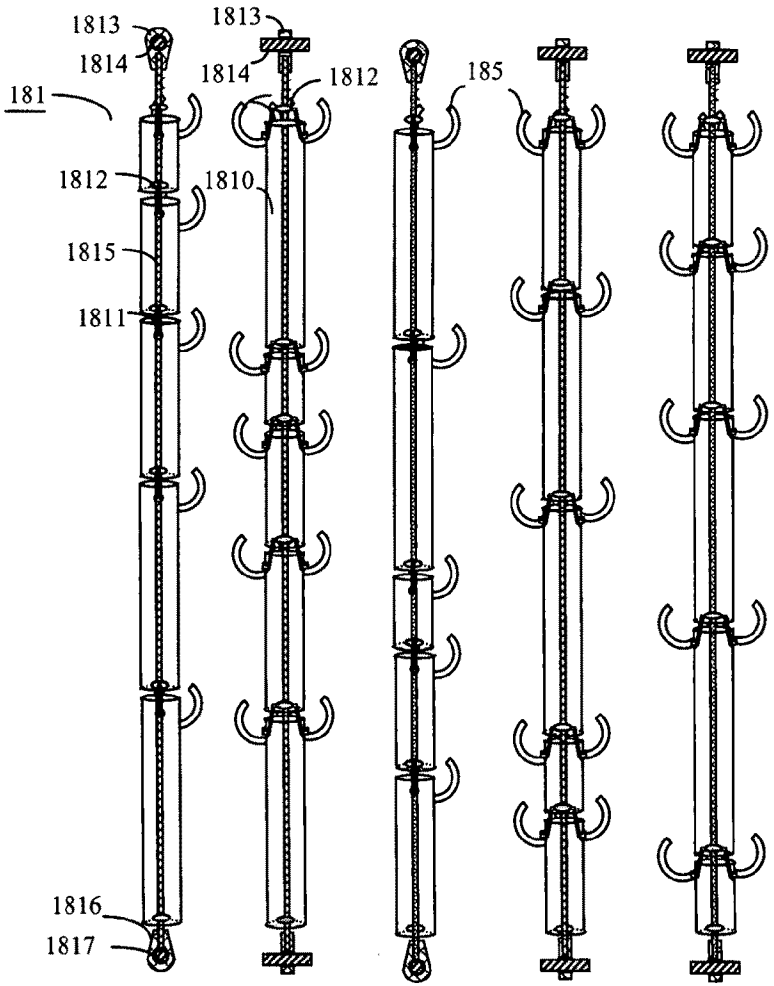
Figure 2C:
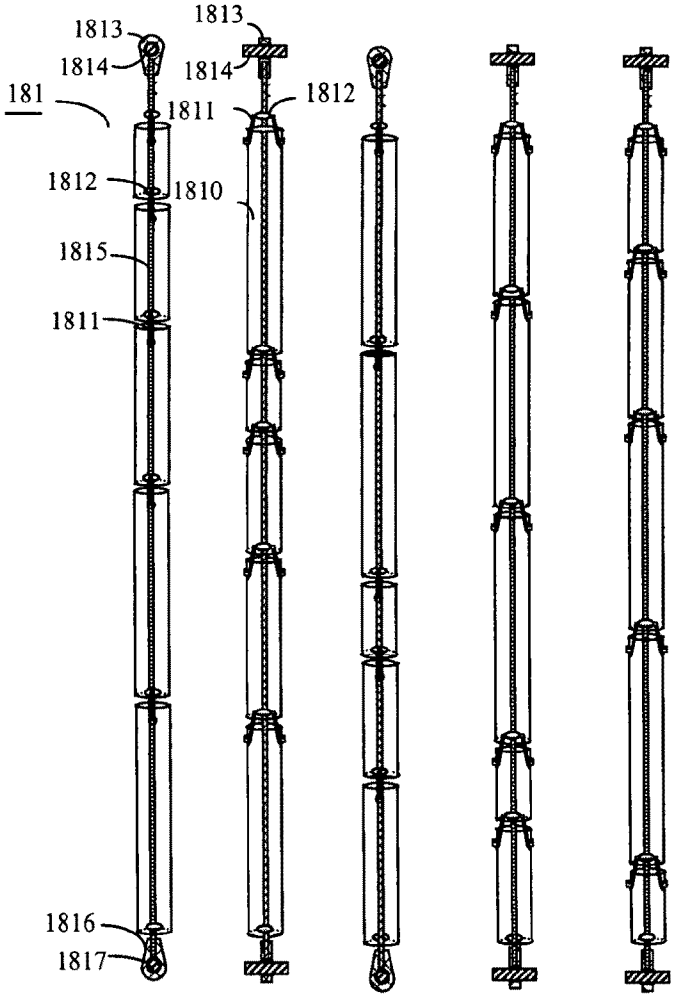
Figure 2I:
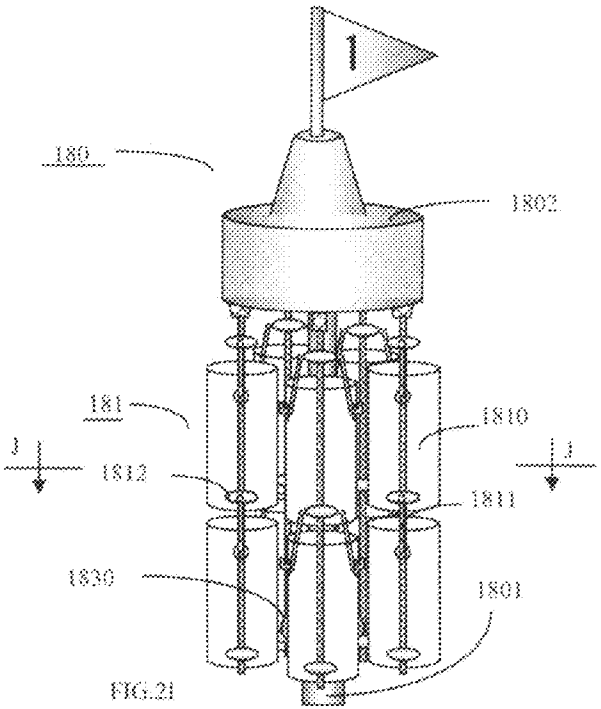
Figure 2J:
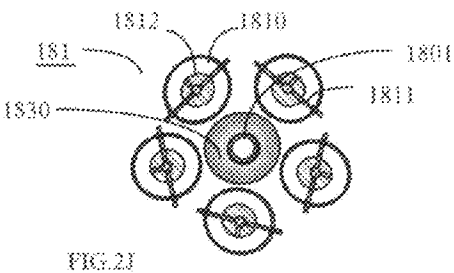
Figure 2E:
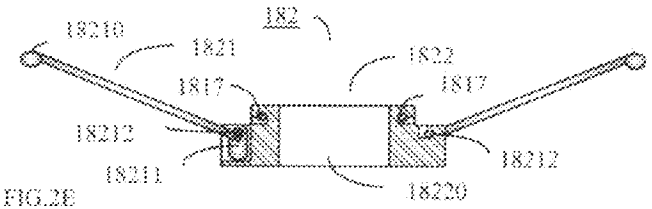
Figure 2F:
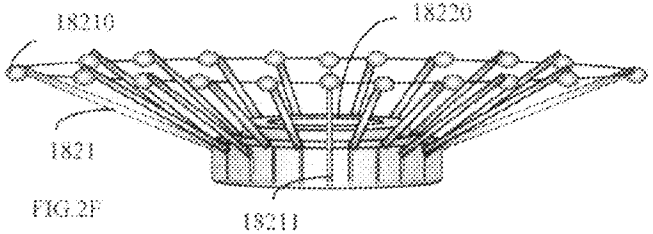
Figure 2G:
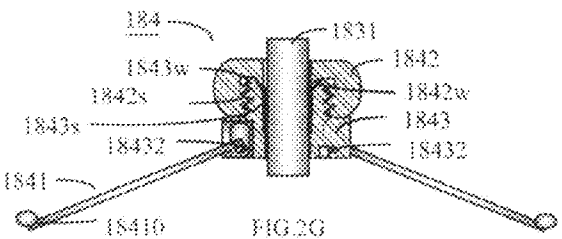
Figure 2H:
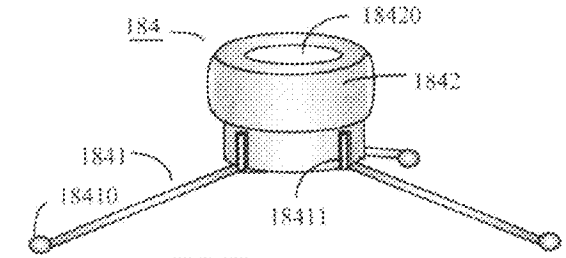
Figure 2T:
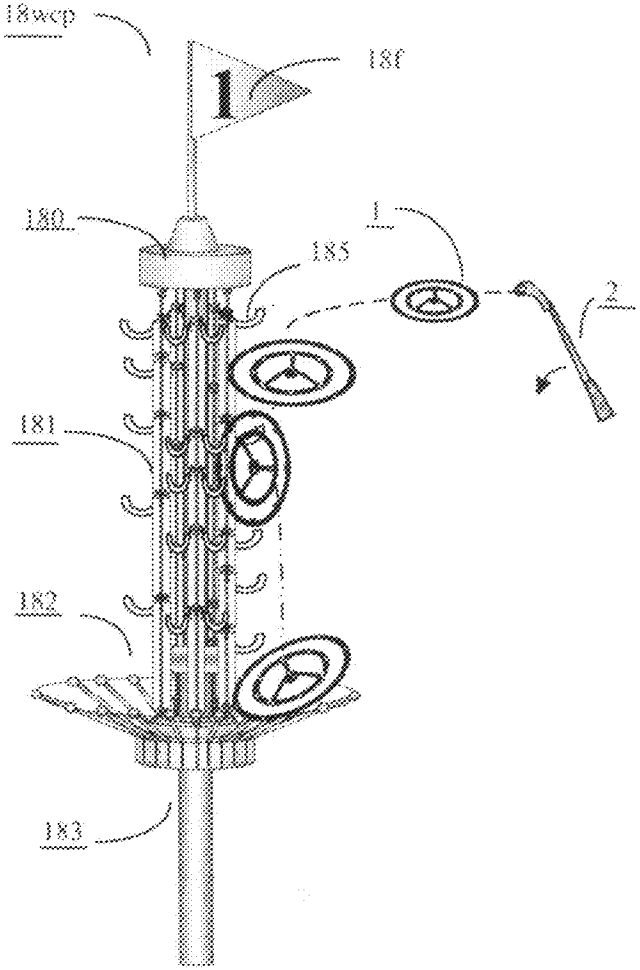

For the fixed golfrisbee basket, there is no need for the stand 184 as shown in FIG. 2S and FIG. 2T. The flag 18*f* gives golher the indications for the wind direction and the wind speed. As shown in FIG. 2A, in the golfrisbee sport, the golfrisbee 1 must be thrown by the golh club 2 to fly and fall into the basket 182 just as the ball rolls into the hole as the golf sport does. To absorb the impact of the golfrisbee 1 and increase the possibility of the golfrisbee 1 to fall into the basket 18*wcp* from any direction, the basket 18*wcp* adopts the wind-bell-chain 181 and the basket 182 having small diameter reverted umbrella structure.

The night golh and snow golh have the long drive with the flying golfrisbee 1 and putting with golfrisbee 1 or the rolling golf ball 151. The snow golh and night golh do not conflict with the existing golf sport activities. The snow golh and night golh can do the time-sharing with golf for the same golf course. So, the portable golfrisbee basket 18*wcp* is invented that the golh can time share with the golf of the conventional golf course. To make the putting of the golfrisbee 1 have the same difficulty as the putting of the golf ball does, the outside diameter of the bundle made of the wind-bell-chain 181 is small. However, the diameter becomes small, the golfrisbee is easily damaged. Therefore, the small cross section golfrisbee basket 18*wcp* has the special design to reduce the impact force. The special design is the wind-bell-chain 181. As the golfrisbee 1 hits on the wind-bell-chain 181 and/or falls in the reverted-umbrella basket 182, the wind-bell-chain 181 and the reverted-umbrella basket 182 swivel and generate the music sound of wind chain. The kinetic energy of the flying golfrisbee 1 is converted to the acoustic vibration energy of the wind chain 181. The swivel movement of the wind-bell-chain 181 serves as the buffer to protect the golfrisbee 1 from damage.

The wind-bell-chain 181 has a long dimension. The putting art of golfrisbee 1 is the golher has to control the force correctly. If the force is too large, the golfrisbee will bounce back and fall outside the reverted umbrella basket 182. As shown in FIG. 2C, the wind-bell-chain 181 is made of the multiple sections of wind-bell 1810. To have the harmonics of music, the wind-bell tube 1810 has the different length. Furthermore, to have the different harmonic combination, for different string of the wind-bell-chain 181, the different length wind-bells 1810 are aligned cyclically. As shown in FIG. 2I and FIG. 2J, the wind-bell-chains 181 are hanged around the supporting pole 1801. To make the wind-bell chain generate the music sound, the wind-bell-chain must be hanged near vertically. The tube 1810 only can hit on the dangling pan 1812. As the tube 1810 touches on dangling pan 1812, the sound cannot be generated. Therefore, the swivel amount of the wind-bell-chain 181 is small. Therefore, as shown in FIG. 2L, there is a pan 1830 to limit the swivel of the wind-bell-chain 181 and the basket 182. The conventional wind chain stands still. It is hit outside to generate sound. The conventional bell moves and is hit inside to generate sound. As shown in FIG. 2M and FIG. 2N, the wind-bell-chain 181 has the hybrid characteristics of both the bell and the wind chain. The tube 1801 of wind-bell-chain 180 swivels on the link 1811 and hit by the pan 1812 from inside the tube 1801 as the bell does. The pan 1812 clamps on the string 1815. The pan 1812 supports the fork 1811. The linkage of fork 1811 passes through the holes 1810*n* of the cylindrical tube 1810. The fork 1811 has the hook 1811*m* to hold the tube 1801. As the cylindrical tube 1810 dangles and swivels on the fork 1811, the bottom of the cylindrical tube 1810 hits on the pan 1812 and the music sound is generated. In the conventional bell and wind chimes, the moving pan hits the walls of bell and wind chimes. For the wind-bell-chain 181, the moving wall of the cylindrical bell 1810 hits the pan 1812. This operation is the reversed operation of the conventional bell and wind chain.

As shown in FIG. 2K and FIG. 2L, the wind-bell-chain 181 is hanged beneath the hanging cap 180. The string 1814 passes through the hole of hanger 1813 and the slot 1803 in the hanging cap 180 to hang up the wind-bell-chain 181. To increase the swivel of the wind-bell-chain, the hanging cap 180 is supported on the universal joint type ball 18010. To swivel only, the hanging cap 180 might be supported on one pinpoint. However, for the fixed golfrisbee basket, to keep the theft from stealing the wind-bell-chain 181, we need to use the ball joint to lock the wind-bell-chain 181 to the supporting pole 1801 as shown in FIG. 2S. As the wind-bell-chain 181 swivels, the hanging cap 801 rolls on the ball joint 18010. There is a lot of space 1800 reserved for the free roll movement of the hanging cap 180. With the free roll mechanism of the hanging cap 180, the whole wind-bell-chain 181 can free to rotate as the conventional wind chain does.

The light 180L is for the night golf. In the night, the light 180L shines on the flag 18*f*, the wind-bell chain 181 and the reverted umbrella 182. With the lights 180L, the golher can see the golh basket 18*wcp* in the night and swivels the golh club 2 to launch the golfrisbee 1 to fly toward the golfrisbee basket 18*wcp*.

Without the free roll mechanism of the universal joint type ball 18010 of the cap 180, the wind-bell-chain 181 and the foldable basket 182 cannot swing. The wind-bell-chain absorption capability of the impact energy will be reduced a lot. Both the golfrisbee basket 182*cp* and the golfrisbee 1 will be damaged due to the hit impact of the golfrisbee 1. Therefore, the free roll mechanism of the universal joint type ball 18010 is the core technology of the golfrisbee basket 18*wcp*.

As shown in FIG. 2E and FIG. 2F, to be portable, the basket 182 is in the shape of the reverted umbrella. The L-shaped basket bone 1821 pivots on the string 18212 as the umbrella bone does. In the normal operation, the end 18211 leans against the wall of the basket ring 18220. In the portable mode, the L-shaped basket bones 1821 rotate and concentrate to be a bundle of ribs just as the umbrella does.

As shown in FIG. 2A, FIG. 2I, FIG. 2J, FIG. 2K and FIG. 2L, to be portable, the supporting pole 1801, the lock screw 1830 and the stand pole 1831 can pass the hole of the basket support 18220. The lock screw 1830 has the pan structure to hit the outside of tube 1810 as the conventional wind chain does. The lock screw 1830 is to limit the swing of the wind-bell-chain 181. As the dangling wind-bell-chain 181 hits on the pan of the lock screw 1830 with the impact force and the wind-bell-chain 181 will bounce back to swing in the reverse direction. The dangling tubes 1810 will continue swinging in the original moving direction that the tube 1810 hits on the pan 1812 on the inside of the tube wall. This process is similar to the emergency brake of the car, all the passengers continue moving forward and hit by the blockages.

Therefore, there are three different hit mechanisms to generate the music sound of the wind-bell-chain 181. The first hit mechanism is the flying golfrisbee 1 hit on the outside of tubes 1810 and the wind-bell-chain 181 begins to swing. The second hit mechanism is the pan of the lock screw 1830 hits on the outside of tubes 1810 of the swinging wind-bell-chain 181. The third hit mechanism is the dangling tubes 1810 hit on the pans on the inside wall of the tubes 1810 during the swinging wind-bell-chain 181 hitting on the pan of the lock screw 1830.

Since the tube 1810 swiveling only in one direction, as shown in FIG. 2J, the fork 1811 is aligned in the tangent direction of the circle. As shown in FIG. 2C, the upper hanger 1813 and the lower hanger 1816 keep the tubes of the wind-bell-chain in the correct direction. The upper hanger 1813 passes through the string 1814 inside the hanging cap 180 as shown in FIG. 2L; the lower hanger 1816 passes through the string 18212 as shown in FIG. 2E. The strings 1814 and 18212 are in circle shape.

As shown in FIG. 2G and FIG. 2H, the stand 184 of the portable wind-bell-chain golfrisbee basket 18*wcp* has the similar structure of the basket 182. The only difference is that the stand 184 has only three legs 1841 and the legs 1841 are much stronger than the rib 1821 of the basket 182. The stand legs 1841 pivotally rotate on the string 18432 and bears against the cylindrical wall 1843 of the stand 184.

As shown in FIG. 2M, the portable wind-bell-chain golfrisbee basket adopts the lock screw technology. There are a circular wedge 187*w* on the female screw 187 and a circular wedge slot 188*w* on the male screw. On the circular wedge 187*w*, there are multiple cut 187*c*. As the female screw 187 rotates in the engaging direction, the wedge slot 188*w* squeezes the wedge 187*w* toward the center of the screw 187 to lock the pole passing the screw. As shown in FIG. 2Q and FIG. 2K, the wedge slot 1831*w* squeezes the wedge 1830*w* to engage and lock the extension pole 1801. As shown in FIG. 2R and FIG. 2G, the wedge slot 1843*w* squeezes the wedge 1842*w* to engage and lock the stand pole 1831.

Releasing the lock of the compact lock crew mechanisms, the reverted umbrella golfrisbee basket 18*wcp* with the wind-bell-chain is easily retracted to a portable size. As shown in FIG. 2K, FIG. 2L and FIG. 2A, rotating the female screw 1830 in the disengaging direction, the lock of the supporting pole 1801 is released. The supporting pole 1801 can slide into the stand pole 1831. As shown in FIG. 2A and FIG. 2F, the ribs 1821 are retracted to a bundle as the umbrella does. As shown in FIG. 2G, FIG. 2H and FIG. 2A, rotating the female screw 1842 in the disengaging direction, the lock of the stand pole 1831 is released. As shown in FIG. 2A and FIG. 2H, the stand leg 1841 are rotated downward and retracted to a bundle as the umbrella does. Then the stand 184 can slide upward inside the wind-bell-chain 181. With the lock screw and the rotating ribs and stands, the golfrisbee basket is easy to collapse to be a small package to carry.

As shown in FIG. 2S, we can easily modify the portable wind-bell-chain golfrisbee basket 18*wcp* to be the fixed golfrisbee basket 18*wcf*. For the fixed golfrisbee basket 18*wcf*, the stand 184 and the stand pole 183 are not needed. As shown in FIG. 2A, FIG. 2R and FIG. 2L, the support pole 1801 is making longer. The support pole 1801 is modified with the addition of a pan as the lock screw 1830 does.

As shown in FIG. 2T, it is the alternative way and the simplest way to modify the portable wind-bell-chain golfrisbee basket 18*wcp* to be the fixed golfrisbee basket 18*wcg*. It is just to take away the stand 184 and buries the stand pole 1831 in the ground directly.

Comparing our invention of the wind-bell-chain reverted umbrella golfrisbee basket 18*wcp* with the conventional disk golf basket, the conventional disk golf basket is very bulky and heavy. Without the free roll mechanism of the universal joint type ball 18010, the conventional disk golf basket is constituted of a large bundle of heavy steel chains. As the flying disk hit on the conventional disk golf basket, the impact will cause the damage of the disk. Therefore, the putting disk of the disk golf has thick rim to increase the contact area to reduce the damage of the disk. Our wind-bell-chain reverted umbrella golfrisbee basket is light and swiveling. It is light and foldable that it is easy to carry as the portable golfrisbee basket. The flying disk hits on the wind-bell-chain reverted umbrella golfrisbee basket; the flying disk will not have damage.

The large bundle of the steel chain of the conventional disk golf basket has no excitation as the putting of the golf ball. The thick rim of the putting disk reduces the performance of the flying disk's flying range a lot. With our wind-bell-chain invention, the section of the wind-bell-chain 181 is as small as the hole of the conventional golf sport does. The putting of golfrisbee disk is as exciting and challenging as the putting of the golf ball does. The golfrisbee 1 doesn't need to have the thick edge that the golfrisbee 1 doesn't lose the performance of flying range. The golher can have birdie, eagle or hole-in-one/without the worry of the damage of the golfrisbee disk 1.

FIG. 2T shows the wind-bell-chain golfrisbee basket having the multiple hooks 185 on the wind-bell-chains 181. The wind-bell-chain golfrisbee basket with hooks can be played as game of fortune-teller. Depending on the different hooks the golfrisbees are hanged, there are different fortunes. There are many ways to implement the hooks 185. FIG. 2D shows the hooks 185 being made of the extension of the dangling wire 1811.

Figures 3E, 3F, 3G, 3H:
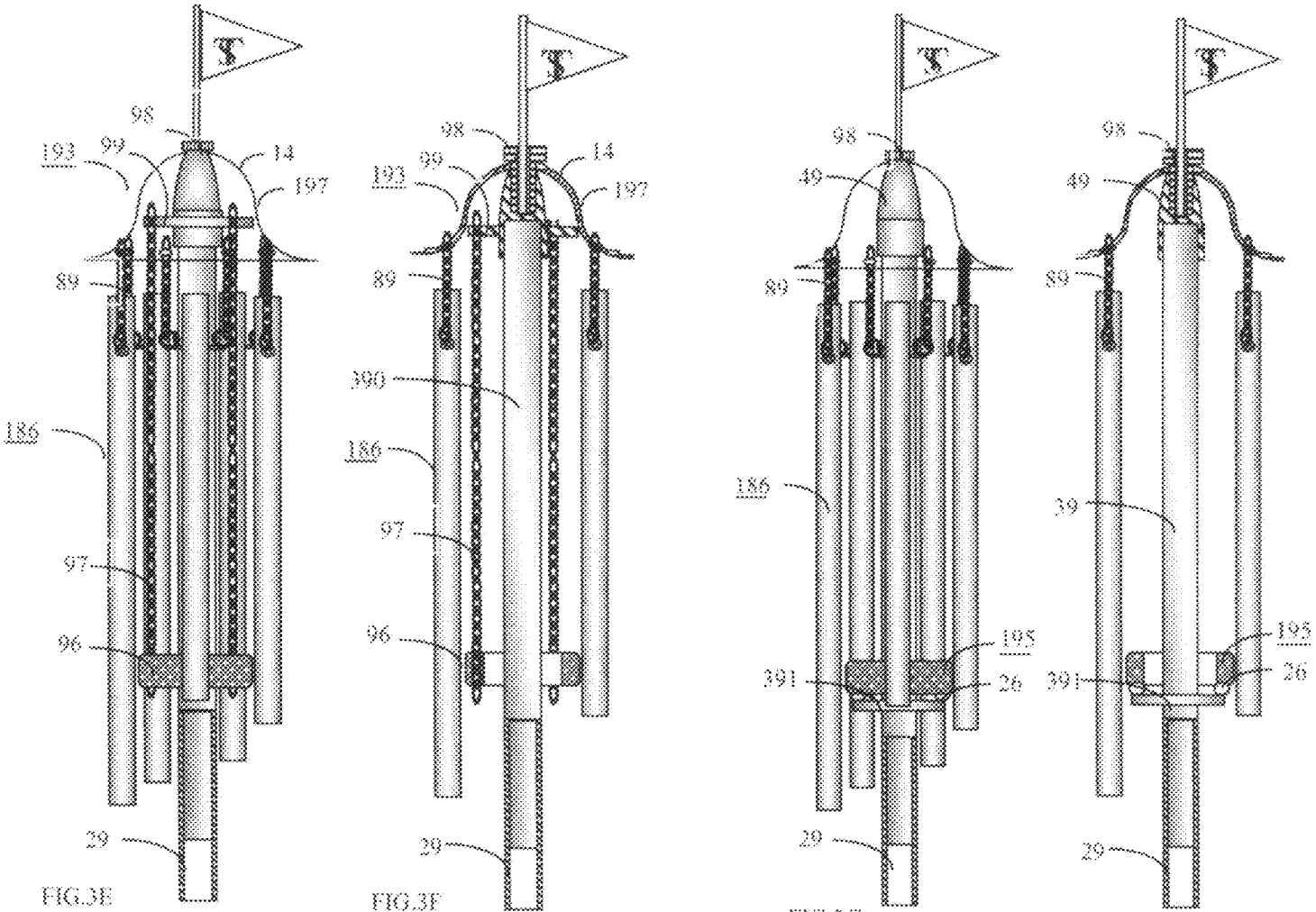

FIG. 3A shows the alternative design of the wind-chime golfrisbee basket. The golfrisbee throwing target of golfrisbee basket comprises wind chiming 186, top hat 193 and post 39 or 390. The top hat 193 installed on a top position of post 39. The wind chiming 186 or 181 comprising a plural of tubes hanging below the top hat 193 with strings 89 around post. The post 39 or 390 passes through the central hole of dangling block 96, 195, or 182. A free swiveling chime block 96 or 195 is to hit and to be hit by tubes of wind chiming 186. As the flying golfrisbee 1 hitting on the tubes of wind chiming 186 or 181, the tubes are hit by flying golfrisbee 1 swiveling to absorb impact energy of golfrisbee 1 and generating melody. As the hit tubes swiveling to hit on free swiveling chime block 96 or 195 or 182, the chime block 96 or 195 or 182 continues moving and hits other tubes. Then the other tubes swivel back and forth and hit on the chime block 96 or 195 or 182 again. This process continues until all the tubes swivel and generate harmonic melody altogether. The wind-chime golfrisbee basket is composed of the wind-chime 193, the web-basket 189 and the tripod 192. As shown in FIG. 3E, the wind-chime tubes 186 are hanged under the top cap 14. FIG. 3E is elevation view; FIG. 3F is the partial exposed view. The top cap 14 is supported on the pole 390. The free swiveling dangling block 96 hangs below the rim 99 of the top cover 197. There is one big hole in the block 96 that the block dangles and hits on the wind-chime tube 186 to generate the melody. As the golfrisbee 1 hits on one wind-chime tube 186, this wind-chime tube 186 will swivel accordingly and hit on the dangling block 96. The dangling blocks 96 hits on the other wind-chime tubes 186 and generate the harmonica melodies. FIG. 3G shows the alternative design of the block 195. The ball bearings 26 are beneath the block 195. The block 195 slides on the platform 391. FIG. 3B shows the portable golfrisbee basket comprises a foldable web basket 189. The foldable basket 189 has a plural of links 24 with one end 24*l* being pivotally hinged on post 29. The link 24 is pivotally mounted on the flange 292. The link 24 has one end 24*l* biased against the pole 29. A plural of chains 19 are hooked to links 24 to form a web. The foldable basket 189 is open naturally with the weight of links 24 and web. The hooked chains 19 are hooked to the link 24 to be web basket. Due to the gravity, the web basket 189 will open automatically. There is no need for the biasing force to open the web basket 189.

FIG. 3C shows the alternative design of foldable basket for the web basket being made of the reverted umbrella structure. The web and links 27 and 28 constitute of a portable basket. The foldable basket has a plural of trusses. The truss has a first link 27 with one end being pivotally hinged to post 29 and a second link 28 with one end being pivotally hinged to middle portion of the first link 27 and another end being pivotally hinged to a sliding tube 31. The trusses are in an umbrella type structure. A plural of chains 19 are hooked on links 27 to form a webs. Pushing the sliding tube 31, open up the web and truss and locking it to post 29 to open the foldable basket. Releasing the locking with post 29, the foldable basket is in fold position due to the weight of foldable basket. The links 27 are pivotally mounted on the sliding flange 31. The link 28 is hinged at the center of the link 27. Being similar to the umbrella, the web basket is biased to open with the spring lock 32. The alternative design of the partial exposed view of the tripod is shown in FIG. 3D. The foot bar 322 is pivotally mounted on the sliding tube 32 with hinge 32*c*. The support 324 is pivotally hinged at the fixed flange 33*c*.

The golh club 2 is also used to push the golfball to roll into the universal portable put & hole 6. The most difficult challenge of the swivel-to-fly technology is to use the pole to emulate the human throwing-to-fly process. However, the human hand is the most complicated and delicate mechanism with the most sophisticated controller, brain. The combination of the human hand and brain, it is almost impossible to emulate such complicated human throwing process with a simple mechanism. The most important issue is the simple mechanism needing to grasp the disk tightly before the launch and suddenly release the disk at the designated launching position. This is the snap release screw means having the resilient material covering on the hard backbone to increase the grasp. With the snap release screw, the golfrisbee throwing to fly distance can be double. Usually, the designated launching position is the club being swiveled at the highest speed. It is an impossible mission to emulate the human hand and brain with a simple mechanism. Furthermore, to be practical, the simple mechanism has no moving part. The simple mechanism is sturdy. Otherwise, it will be easily broken in the high-speed operation of the club. That is the reason why the conventional disk-golf sport still uses the hand-throwing flying disk to play the golf-disk sport. They cannot overcome the technology barrier to have a simple, efficient and practical way to swivel and launch the flying disk.

So, until now, there is no disk-golfer using the pole to launch the disk to fly. We are the only team dedicating our efforts to make the golfrisbee dream to become true. After a lot of trials and tests, finally, we make a breakthrough in concept and we have built a prototype to launch the disk to fly with the club. We have verified the innovative idea with the prototype to make the golfrisbee dream to become true. The verified innovative ideas and efforts becomes the core of our invention.

Figure 4A:
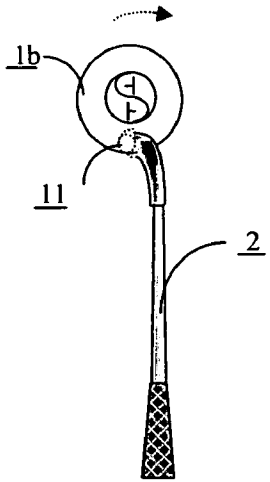
Figure 4B:
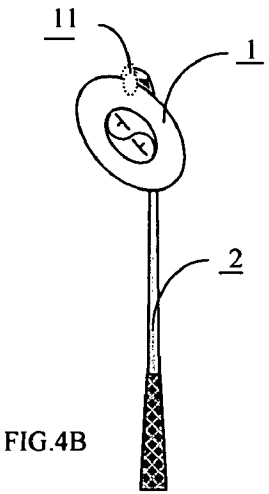
Figure 4C:
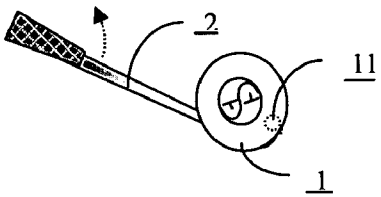
Figure 4D:
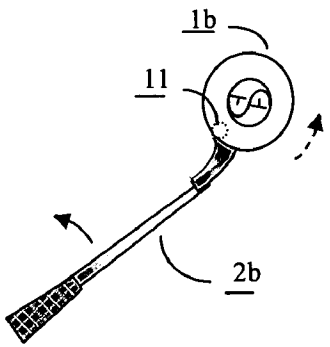
Figure 4E:
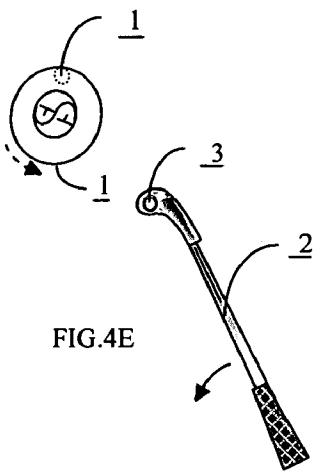

We have built many prototypes and made field tests for these prototypes successfully. The working principle of the swiveling-to-launch-to-fly golfrisbee is to use the simple screw mechanism to emulate the complex human throwing way to launch the flying disk. As shown in FIG. 4 and FIG. 9, the golfrisbee 1*b* is mounted on the head of the golh club 2*b* with the screw type mechanism 11*b*. Rotating 180 degrees as shown in FIG. 4B, the golfrisbee is mounted on the head of golh club. The screw mechanism is simple and having no moving part. The invention of blockless snapping lock and launch means of screw was the most important invention in history. However, nobody think the blockless snapping lock and launch means of screw mechanism has such kind an important application which can emulate the complex process of human throwing disk to fly. As shown in FIG. 4C, the golh club starts to swivel the golfrisbee. Due to the initial momentum being static, the golfrisbee 1*b* rotates counterclock relative to the head 3*b* of the golh club 2*b*. Due to the eccentric force of the swiveling circle of the golh club 2*b*, the golfrisbee 1 is swiveled to the outside straight line position of the golh club 2*b*. At the launching position of the golh club, the golfrisbee 1 is launched to fly in the sky as shown in FIG. 4E.

The golfrisbee sport includes two components, the golfrisbee disk 1, and the golfrisbee club 2. FIG. 4, FIG. 5, FIG. 6 and FIG. 7 illustrate the operations of golfrisbee. For the screw type golfrisbee as shown in FIG. 9, as shown in FIG. 4A, the golfrisbee disk 1 is mounted on the head of golh club 2. Then, as shown in FIG. 4B, rotating the golfrisbee disk 180 degrees to engage the screw of golfrisbee disk 2 with the screw of the head of the golh club 1.

As shown in FIG. 5, it makes the analytical mechanism study of the golfrisbee. FIG. 5A shows the golfrisbee 1 being mounted on the golh club 2 with the same position of the launching point of the golfrisbee. Rotating golfrisbee 180 degrees clockwise, as shown in FIG. 5B, the golfrisbee being engaged with the head of the golh club 2 and on the head of the golh club 2. Swiveling the golh club 2, the golfrisbee 1 rotates counterclockwise to reach the launching point and is ready to be launched as shown in FIG. 5C.

A golfrisbee sport comprises of a disk 1 for being thrown to fly with a swivel of a club 2 by hands. The club 2 is swiveled with hands to rotate disk 1 and throw disk 1 to fly. The club 2 is constituted of a pole and a head. The pole is swiveled with hands in a circle to throw disk to fly. The golh club 2 has a head 3 for disk 1 to be pivotally mounted that the disk 1 is thrown out to rotate to fly in sky. As shown in FIG. 6A, the axis 13 for the pivotally mounted disk 1 is referred to be pivotal axis 13. The axis for the center of gravity of disk is referred to be rotational axis 103. The eccentricity is referred to be the pivotal axis 13 and rotational axis 103 being not in coincidence. So, the disc 1 has the eccentricity.

The disk 1 is constituted of a plate and a fitting. The plate is for rotating and being thrown to glide to fly in sky. The fitting 13 is for the plate being pivotally mounting on the head of club 2 The pivotally mounting is eccentric to plate that the pivotal axis 13 is not coincident with the rotational axis 103. This eccentric mounting enables the plate pivotally rotating due to an eccentric force of swivel of pole. The rotation of disk 1 is in parallel to a plane of the swivel of club 2. So the flying disc 1 is in the plane which is parallel to the swiveling plane of the golh club 2. It makes the disk 1 to fly with very little drag force.

Figures 9A, 9B, 9C, 9D, 9E, 9F, 9G, 9H:
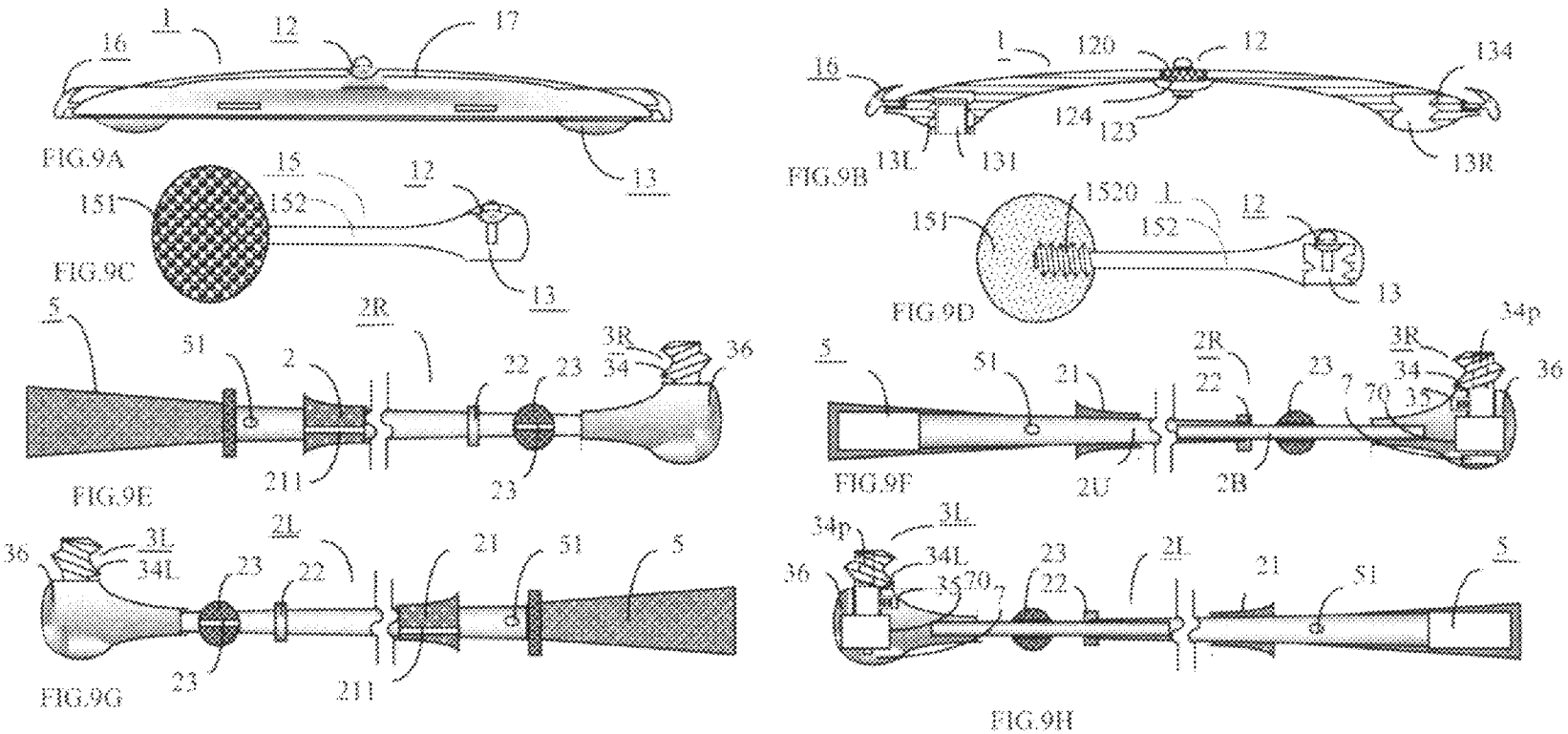

Comparing FIG. 5A and FIG. 5C, the fitting 13 being pivotally rotating on head and changing directional relation with head 3 as pole being swiveled with hands. They are rotated 180 degrees. One position is locked position and one position is releasing position. As shown in FIG. 9A and FIG. 9B, the plate 1 with fitting 13 being pivotally mounted on head 3 and having blockless snapping lock and release 11 with head 3 and being launched to fly with head based on directional relation between head 3 and fitting 11. As shown in FIG. 9C and FIG. 9D, the ball 15 with fitting 13 being pivotally mounted on head 3*d* and having blockless snapping lock and release 15 with head 3 and being launched to fly with head 3 based on directional relation between head 3 and ball 15.

As shown in FIG. 5C, due to the eccentricity of the pivotal axis 13 and the rotational axis 103 and the initial momentum of the golfrisbee being zero, as the golh club 2 swings to the left, the initial momentum of the golfrisbee 1 is zero. Even the pivotal axis 13 moves left, the rotational axis 103 stays still. However, being relative to the pivotal axis 13, the golfrisbee 1 rotates counter-clockwise. The initial counter-clockwise angular momentum is built up. According to the conservation of angular momentum, the golfrisbee 1 continues rotating counter-clockwise. There is a distance d between the pivotal axis 13 and the rotational axis 103. Due to the eccentric force ($V^2/r$) of the golh club swiveling force, the eccentric force times the distance d is the force to generate the angular momentum. So the swing of golh club makes the golfrisbee 1 have very large angular momentum. The golfrisbee 1 rotates to the golfrisbee launching point with the pivotal axis 13 being the center of rotation. This golfrisbee launching point is the same as the golfrisbee mounting position as shown in FIG. 5A. In FIG. 5A, at the mounting point, the golfrisbee 1 is still and rotates clockwise to mount on the head of the golh club. In FIG. 5C, the golfrisbee 1 rotates counter-clockwise with very large angular momentum and very high velocity to take off the head of the golh club. The flying golfrisbee 1 has the rotational axis 103 to be the center of rotation. The golh club 2 continues to move on the swiveling circle with the constant velocity V. As shown in FIG. 4E, the flying golfrisbee 1 flies along the tangent line of the circle at the launching point. The flying golfrisbee 1 flies in the plane which is parallel to the swivel plane of the golh club 2. So, the flying golfrisbee 1 has the minimum angle of attack and has the minimum the aerodynamic drag force that the golfrisbee 1 fly the ultra long flying distance of 500 yards.

FIG. 6 shows the angular positions of the effects of the different launching point. FIG. 6A shows the launching point is too early to launch the golfrisbee. FIG. 6B shows the optimum launching point to launch the golfrisbee. FIG. 6C show the launching point is too late to launch.

Figure 7A:
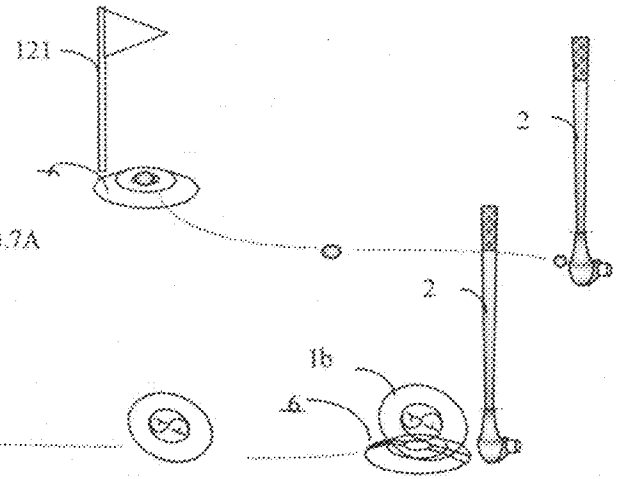
Figure 7B:
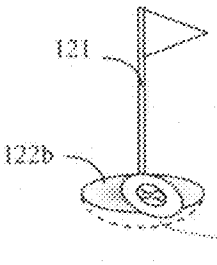

As shown in FIG. 1 and FIG. 7, the hybrid golh has the combination of the golfrisbee to fly as flying disk and the golfball or golfrisbee rolls as the golf does as shown in FIG. 7. As shown in FIG. 7A, using the same golh club 2*b*, the golfball is pushed to roll into the hole of the universal put & hole 6. As shown in FIG. 7B, the golfrisbee 1*b* is mounted on the universal put & hole 6 being served as golfrisbee put. Pushing the golfrisbee 1*b* with the golh club 2*b*, the golfrisbee 1*b* being pushed to roll into the golfrisbee cave 122*b*.

As shown in FIG. 1, the disk golf type golfrisbee is to swivel the golh club 2 to launch the golfrisbee disk 1 to fly into the portable golfrisbee basket 4. In the golfrisbee course, there are eighteen portable golfrisbee baskets 4 which are corresponding to the eighteen holes of the golf course. There are versatile designs of the portable golfrisbee basket 4.

Figure 8B:
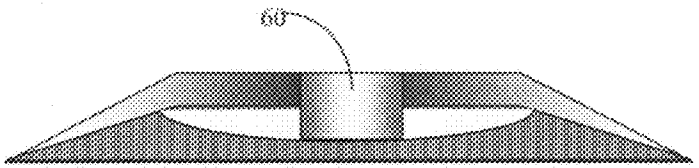

As the golfrisbee disk is in the neighborhood of the target flag 121, as shown in FIG. 7, the golfrisbeer pushes the golfrisbee 1*b* to skid into the hole 122 with the club 2*b*. The hole 122 is at the foot of the flag 121. FIG. 8A shows the universal portable put and hole 6. The universal put & hole 6 is the putt for golfrisbee and the hole for the golfball. The hole 60 is for the golfball to roll into it. The removable plug 61 is to convert the universal put & hole 6 to be the put for the golfrisbee. As shown in FIG. 7B and FIG. 8B, removing the plug 61, the golfrisbee disk can be mounted on the putt 6 to push to roll into the golfrisbee cave 122*b*.

As shown in FIG. 1A, FIG. 7 and FIG. 8, the universal portable putt and hole 6 is for putting a disk 1 to roll and for providing a hole target for the rolling ball to roll into it. The universal put and hole 6 comprises a seat and two wedge type plugs 61. The seat comprises a slot at center of said seat. The two wedge type plug 61 are fit in the slot to form a hole 60 at a center of the universal portable putt and hole 6 to provide a hole target for rolling ball to roll into it. Pulling out two wedge type plugs from the seat, the slot is formed for disk 1 being inserted in slot for disc 1 to be putted to push to roll with club. The disk 1 is mounted in the slot on universal portable put and hole 6 and is to be pushed to roll with a club 2. The club 2 is for swiveling a disk to fly and pushing disk 1 mounted on said slot to roll into a cavity and putting a ball to roll into a hole of universal put and hole 6.

Figure 8C:
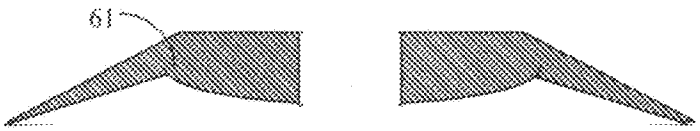
Figure 8A:
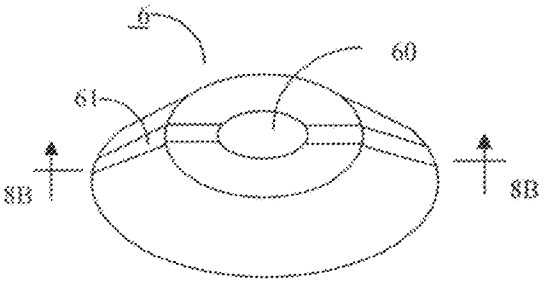

As shown in FIG. 7 and FIG. 8, the universal portable put & hole 6 is to putt a disk to roll and provide a hole target for the rolling ball. The club is for swiveling a disk to fly, push disk to roll into a cavity and push a ball to roll into a hole. As shown in FIG. 7B and FIG. 8B, the disk 1 is mounted on a universal portable put & hole and is pushed to roll with a club 2. As shown in FIG. 7A and FIG. 8A, the universal put & hole 6 has a hole at a center for the rolling ball to roll into it. As shown in FIG. 8C, there are two wedge type plugs. As shown in FIG. 8B and FIG. 8C, pulling out these two plugs to form slot for mounting the disk 1*d* in the slot to putt the disc 1*d* to roll with the club 2*b* as shown in FIG. 7B.

In the course golh, the golh is the hybrid sport constituted of the flying golfrisbee, flying golfball and rolling ball. The golh can also play in the park as the park golh. However, the park golh is limited to the flying golfrisbee and the rolling ball. Unless you are outside the plan grass area, you can use the flying disk to make the long drive to fly. If the golher putt with golfrisbee and the golfrisbee falls outside the golfrisbee basket in the Green area, then the golher has to putt the ball to roll into the hole, i.e. putting Green. In park golh, as the object flying in the sky, it is the flying disk. As the object rolling on the ground, it is the rolling ball. In the strong wind, the golher may use the golfball 15 as shown in FIG. 9C. To make the dogleg turn of the flying path, the golher may use the boomerang golfrisbee or boomerang. As shown in FIG. 1A and FIG. 7A, from long drive to putting, the golher changes the golfrisbee to golf ball.

FIG. 9 shows the basic golh set which includes the golfrisbee 1, golfball 15, golh club 2 and fast golh club head 38. FIG. 9B, FIG. 9D, FIG. 9F and FIG. 9H are the section views of the golfrisbee and the golh club. The golfrisbee is in the UFO shape with right-handed screw cap 13R and left-handed screw cap 13L. This is the basic model of the golfrisbee 1.

The fast golh club head 38 has a duck-mouth 382. As shown in FIG. 9, it shows the basic set of the golh. The golh is the golf hybrid of flying disk and ball. The disk 1 in golh sport is referred as golfrisbee 1. The ball in golh sport is referred as golfball 15. The ball in the conventional golf sport is referred as golf ball. Both golfrisbee 1 and golfball 15 are derived from the same club-swiveling throw art. The golfrisbee 1 or golfball 15 is thrown into the sky with the golh club 2 swiveling. The golfrisbee has many kinds of different designs. As shown in the FIG. 25, it shows the helicopter type boomerang wing segment 17. As shown in FIG. 9, it shows the UFO disk type design.

FIG. 9C shows golfball 15 which uses the same launching mechanism as golfrisbee 1 does. The flying object is a golfball 15. The golfball 15 comprises a ball 151 and an arrow stick 152. The fitting screw 13 is mounted on one end of the stick 152. The other end of the stick 152 is inserted in the ball 151. FIG. 9E is the right-hand golh club 2R; FIG. 9D is the left-hand golh club 2L. The weight 23 is to train the golher to develop the golh muscle. The slot 231 is to have the weight 23 to be mounted on the golh club. The fixed handle 5 is located at the end of the golh club. The sliding handle 21 is to have the natural slow-to-fast swing movement. The slot 211 is to have the sliding handle 21 to be mounted on the golh club.

The core technology of the golfrisbee is the swiveling club throwing technology. The swiveling club throwing technology not only throws the golfrisbee 1 but also throws the golfball 15, boomerang, etc. FIG. 10 shows the golh set of killer applications made of the art of golfball 15 and golh club 2. The fit mechanism between the flying object and the head of golh club is screw. To reduce the air drag force, the fit screw of the flying object is the female screw 13 and the head of golh club 2 is male screw 3.

Figures 10A, 10B, 10C, 10D:
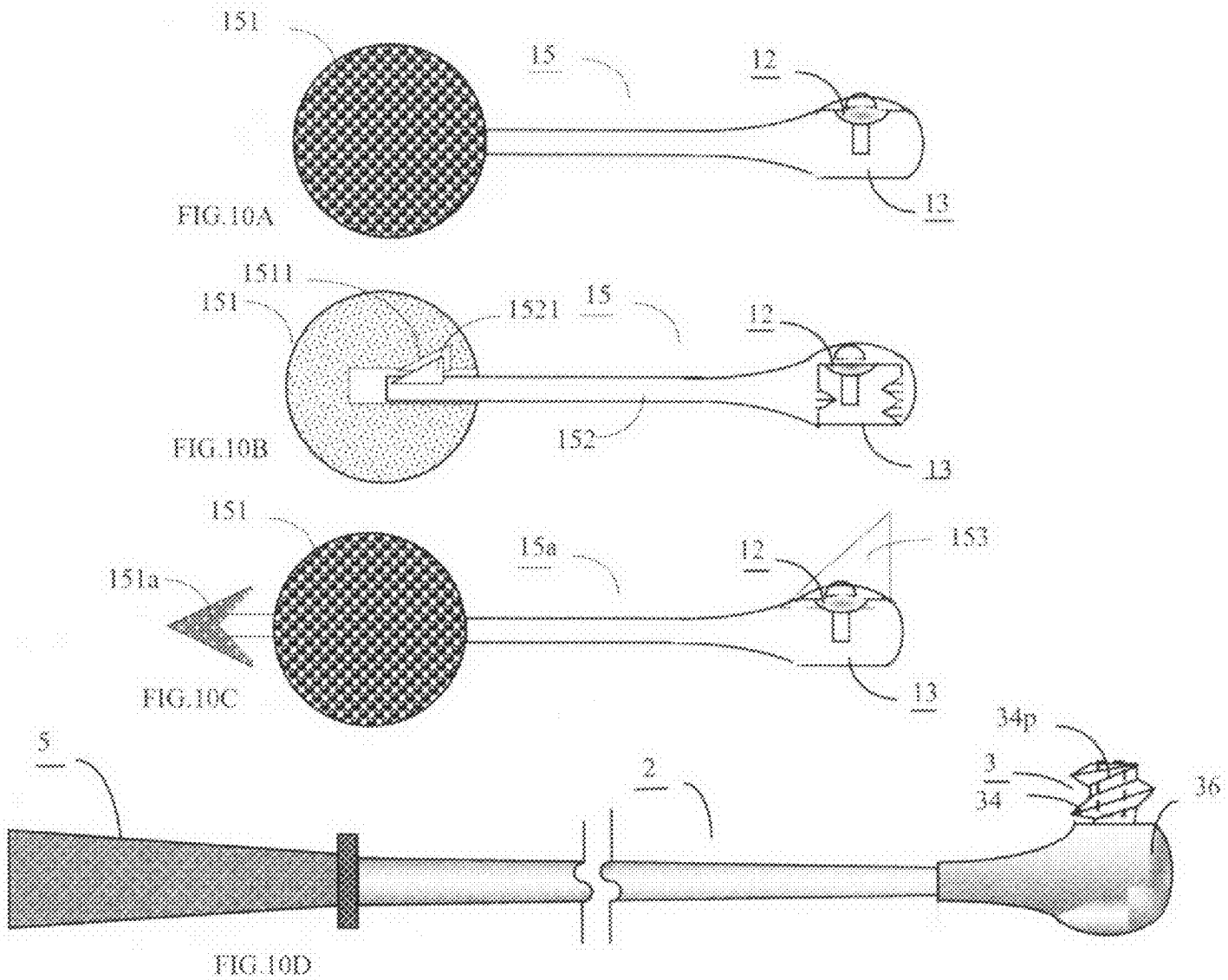
Figure 10G:
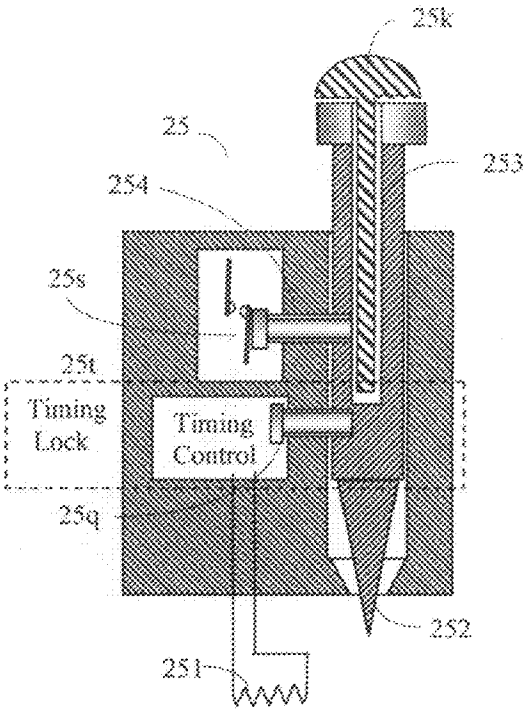
Figure 10E:
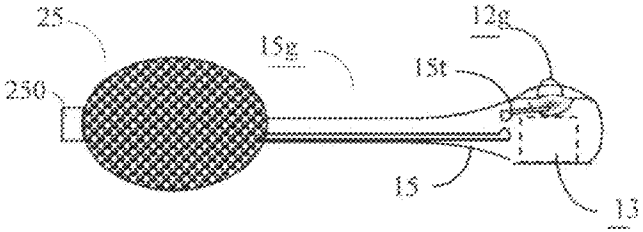

As shown in FIG. 10E, the golh grenade 25 comprises a smart grenade and a handle 15 with club head adaptor 13. The smart grenade 25 further comprises explosive and smart controlling means. The golh grenade 25 pivotally mounting on the golh club head 3 with said club head adaptor 13. Swiveling the golh club 2, the golh grenade 25 pivotally rotating due to eccentric force and taking off to fly to throw toward an enemy target.

Figure 10F:
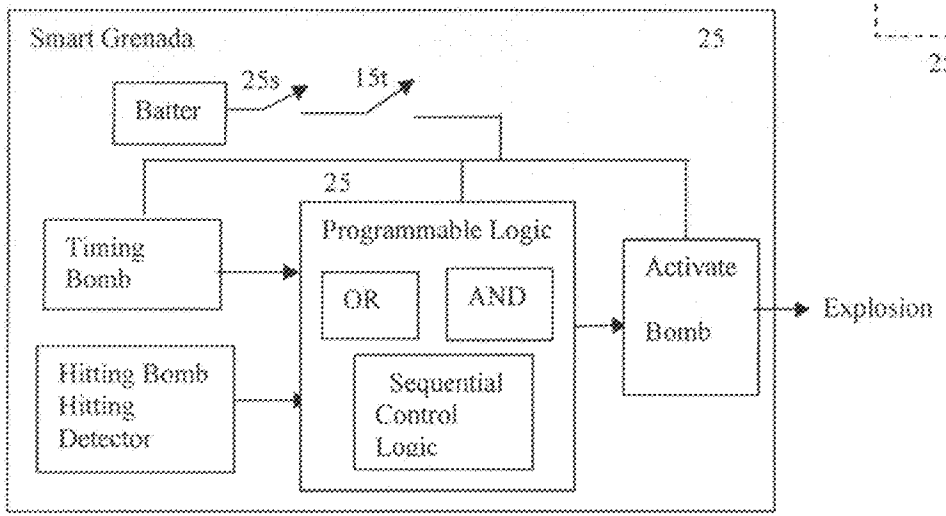

The golfball 15 is thrown with the golh club 2 as shown in FIG. 1A. The fast release latch 1521 is biased by a spring hidden in the bar 152. The fast latch 1521 fits in the notch 151*l* in the ball 151 to lock the bar 152 with the ball 151. Twist the bar 152, the fast release latch 151*l* will be suppressed and the bar 152 can be pulled out of the ball 151. Then the ball 151 can be putted to roll into the hole 6 as shown in FIG. 7A. As shown in FIG. 10C, there is one arrowhead 151*a* attached to the golfball 15. The fin 153 is to control the throwing direction of the golfball 15. The golfball 15 is thrown to fly and shoot at the target board 18*a*. The versatile golfball type objects all can be thrown with the golh club 2 as shown in FIG. 10D. FIG. 10E shows the killer application of the smart grenade 15*g* for the golfball art. The golh grenade comprises a smart grenade 25 and a handle 15*g* with club head adapter 13. The smart grenade 25 comprises explosive and smart controller. The screw 13 is at the end of the handle 15*h*. The smart grenade block diagram is shown in FIG. 10F. There are many different ways to implement the smart grenade. One of the implementation is to mount the grenade 15*g* on the golh club 2 first. The screw 34 presses the tongue 15*t* apart to open the switch first. Then rotate the safety key 25*k* to unlock the safety lock pin 254 and close the safety switch 25*s*. As the grenade 15*g* takes off to fly in the sky, the tongue 15*t* closes the switch. After the programming, the thermal resister 251 can light up the explosive, the grenade can explode in the air to have mass kill. As the grenade trigger 250 hits on the target, the pin 252 hits on the explosive to induce the explosion. The smart grenade 15*g* can be programmed in different mode with the programmable logic 25*p*. There is a general timing lock mechanism 25*t*. As shown in FIG. 10G, the pin 25*q* is pulled out by the timing circuit to unlock the lock with the timing control. Until timing up, the lock cannot be released. As shown in FIG. 10F, with the timing lock mechanism built in the lock, there are many smart functions can be implemented in the smart grenade 25*g*. For example, in the OR mode, either the time-up of the timing circuit or the hit-on of the trigger 250 will cause the smart grenade to explode; in the AND mode, until the time-up of the liming circuit, the hit-on of the trigger 250 will cause the smart grenade to explode; etc.

Figures 10H, 10I, 10J, 10K:
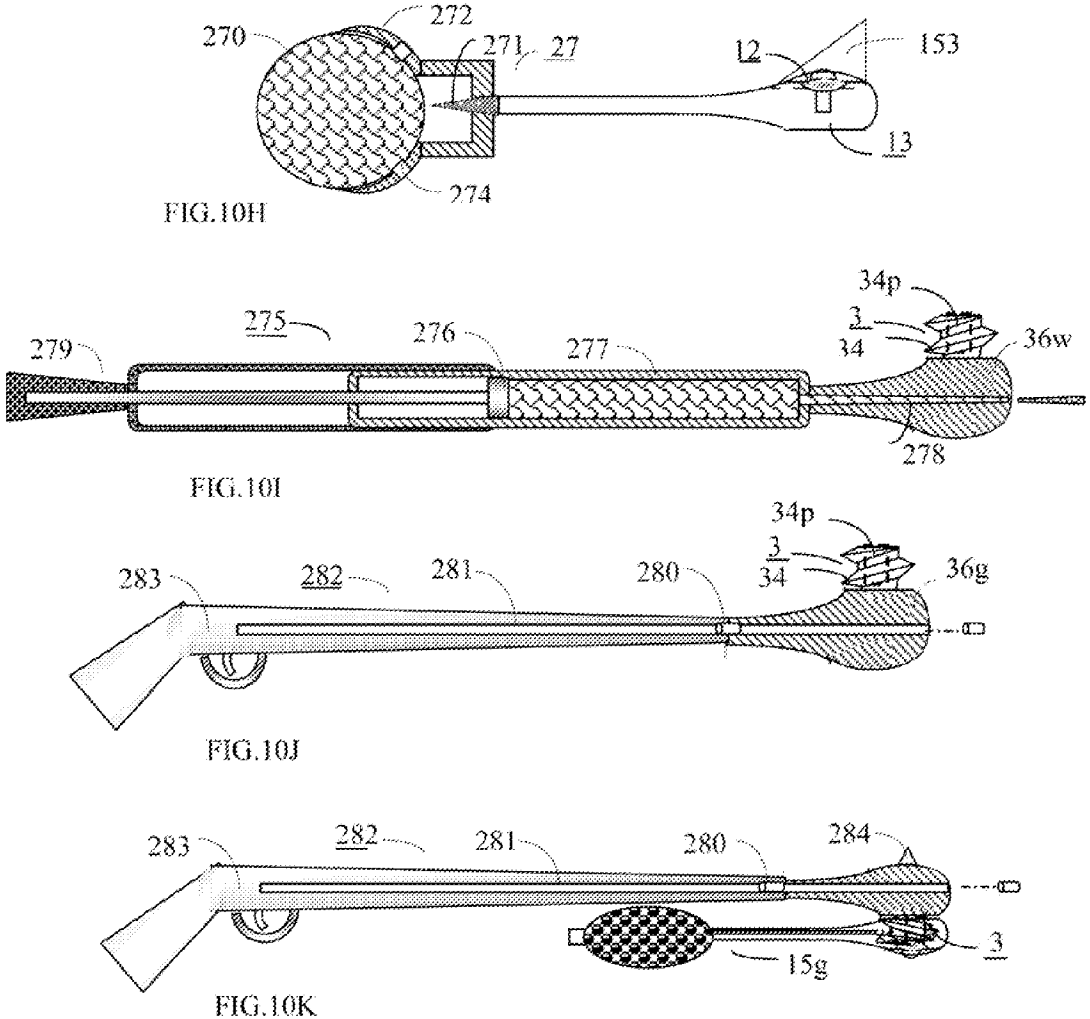

As shown in FIG. 10H, the water grenade 273 comprises a water balloon 270 and a handle 15*wg*. At one end of the handle 15*wg* has a golh club head adaptor 13. At another end, the water balloon 270 is mounted on the handle 15*wg*. Swiveling the golh club 2, the water grenade 273 rotates due to eccentric force and takes off from the golh club head 3. The water grenade 273 flies in the sky and is thrown toward other party kids in the water game.

FIG. 10H shows the water grenade 273 being thrown by the golh club. The water grenade 273 comprises a water balloon 270 and a handle 15*wg*. At one end of handle 15*wg* has a golh club head adapter 13. At the other end of said water balloon 270 is mounted on grappler 272. Swiveling a golh club 2, the water grenade 273 rotates due to eccentric force and takes off from the golh club head 3 flying in the sky and being thrown toward other party kids in water game. The water grenade has many different implementations such as the water grenades are shown in our U.S. Pat. No. 5,433,646 Water gun launching water grenade. The water grenade can be applied here with the handle being replaced with the handle 15*wg*. In FIG. 10H, a new innovational water grenade is made of water balloon 270 directly. In FIG. 10H, the water balloon 270 is snapped into the grabber 272. The grabber 272 holds the water balloon 270 to be thrown by the golh club. As the water balloon 270 hit on the target and expands backward, due to momentum the needle 271 move forward, the needle pill 271 punches through the water balloon 270. The water expels backward and the water balloon shrinks that the grabber 272 cannot hold the water balloon 270 any more. The water balloon explodes and thrust out to spray the water. To fill the water balloon with the proper quantity of water is an art. The best way to fill the water balloon 270 is to fill the water with the balloon fitting inside the grabber 272. The correct amount of water is to have the pin needle 271 almost contact with the balloon. Then push the water balloon out of the grabber 272 through the hole 274. Taking out the water balloon 270 and putt in the bucket, then the kid players can fill another balloon with water. With buckets of water balloons, the kid player can play the water grenade game with the exchange of the throwing water grenades. Water-golh-gun comprises a water gun 275 and a golh club head 3. The golh club head 3*v* is mounted on the water gun 275.

As shown in FIG. 10I, the water gun golh club 275 comprises water gun 277 and golh club head 3. The golh club head 3 is mounted on said water gun 275. Swiveling the water gun 275, the water grenade 273 rotates due to eccentric force and takes off from the water gun golh club 275 flying in the sky and is thrown toward other party kids in water game.

FIG. 10I shows the golh club is further modified to be the water-golh-gun 275. Pushing the handle 279, the piston 276 compresses the water in the tube 277. The water is force flowing through nozzle 278 and being ejected to spray. Swiveling the water gun 275, water grenade 273 rotating due to eccentric force and taking off from water golh gun 275 flying in the sky and being thrown toward other party kids in water game.

As shown in FIG. 10J, the golh-gun club is constituted of gun 281 and golh head 3. The golh head is mounted at top of the gun 281. Pivotally mounting the golfrisbee on the golh head 3 on the gun 281 and swiveling gun, the golh grenade rotates and takes off to bombard on the enemies.

On the real battlefield, as shown in FIG. 10J, the gun is integrated with the golh club to be the golh-gun 282. The golh-gun 282 is constituted of gun 281 and golh head 3. The golh head 3 is mounted at top of gun 281. The bullet 280 is fired and expelled out of the gun tube 281. The gun handle 283 and gun tube 281 are served as the golh club. FIG. 10K shows the practical arrangement of the gun golh club. The left hand holds the front portion 285 and the grenade 15*g* and the right hand holds the rear portion 283. As the gun is swiveled leftward, the left hand slides backward and releases the grenade 15*g*, the grenade 15*g* will rotate and fly toward the enemy. The smart grenade 15*g* is pivotally mounted on the golh head 3 of the gun 281. Swiveling gun 281, the golh grenade 15*g* rotates and takes off to throw on target of enemies.

In general, the golh sport comprises of a flying object being thrown to fly with a swivel of a club 2 by hand. The golh club 2 is swiveled with hands to rotate the flying object to build up the rotating momentum and throw the flying object to fly. The golh club 2 is constituted of a pole and a head. The pole is swiveled with hands in a circle to throw the flying object to fly. The club head is for the flying object pivotally mounting on it. The flying object is thrown out to rotate and fly. The flying object can be boomerang, the ball 15 and the disk 1 as shown in FIG. 9, etc.

From our experience, for a beginner golfrisbeer, he had better to start to play the basic golfrisbee first. For the basic golfrisbee, all the important parameters have been cast into the golfrisbee disk and club as an integrated unit. With these preset parameters, the beginner golfrisbeer can swivel and launch the golfrisbee successfully without any problem. However, these parameters are the results of our numerous tests. The calibration processes for these parameters are professional and very tedious. The beginner golfrisbeer had better not to go through these parameters calibration process. They should leave the calibration process to the manufacturer until they become the expert golfrisbeer. Then they can adjust the parameters with the value-added universal golfrisbee, adjustable golfrisbee.

FIG. 12 is the value-added universal golfrisbee. FIG. 13 is the basic golfrisbee; FIG. 23 is the customized golfrisbee disk, etc. Referring to FIG. 11 of the application of fast release screw, one of the screws 34 is on the head of the golfrisbee club 2; the other corresponding fitting screw 32 is mounted on the golfrisbee disk. Swiveling the pole, the golfrisbee disk rotates around the screw and takes off. The screw 34 and the screw 32 are separated to release the golfrisbee to launch and take off. Swiveling the golfrisbee pole, the golfrisbee disk rotates due to the eccentric force. Swiveling the pole, the screw 34 of golfrisbee club and the screw 32 are separate to release the disk to fly due to the rotation of the golfrisbee disk.

FIG. 11 is the basic screwless golfrisbee made of the mechanism of fast release snapping means. The fast release snapping means is constituted of the screwless head 34*d* and the screwless cap 3*d*. As shown in FIG. 11D and FIG. 11B, a disk 1*d* is pivotally mounted on a head 3*d* of club with fitting, the directional lock and release mechanism of fitting 11*d*. The head 3*d* is for blockless snapping lock and blockless snapping launch. It is a fast release snapping for fast releasing head through a narrow slot 10*d* on a wall 32*d* of fitting lid. The screwless head 34*d* is fit inside the screwless cap 3*d*. As the disc rotates, the screwless cap 3*d* can be free to pivotally rotate on the screwless head 34*d*.

The screwless golfrisbee mechanism is based on the principle as shown in FIG. 5. In FIG. 5, the golfrisbee will rotate 180 degrees with angular momentum M. As disk 1*d* is pivotally mounted on the head 3*d* of club with fitting 11*d*, the fast release snapping engages disk with the head of club with a snapping fastener 34*d* and 32*d* for holding fitting 11*d* with head 3*d*. The disk 1*d* dangles to rotate freely on head of club. As shown in FIG. 5, swiveling club 2 with hand in circle movement, disk 1*d* pivotally rotates due to eccentric force of a circle of swivel of club 2. The fast release snapping 3*d* and 11*d* transfers the translational momentum to disk 1*d* and the eccentric force generates angular momentum of disk 1*d*. At the launching point, the golfrisbee will take off along the tangent line with velocity V. Swiveling club, disk 1*d* rotates due to the eccentric force. The blockless snapping lock and launch of fast release snapping 34*d* of head 3*d* sliding out of fitting 11*d* through slot 10*d* on wall 34*d* of fitting 11*d* that head 3*d* releasing disk 1*d* to launch disk 1*d* to fly. The screwless golfrisbee has one advantage over the screw type golfrisbee that the golfrisbee is not necessary to mount at the launching point. The screwless golfrisbee 1*d* can be mounted at any angle on the head 3*d* of golh club 2*d*. The golfrisbeer just slaps the head 3*d* of the golh club 2*d* into the cylindrical cavity 11*d*. The wedge shape snapping teeth 32*d* will hold the flat cylindrical head 34*d* of the golh club 2*d*. There is a vertical slot 10*d* on the wall of cylindrical cavity 11*d*. As the golfrisbee rotates 180 degrees due to the eccentric force, at the launch point, the vertical slot is located on the tangent line of the swiveling circle as shown in FIG. 5. The flat cylindrical head 3*d* of golh club 2*d* slips out of the cylindrical cavity 11*d* of the golfrisbee. The golfrisbee 1*d* disengages with the golh club 2*d* and is launched to fly in the sky. As the fast release snapping 34*d* and 32*d* disengages disk 1*d* from the head 3*d* of the club 2, at disengaging position as shown in FIG. 5E, the disk 1 is released by fast release snapping 34*d* on head 3*d* of club 2, the disk 1*d* is released to fly due to the translation momentum and rotation. Due to the eccentric force, it rotates the disc 1*d* from lock to release position and the rotation making disk 1*d* have gyroscopic force to stabilize flight of disk 1*d*.

As shown in FIG. 11, FIG. 12, FIG. 13, FIG. 15, FIG. 16. FIG. 17 and FIG. 19, the golh club 2 has a mechanical wedge type head 67 mounting on the golh club head 3 and a mechanical wedge type cap 670 mounting on the golfrisbee cap 13. In the mounting position, the mechanical wedge type head 67 fitting with the mechanical wedge type cap 670. Rotating 180 degree from the mounting position, the mechanical wedge type head 67 pushes the mechanical wedge type cap 670 away and disengages with the mechanical wedge type cap 670.

Figure 17C:
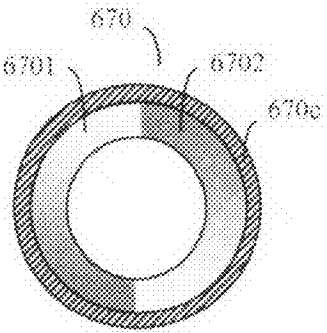
FIG. 17 is the mechanical head and cap of the golfrisbee; (A) is the top view of the head; (B) is the side view of the head; (C) is the top view of the cap; (D) is the side view of the cap.
Figure 17D:
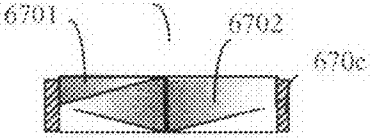
Figure 17A:
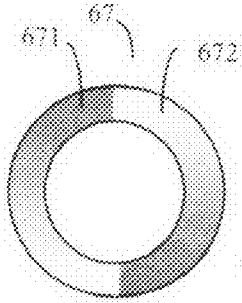
Figure 17B:
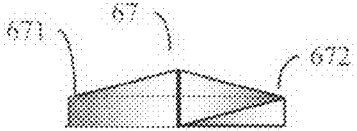

To speed up and ease the mounting of the golfrisbee on the golh club head, versatile club heads have been invented. As shown in FIG. 17 is a mechanical golh head golfrisbee adaptor. As shown in FIG. 17A and FIG. 17B, the golh club head is two semi-circular wedges. As shown in FIG. 17C and FIG. 17D, the golfrisbee cap is the conjugate two semi-circular wedges. The cap and head can fit each other. As the cap rotates 180 degrees, the cap is pushed out by the mechanical wedge to detach from the golh head.

As shown in FIG. 18, FIG. 19 and FIG. 20, the golh club 2 has the magnetic type head 68 mounted on the golh club head 3 and a magnetic type cap 680 mounted on the golfrisbee 1. In the mounting position, the magnetic type head is attracted and fit with said magnetic type cap 680. Rotating 180 degree from the mounting position, the magnetic type head 68 pushes the magnetic type cap 680 away and disengage with said magnetic type cap 680.

As shown in FIG. 18 is a magnetic golh head golfrisbee adaptor. As shown in FIG. 18A and FIG. 18B, the golh club head is one magnetic has the North Pole and South Pole. As shown in FIG. 18C and FIG. 18D, the golfrisbee cap is the magnetic having the conjugate North Pole and South Pole. The cap and head can fit each other due to the attraction of the magnetic force. As the cap rotates 180 degrees, the cap is pushed out by the magnetic force to detach from the golh head.

In FIG. 18, the magnetic is mounted inside the hole. In FIG. 19, the magnetic is mounted outside the fitting hole. As shown in FIG. 19B and FIG. 19C, the protrude 69*p* is fit inside the hole in FIG. 19C. To get rid of the cap outside the golfrisbee rim, the cap thickness is reduced. The magnet is mounted outside the fitting hole.

As shown in FIG. 20 is the composite mechanical and magnetic golh club head and golfrisbee cap. The mechanical wedges of the golh club head and the golfrisbee cap fit together and the magnetic of the golh club head and the golfrisbee cap attract each other. As the golfrisbee cap rotates 180 degrees; the mechanical wedges are pushed apart each other and the magnetic force of the magnets pushing apart each other.

Figures 21A, 21B:
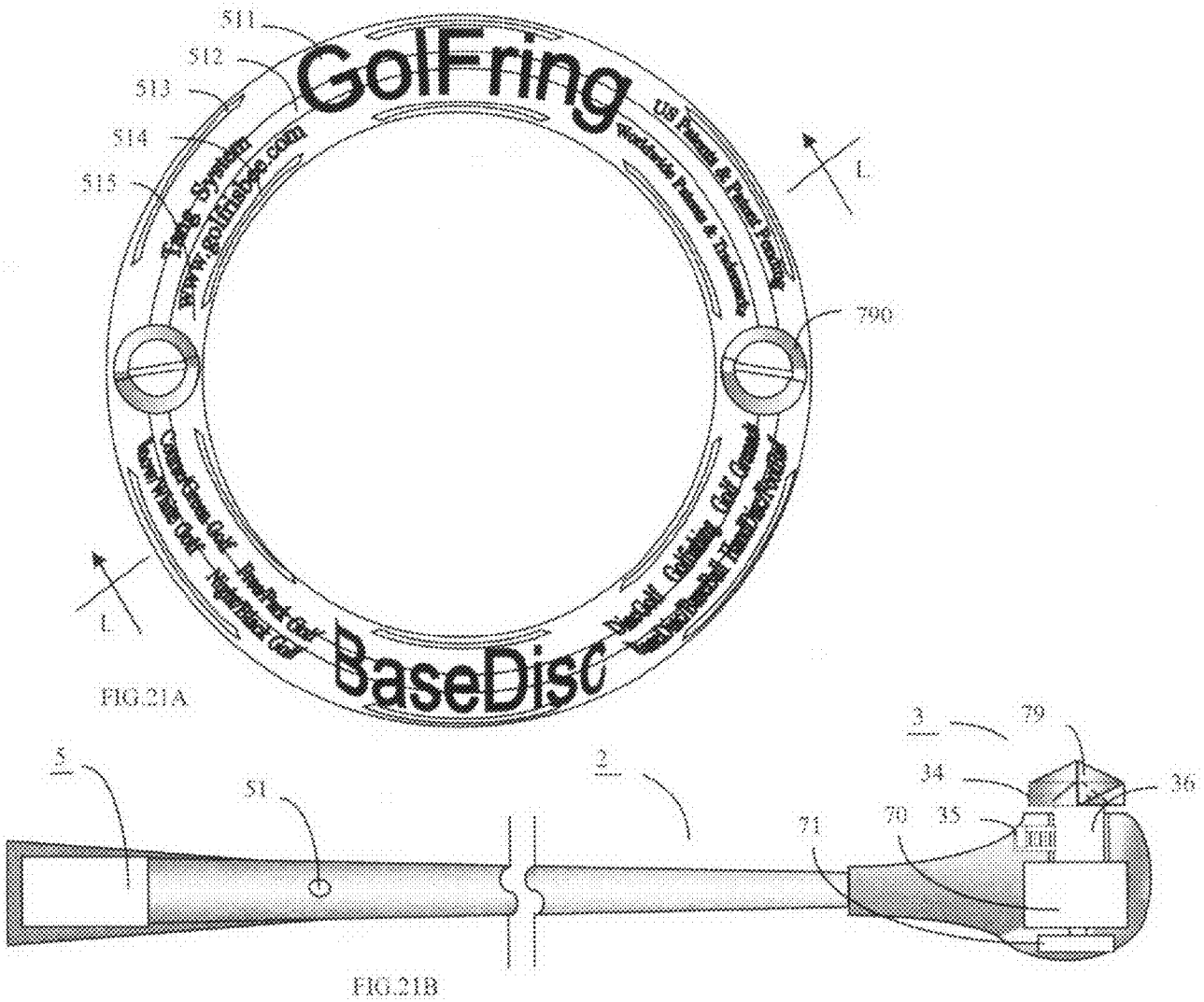
FIG. 21 is the golfrisbee and golh club set having the magnetic and mechanical head and cap. (A) is the top view of the golfrisbee; (B) is the side view of the golh club.

FIG. 21 shows the versatile golfrisbee cap and the golh club head are installed on the golfrisbee and golh club. In FIG. 21, the mechanical and magnetic golh club head and golfrisbee are adopted to be an illustrative example.

Referring to FIG. 9, depending on the golfrisbeer is right-hand user or left-hand user; the golfrisbee club has the right hand golfrisbee club 2 and the left-hand golfrisbee club 7. The right-hand user will swivel the golfrisbee club 2 on the right side of his body; the left-hand user will swivel the golfrisbee club 7 on the left side of his body.

Figure 12A:
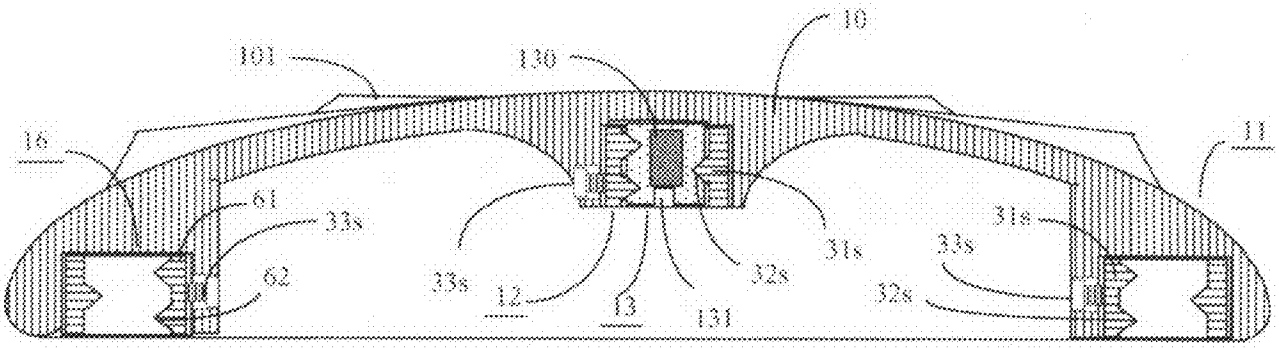
Figure 12B:
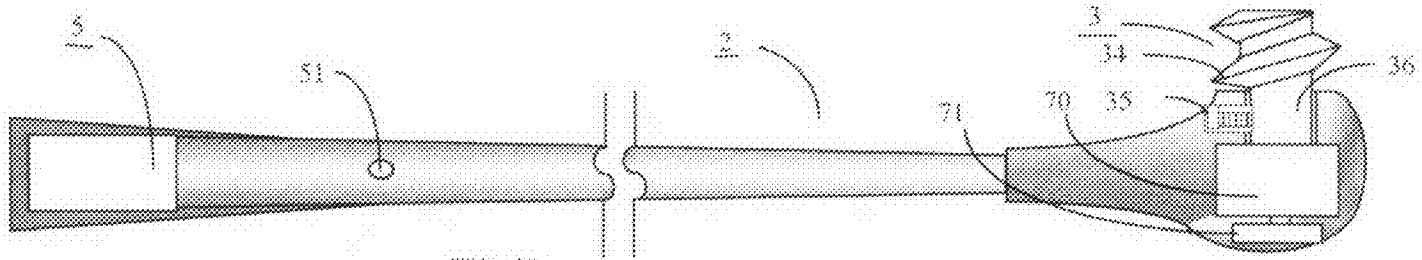

As shown in FIG. 12A and FIG. 12B, for the right-hand golfrisbeer, he uses the right hand golfrisbee club 2 together with the right hand fitting cap. The right hand screw 34 is notched on the club head 3. The right hand screw 32 is notched in the fit cap 11. The fitting cap 11 having the right-hand screw 32 fits on the head 3 having the right hand screw 34.

Figure 12C:
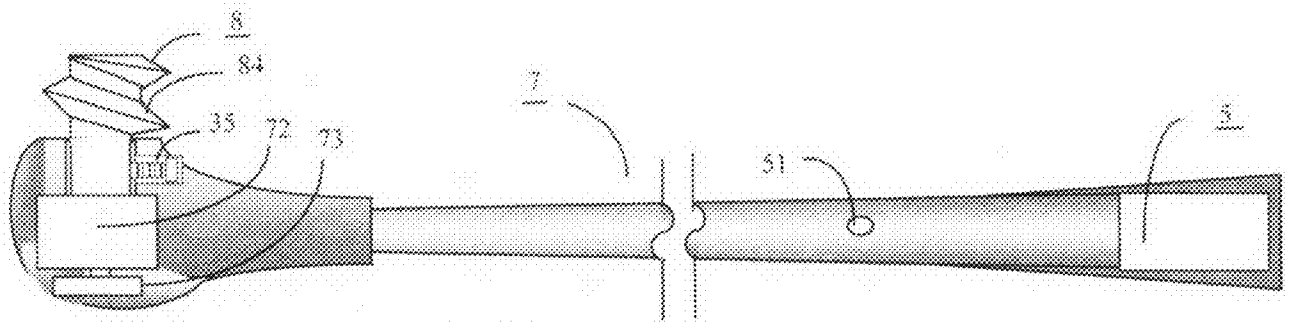

As shown in FIG. 12A and FIG. 12C, for the left-hand golfrisbeer, he uses the left-hand golfrisbee club 7 together with the left-hand fitting cap 16. The left-hand screw 84 is notched on the left-hand club head 8. The left-hand screw 62 is notched in the left-hand fitting cap 16. For the left-hand golfrisbee system, the screw 84 is left-hand screw system. Accordingly, the fitting cap 16 having the left-hand screw 62 fits on the head 8 having the left-hand screw 84.

In the following description, we make a lot of discussion is based on the right-hand golfrisbee. However, the same principles can be applied to left-hand golfrisbee.

Referring to FIG. 12, the golfrisbee disk 1 is a special design disk to rotationally mount on the golh club head 3 with the screw mechanism. The screw 32 of the fitting cap 11 is rotationally fit on the right-hand screw 34 of the golfrisbee club head 3. The club head is constituted of a screw 34 notched on a pole 36. The pole 36 can be locked not to rotate with the locking screw 35. Releasing the locking screw 35, the pole 36 can rotate to adjust the designated launching point of the golfrisbee 1. The fitting cap 11 filling on the club head 3 is mounted beneath the universal golfrisbee 1. The fitting cap 11 is constituted of the tube wall 31 and the right hand screw 32. The fitting cap 11 can be fixed with the locking screw 33. Releasing the locking screw 33, the fitting cap can rotate to change the designated launching point of the golfrisbee 1, too. However, to make the adjustment of the designated launching point, both the fitting cap 11 and the club head 3 have to make the necessary adjustments together. The operation range is very narrow. It is easily out of range. Therefore, we strongly suggest the beginner golfrisbeer to start with the basic golfrisbee. As shown in FIG. 12C, the shield 10 is the airflow guiding plate to reduce the air drag force. The airfoil needs to generate the airlift force. Referring to FIG. 12D the airfoil 101 is the blades which can generate the lift force.

Figure 12D:
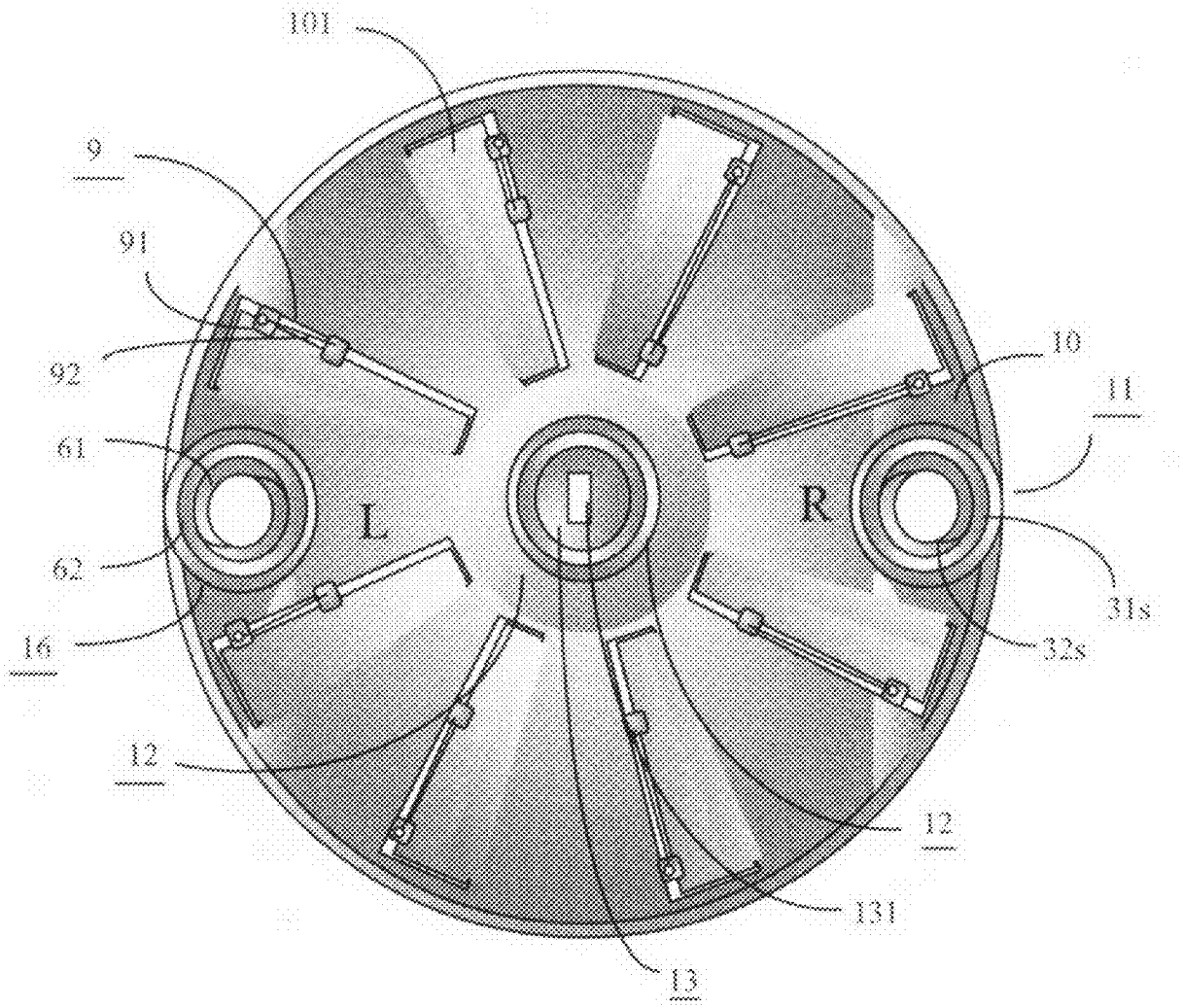
Figure 13A:
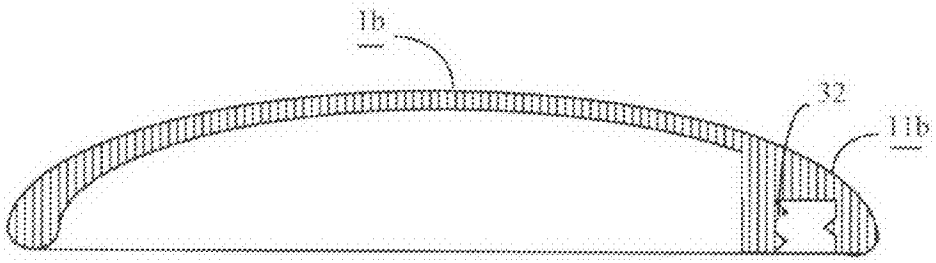
Figure 13B:
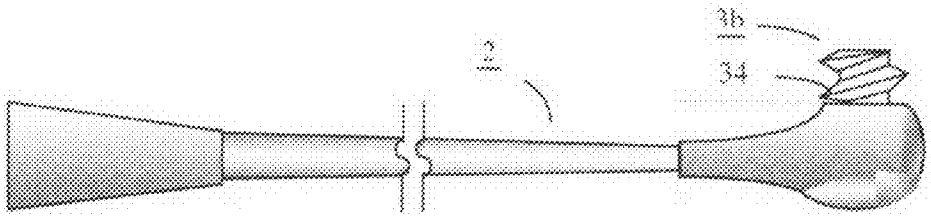
Figure 13C:
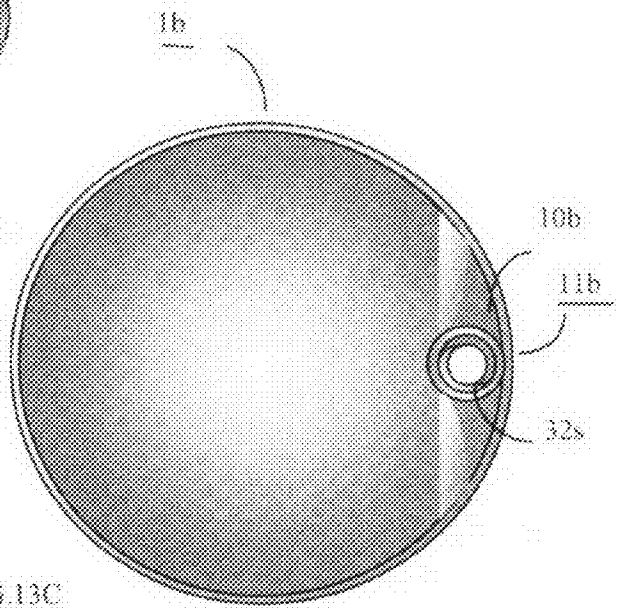

As shown in FIG. 13A, all the value-added components are removed from the universal golfrisbee to be the basic golfrisbee. Referring to FIG. 12, one of the screws 34 is on the head of the golfrisbee club 2; the other corresponding fitting screw 32 is mounted on the golfrisbee disk. They are separable and located on different places, pole and disk. Swiveling the pole, the golfrisbee disk rotates around the screw and launches to take off. The screw 34 and the screw 32 are separate and release the golfrisbee to launch and take off. Swiveling the golfrisbee club, the golfrisbee disk rotates due to the eccentric force and the screw 34 of golfrisbee club and the screw 32 are separate due to the rotation of the golfrisbee disk. This is a blockless snapping lock and launching mechanism. The cap fitting 11*b* is cast to be one unit with the basic golfrisbee 1*b*. The basic golfrisbee has only one fitting cap 11*b* having the screw to be either right-hand screw or left-hand screw. Correspondingly, the golfrisbee club 2*b* has the club head 3*b* having the notched screw to be either right-hand screw or left-hand screw. Referring to FIG. 5, the fitting 11*b* is at the rim portion of golfrisbee disk 1*b*.

Just like the golf having many different clubs, the golfrisbee not only has many different kinds of clubs but also has many different kinds of golfrisbee disks. To understand the swivel-to-launch and push-to-skid working principle of the golfrisbee, the universal golfrisbee as shown in FIG. 23 is simplified to be the basic golfrisbee as shown in FIG. 12. It had better to understand the operation principle of golfrisbee principle with the basic golfrisbee. The operations of the basic golfrisbee are illustrated in FIG. 1, FIG. 5, FIG. 6 and FIG. 7. The golfrisbee is similar to the golf. The golfer swivels the golf club to hit the golf ball to fly or push the golf ball to roll into the hole. The golfrisbeer swivels the golfrisbee club to launch the golfrisbee disk to fly or push the golfrisbee to roll into the hole.

My invention is use the eccentric force to generate the rotation of disk only rotate ½ turn to unlock and launch the flying disk to fly. As shown in FIG. 5 and FIG. 6, it shows the operations of the right-hand golfrisbee. In FIG. 4A, the disk fitting cap 11*b* mounts on the head 3*b* with the screw 32 engaging with the screw 34. As shown in FIG. 4B, rotates the basic golfrisbee 1*b* about ½ circle to ¾ circle in the right-hand screw direction, i.e., in the clockwise direction. The club head 3*b* holds the basic golfrisbee 1*b* with the screw mechanism. As shown in FIG. 4C, swiveling the club 2*b* backward slowly as the golfer or baseball player does. As shown in FIG. 4D and FIG. 4E, swiveling the club 2*b* forward fast as the golfer or baseball player does. Due to the eccentric force, the golfrisbee 1*b* rotates in the counterclockwise direction with the club head 3*b* being the pivotal center. As shown in FIG. 4D and FIG. 4E, as the golfrisbee 1*b* points forward and the club 2*b* is at the highest speed, it is the designated launching point set by the parameters of the golfrisbee. The cap fitting 11*b* of the golfrisbee 1*b* automatically takes off and the golfrisbee 1*b* launches to fly in the sky as shown in FIG. 4D and FIG. 4E.

Figure 23A:
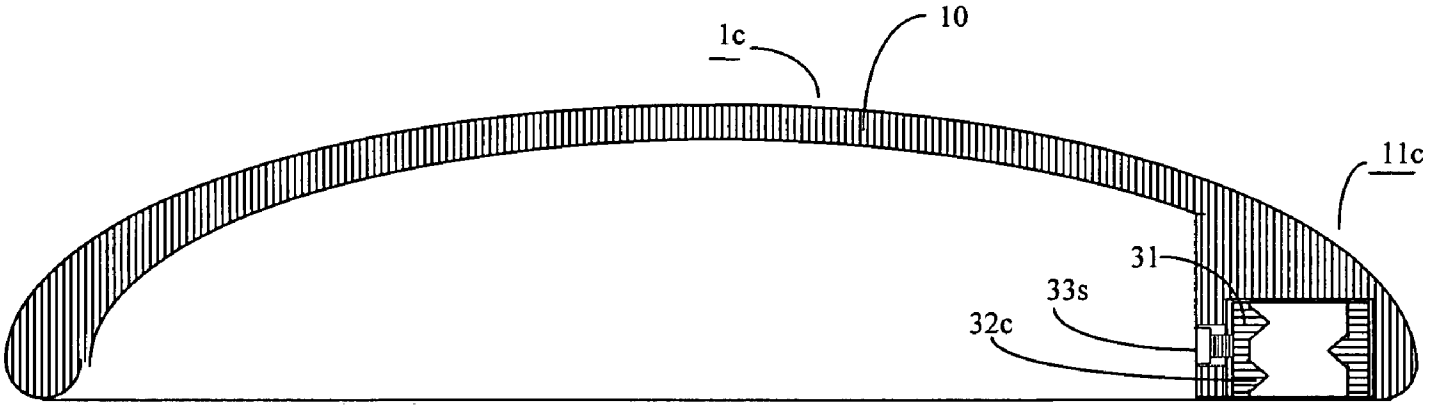

There are two kinds of flying styles: the airplane and the helicopter. Similarly, there are two kinds of flying style for the golfrisbee. As the fitting cap is located at the rim of the golfrisbee disk, the golfrisbee flies as the airplane; as the fitting cap position is at the center of the golfrisbee disk, the golfrisbee flies as helicopter. As shown in FIG. 13, the basic golfrisbee 1*b* mainly flies as the airplane. As shown in FIG. 23, the universal golfrisbee 1 can fly as either airplane or helicopter. Referring to FIG. 23 and FIG. 24, as the fitting cap is located at the center of the golfrisbee, the golfrisbee 1 needs to use the motor enhanced club 2 or 2*a*. For the club having screw mechanism, the launching point must be set at a designated launching point on the swiveling trajectory of the club. Referring to FIG. 23A, the fitting cap 11 at the rim is for the airplane type golfrisbee; the fitting cap 12 at the center is for the helicopter type golfrisbee. With the motor enhanced golfrisbee club 2, the fitting cap 11 at the rim can be used to launch the golfrisbee to fly as the airplane or the fitting cap 12 at the center can be used to launch the golfrisbee to fly as the helicopter.

Figure 23B:
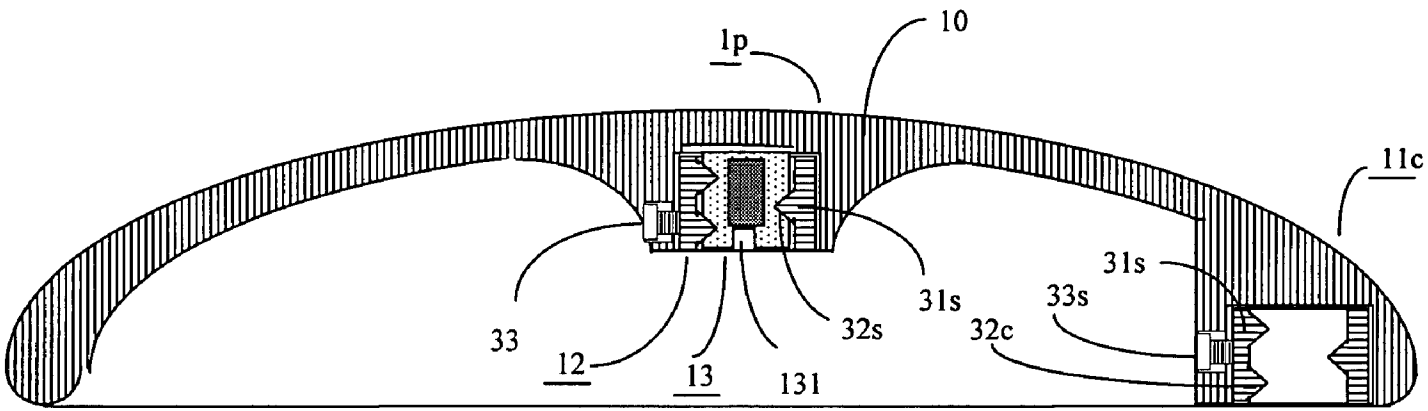
Figure 23D:
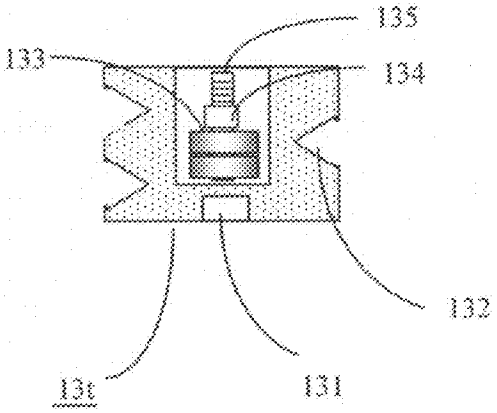
Figure 23C:
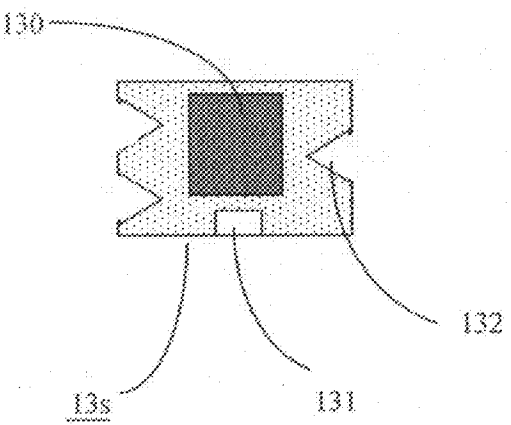
Figure 23E:
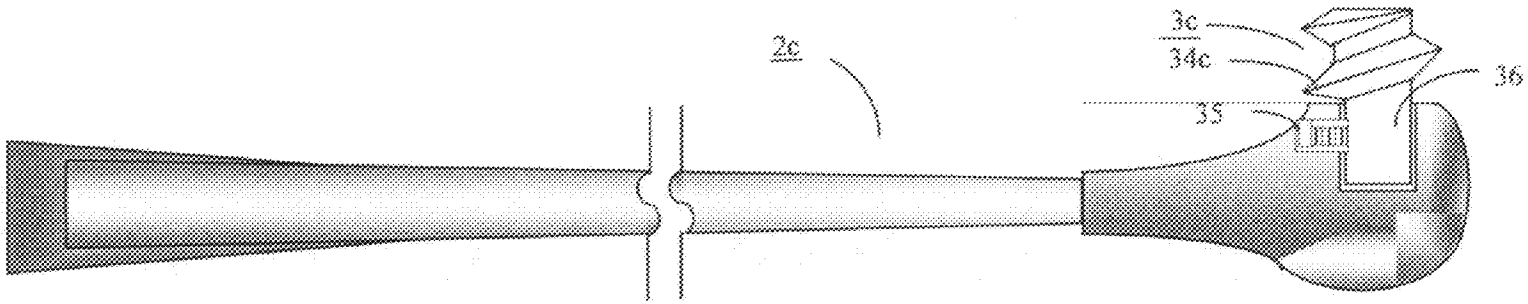

Different screws have different launching effects. Different weights have different launching and fly effects. Different people have different swiveling styles. Under different weather conditions, the golfrisbee has different optimum "weight to aspect ratio" for best performance. To meet the different requirements, we need to have an open platform to meet the different requirements of the versatile working conditions. To understand the open platform principle, the universal golfrisbee 1 is simplified to be the customized golfrisbee 1*c* in FIG. 23 and the personal golfrisbee 1*p* in FIG. 23B. FIG. 23C and FIG. 23D show the different weight systems. FIG. 23A, and FIG. 23B show the golfrisbees with the open platform for the different screw and weight systems.

Figures 22A, 22B, 22C, 22D, 22E, 22F, 22G, 22H, 22I, 22J:
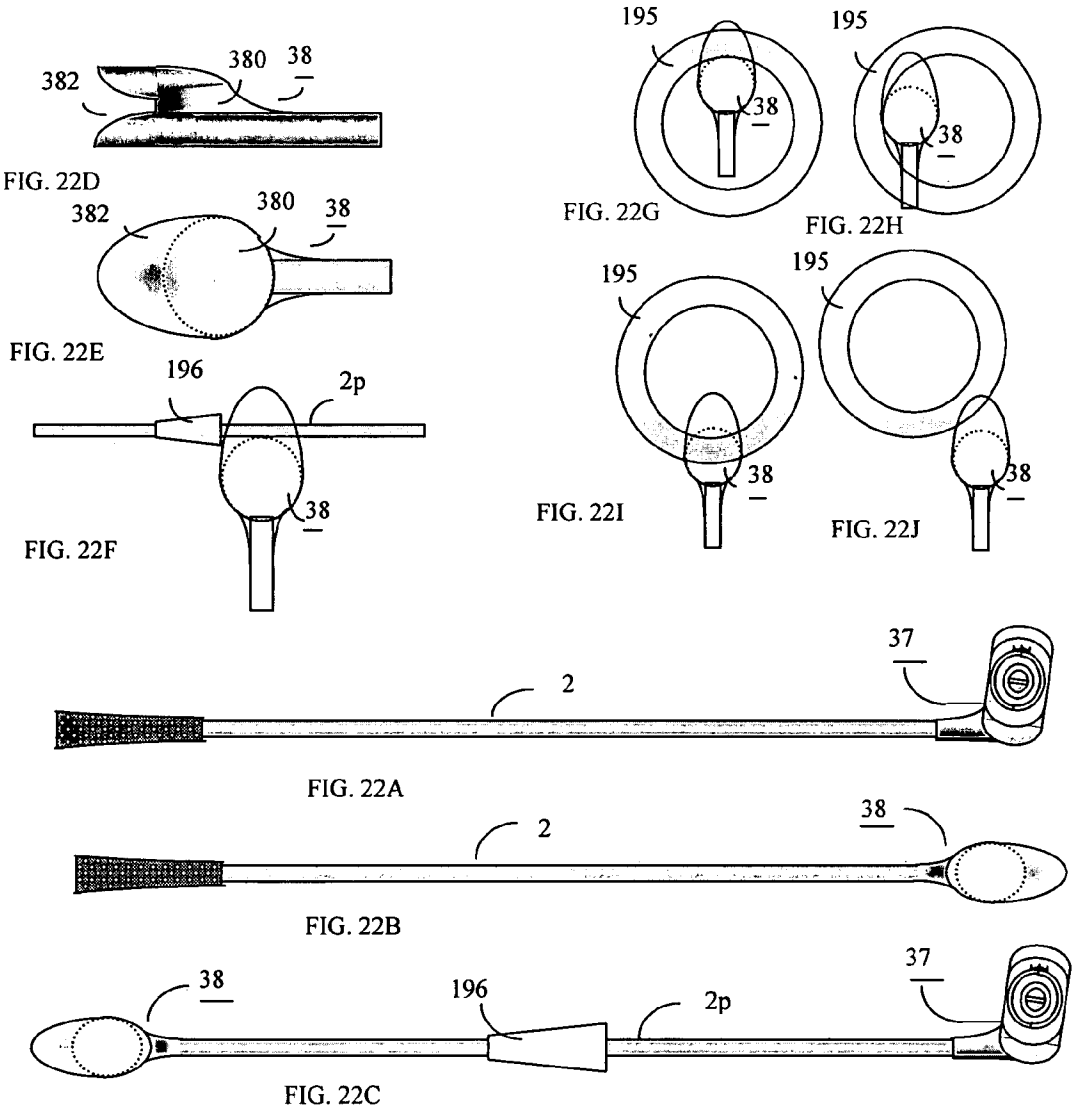

FIG. 22B and FIG. 22C show the auxiliary tool of the fast golh club head 38. FIG. 22B is the golh club with the golh club head 38. The fast golh club head 38 has a shape of duck-head. As shown in FIG. 22F, the fast golh club head 38 can pick up the pole 2 and throw the pole 2 with the duck-mouth 382. As shown in FIG. 22G, he duck mouth 38 also can pick up the flying golfrisbee 195. As shown from FIG. 22G to FIG. 22J, the golfrisbee thrown by the fast golh club head 38 is a ring shaped golfrisbee 195. Golfrisbee ring 195 has an inside edge and outside edge. The golh head has a duck-mouth shaped opening notch 382 attaching to the pivotal axle 380. The duck-mouth-opening 382 clamps at the inside edge of golfrisbee 195. At an opposite edge of the duck-mouth shaped opening notch 382 is an open slope 386 on pivotal axle 380 for the inside ring edge of golfrisbee 195 being released to fly. Swiveling the golh club 2, the golfrisbee 195 pivotally rotates with the axle 380 being axis. Swiveling golh club 2, due to the eccentric force, the inside edge of ring-shaped golfrisbee 195 pivotally rotating around pivotal axle 380. Due to the eccentricity, as shown in FIG. 22I, the golfrisbee 195 continues rotating and releasing from the duck-mouth 382. As the inside edge of the ring-shaped golfrisbee 195 contacting with open slope 386, the ring-shaped golfrisbee 195 is sliding over the open slope 386 and released from golh head to fly in sky. As shown in FIG. 22J, the golfrisbee 195 takes off to fly in the sky. FIG. 22C is the combination of the golh head 37 and the fast golh head 38 with one head at each end.

As shown in FIG. 13, FIG. 15 and FIG. 16, the golfrisbee 1 is pivotally mounted on the head 3*b* of said golh club 2 with a fitting cap 3, A directional lock and release mechanism of the fitting cap 3 and head 3*b* and launch a snap release screw 11*s*, As the golfrisbee 1 is pivotally mounted on the golh head of the club with the fitting cap, said snap release screw engaging the golfrisbee 1 with the head 3*b* of golh club 2 and the golfrisbee 1 being resiliently grasped on the head 3*b* of club. Swiveling the club 1, the golfrisbee 1 rotating due to the eccentric force launching the snap release screw 32*s* releasing the golfrisbee 1 to launch the golfrisbee 1 to fly. Swiveling the golh club 1 with hand in circle movement, the golfrisbee 1 pivotally rotates due to the eccentric force of a circle of the swivel of club 1. The blockless snapping release screw transfers the translation momentum to the golfrisbee 1 and the eccentric force generates the angular momentum of the golfrisbee 1. As the blockless snapping release screw 32*s* disengages the golfrisbee 1 from the head 3*b* of golh club 1. At the disengaging position, the golfrisbee 1 is released by the blockless snapping release screw 32*s* on the head 3*b* of the club. The golfrisbee 1 is released to fly due to the translation momentum and the rotation due to eccentric force. The golfrisbee 1 rotates from lock to release position and the rotation making the golfrisbee 1 has gyroscopic force to stabilize the flight of said golfrisbee.

To have the blockless snapping release action, the snap release screw 32*s* further comprises the dual half-ring screws made of resilient material or composite material of resilient material of rubber and the hard backbone material such as PC (Polycarbonate) as shown in FIG. 15, The dual half-ring screws 32*s* being separated from each other about half circles away. The disk 1 mounting on the head 3*b* of the club 1 at the extension line of the club 2, rotating 180 degrees that the disk 1 being in an engaging position. In the blockless snapping release screw 32*s* there is resilient layer to hold the disk tightly. In said engaging position, rotating the disk 180 degrees in a reverse direction, the disk 1 in disengaging position. Swiveling the club 2, the disk 1 rotates about ½ to ¾ turns having blockless snapping release of the disk 1 with said blockless snapping fast release screw 32*s*. Having the blockless snapping release screw, the flight distance of the golfrisbee can be double the flight distance with the efficient transmission of the kinetic energy and momentum of golf club to the golfrisbee.

Figure 14C:
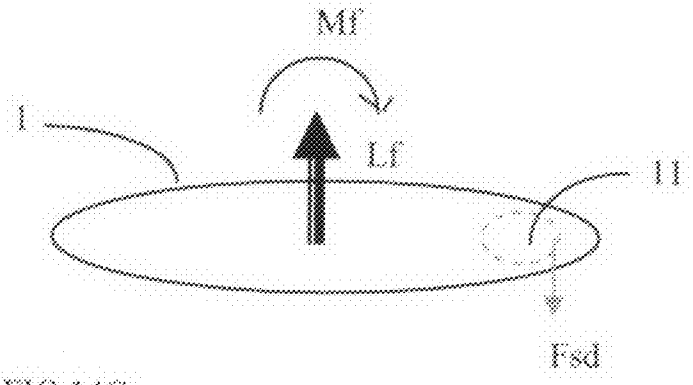
Figure 14D:
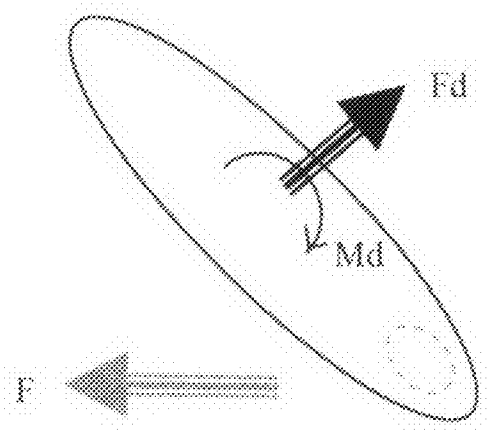
Figure 14A:
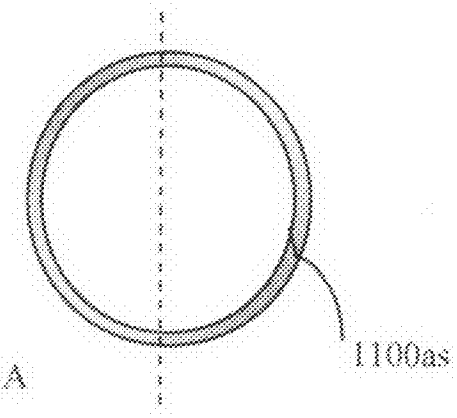
Figure 14B:
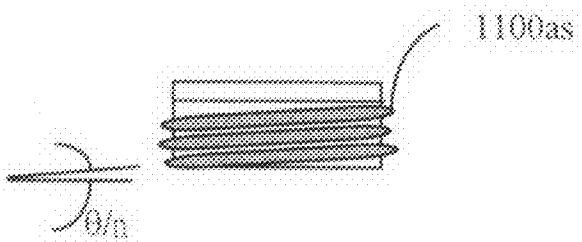
Figure 14G:
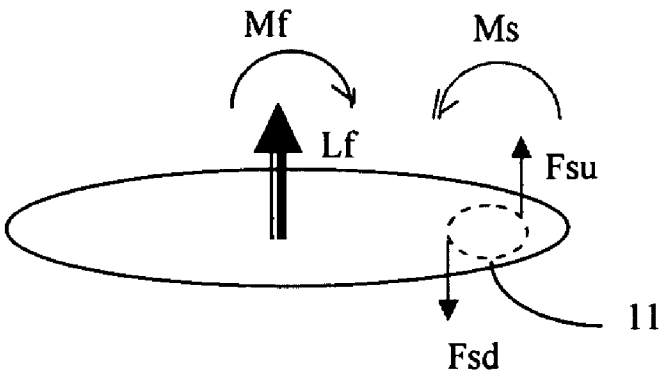
Figure 14H:
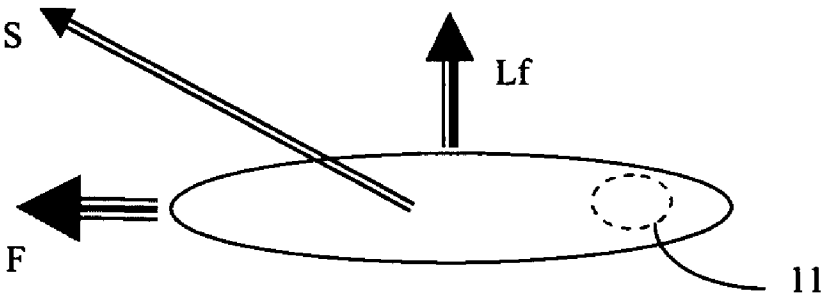
Figure 14E:
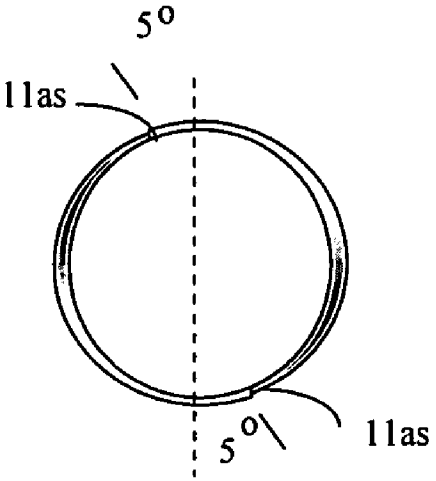
Figure 14F:
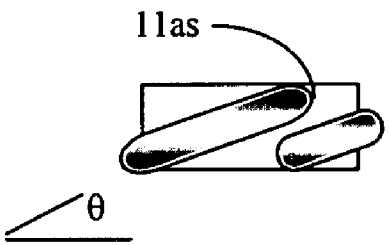
Figure 15A:
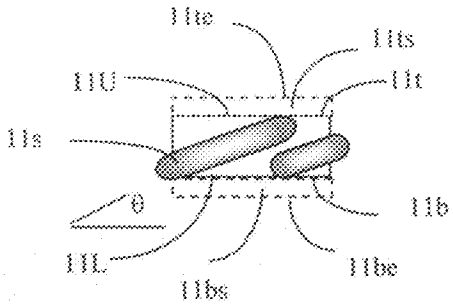
Figure 15B:
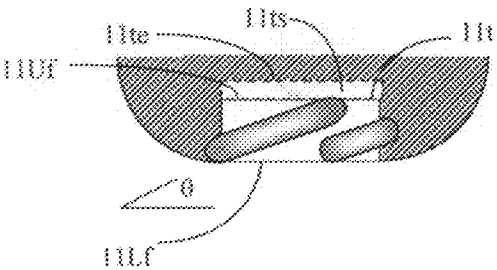
Figure 15D:
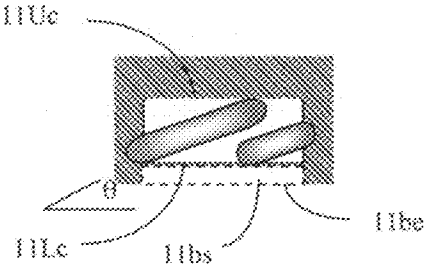

The screw mechanism of the golfrisbee has the special designs. It is not all the screws can be applied to the golfrisbee. They will make the failure of function of the golfrisbee. As shown in FIG. 15, it is the prior art of the screw of bottle and its cap. The prior art of screw of bottle and cap will fail the function of the golfrisbee. As shown in FIG. 15A, the angle of the starting thread is arbitrary. There is no such rule of optimum angle to be 5 degrees as shown in FIG. 6B. The starting point 1100*as* of the thread of screw is arbitrarily located on the rim. As shown in FIG. 14B, there are multiple turns of the single thread of the screw. It is not the dual half-ring golfrisbee screw as shown in FIG. 14F. As shown in FIG. 14C, closing to the launch point, there is only one side of force Fsd induced by the single side engagement of the single thread of screw. The force couple of the lift force Lf and the single-side force Fsd generate the overturning momentum Mf. The overturning momentum Mf will make the golfrisbee 1 rotates around the screw 11. As shown in FIG. 14D, the rotation of golfrisbee disk 1 will cause the stall of the golfrisbee disk and the golfrisbee falls to the ground to have the disaster crash. So the screw of the golfrisbee needs to have the careful design.

As shown in FIG. 5, the swivel of golh club 2 causes the rotation of golfrisbee disk 1 to rotate 180 degrees. One turn has 360 degrees. So. 360 degrees/180 degrees=2, i.e., the golfrisbee needs to be the dual half-ring screw structure as shown in FIG. 14E and FIG. 14F. As shown in FIG. 6B, there is the optimum angle of 5 degrees. It is corresponding to the specified starting points as shown in FIG. 15A. Due to the dual half-ring screw structure, at the launching point, there are two coupling screw forces Fsu and Fsd which generates the count momentum Ms to count against the overturning momentum Mf which is generated by the lifting force Lf to keep the golfrisbee to be flat in the horizontal flying status. As shown in FIG. 14D, as the golfrisbee 1 takes off form the golh head, the golfrisbee keeps the horizontal flying status. The horizontal flying momentum F combining with the lifting force Lf forms the resultant vector sum S. With the vector sum of force S, the golfrisbee flying high in the sky with the horizontal flying status.

Figure 15C:
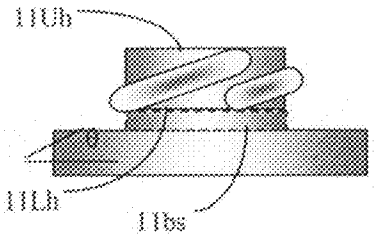
Figure 15E:
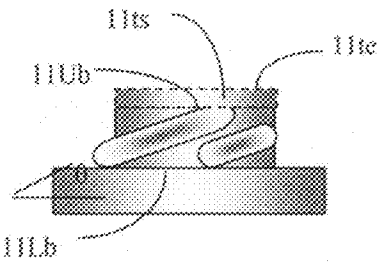

The screw of golfrisbee is dangling screw type. The dangling screw of golfrisbee 1 and golh club 2 is much different from the locking screw of the cap for the bottle type. As shown in FIGS. 15B, 15C, 15D, and 15E are the comparisons between the structures of the golfrisbee screw with the conventional bottle screw. FIG. 15A shows the complete scheme of the screw. The dual half-ring screw 11*s* has the upper edge 11U and the bottom edge 11L. There is an empty space 11*ts* above the dual half-ring screw 11*s* having the top edge 11*te* and the bottom edge 11*t*. The bottom edge 11*t* of the empty space 11*ts* is coincident with the upper edge 11U of the dual half-ring screw 11*s*. FIG. 15C is the section view of the golfrisbee screw structure; FIG. 15E is the section view of the cap structure. FIG. 15C is the elevational view of the screw of the head of the golh club; FIG. 15E is the elevation view of the screw of the bottle. Comparing the golfrisbee screw in FIG. 15B with the cap screw in FIG. 15D, the golfrisbee screw has the upper free space 11*ts* and it doesn't have the low free space 11*bs*; on the contrary, the cap doesn't have the upper free space 11*ts* and it has the low free space 11*bs*. Comparing the golh club screw in FIG. 15C with the bottle screw in FIG. 15E, the golh club screw has the bottom free space 11*bs* and it doesn't have the upper free space 11*ts*; on the contrary, the bottle screw doesn't have the bottom free space 11*bs* and it has the upper free space 11*ts*. The screw structure of the golfrisbee 1 and golh club head 2 completely reverses the relation of the cap and bottle. It is due to the golfrisbee and golh head being dangling relation and the cap and bottle being locking relation. In the dangling relation, swiveling the golh club 2, the golfrisbee easily takes off to fly in the dangling screw relation. If the golfrisbee and golh club head dangling is mistaken to be the locking screw of the cap and the bottle, the golfrisbee and golh club cannot detach from each other. In the locking condition, the mistaken lock golfrisbee will not detach from the golh club 2 to fly. So, the screw mechanism of golfrisbee 1 has the free space at the top of screw and the screw mechanism of golh club has the free space at the bottom of screw. The screw must be dual half-ring with the starting screw position to be 5 degrees from the vertical extended straight line.

Figure 16A:
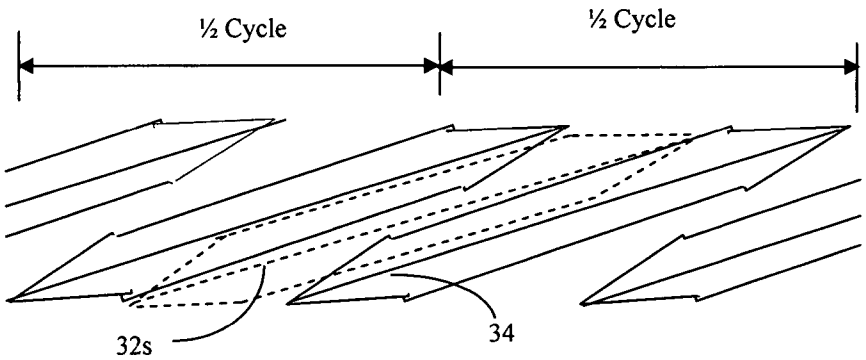
FIG. 16 is the open platform of customized golfrisbee with different kinds of launching screw and weight systems; (A) is the linear launching screw mechanism; (B) is the jumping type nonlinear launching screw mechanism; (C) is the speedy type nonlinear launching screw mechanism.
Figure 16B:
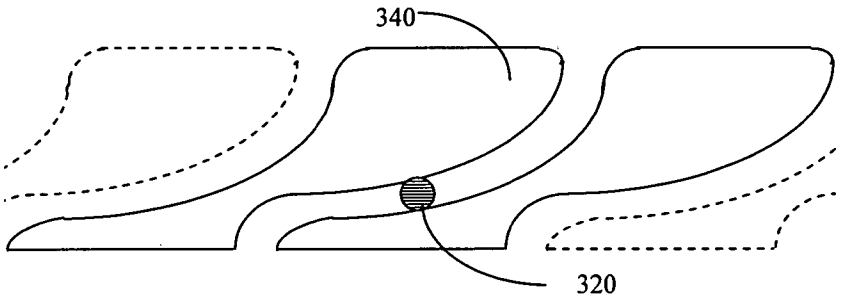
Figure 16C:
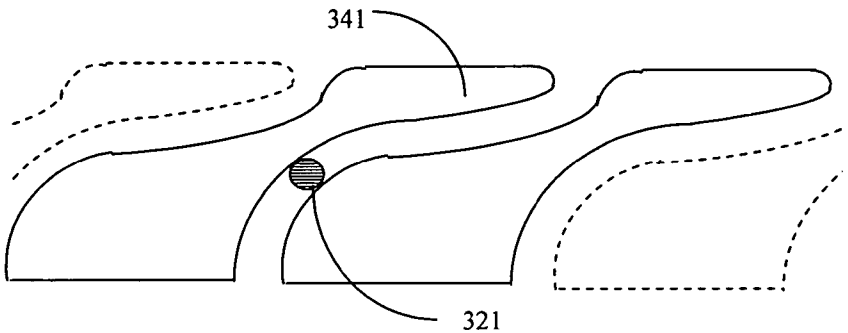

As shown in FIG. 16A, FIG. 16B, and FIG. 16C, there is different blockless snapping lock of screw systems. FIG. 16A is the blockless snapping lock and launch of linear screw system. The linear screw shown in FIG. 16A is the screw system shown in FIG. 23. The screw 34 is notched on the pole of club head 3. The screw 32 notched on the inside wall 31 of cap fitting 11. For the linear system, the vertical take-off speed of the golfrisbee disk 1 is only a fraction of the horizontal rotational speed.

For the blockless snapping lock and launch means of non-linear screw system, the screw notched on the fitting cap 11 is different from the screw notched on the club head 3. To increase the vertical take-off speed of the disk 1, the non-linear screw system 340 is used. The horizontal rotation momentum will convert to the vertical take-off momentum. As shown in FIG. 16B, the jumping type screw 340 is in parabolic shape notched on the club head 3. The corresponding nonlinear screw 320 is a circle spot notched on the fitting cap 11.

FIG. 16C is the non-linear screw system 341 designed for the throwing distance. As shown in FIG. 16C, the speeding type golfrisbee nonlinear screw 341 is notched on the cap fitting means; the nonlinear screw is notched on the club head is only one circular spot 321, or vice versa. The golfrisbee 1*a* will not start the take off process until the club 2*a* swiveling at very high speed. The momentum is transmitted from the club 2*a* to the golfrisbee 1*a* effectively. The golfrisbee 2*a* with the nonlinear screw 341 will fly farther than the golfrisbee 2*a* with linear screw system 34.

In the windy day, we need to increase the weight of the golfrisbee. As shown in FIG. 23A and FIG. 16B, the universal golfrisbee disk 1 and the personal golfrisbee disk 1*p* are the open platform for different weight package 13. The adjustable weight package is fit in the central fitting cap 12.

As shown in FIG. 16A, FIG. 16B and FIG. 16C, to fit for the different requirements in the versatile conditions, the fitting cap 11*c* and the club head 3*c* can be exchanged. The customized golfrisbee 1*c* or the personal golfrisbee 1*p* and the customized club 2*c* provide the open platform for the different screw and/or weight system. Releasing the locking screw 33, the fitting cap 11*c* can be exchanged for different screws. Releasing the lock screw 35, the club head 3*c* can be exchanged for different screws. Exchanging the fitting cap 11*c* or the club head 3*c*, the screw 34*c* needs to match with the screw 32*c*. They should be changed in pair. Since it is difficult to calibrate, there is an alignment mark marked on the disk 1*c* to suggest the alignment of the fitting cap 11*c*. There is an alignment mark marked on the club 2*c* to suggest the alignment of the club head 3*c*, too.

Referring to FIG. 23, as the golfrisbeer uses cap-fitting 11*c* at the rim, the weight package 13 is screwed in the central fitting cap 12. As shown in FIG. 23C and FIG. 23D, the weight package 13 has two different types, packages 13*s* and 13*t*. As shown in FIG. 16C the adjustable weight 13 is a sealed package. Different package 13*s* has the different weight 130. The weight 130 is sealed inside the package. Depending on the wind condition, the golfrisbee player will select different weight package 13*s*. The notch 131 is to remove or install the weight package 13*s*. If the golfrisbeer wants to have fine tune for the weight, he can use the personal weight package 13*t*. The weight plate 133 can be added to the stud 135. The screw 134 locks the weight plates to the package 13*t*.

Referring to FIG. 12, to increase the lift, there are the airfoil means of blades 101 attaching to the disk body. To increase the rotating angular momentum of the golfrisbee 1, the motor 70 can be embedded in the head 3 of golfrisbee club 2. In the motor enhanced swivel-to-launch mode, the lock screw 35 will be released to let the axle 36 freely spin. The working principle of the motor enhanced golfrisbee is very smart. To swivel the golfrisbee pole to launch the disk to fly, the angle of the launching is very important. Just like the taking off process of the airplane, the angle of taking off is very important. In the golfrisbee disk launching to take off process, the angle is very important, too. The launching angle of the golfrisbee disk is controlled by the screw position. Referring to FIG. 13, for the golfrisbee club without the motor, the blockless snapping lock and launch means of screw 34 positions is fixed to the optimum position. However, referring to FIG. 12, for the golfrisbee disk 1 being driven by the screw 34 with the motor 70 to rotate to increase the rotational momentum of the golfrisbee disk, at the moment of the launching the golfrisbee disk, the motor needs to stop rotation and parking the blockless snapping lock and launch means of screw 34 at the optimum position to have the optimum launching angle to launch the golfrisbee disk 1 to fly. This optimum parking position for the blockless snapping lock and launch means of screw 34 is referred to be the stopping position. The screw mechanism has both driving and launching capabilities. The push button 51 is the switch for the motor 70. There is one launching point indicator 71 which is the launching position and the rotating stop position indicator for the motor. On the launching point indicator 71, there is a stopping position mark. The motor will stop at the position specified by the stopping position mark. As the push button 51 is pushed to run, the digital motor will continuously run; as the push button 51 is pushed again, the digital motor will stop at the position specified by the stopping mark 71. As the motor 70 runs and drives the golfrisbee disk 1 to rotate, the golfrisbee disk 1 is engaged and held by the screw 34. As the motor 70 suddenly stops running and holds the axle 36 still, the golfrisbee disk 1 continues rotating due to the angular momentum. The golfrisbee disk 1 is released to launch to fly at the launching point specified by the launching point indicator 71. Such kind of an operation can be easily implemented with the modification of the traditional stepping motor. The battery pack 5 is to supply the electrical power to the motor 70. It can be rechargeable battery pack or conventional battery pack or fast exchangeable battery pack. The battery is embedded in the handle for the convenience of the replacement of the battery. Just sliding in and out, the battery can be replacement.

Figure 24A:
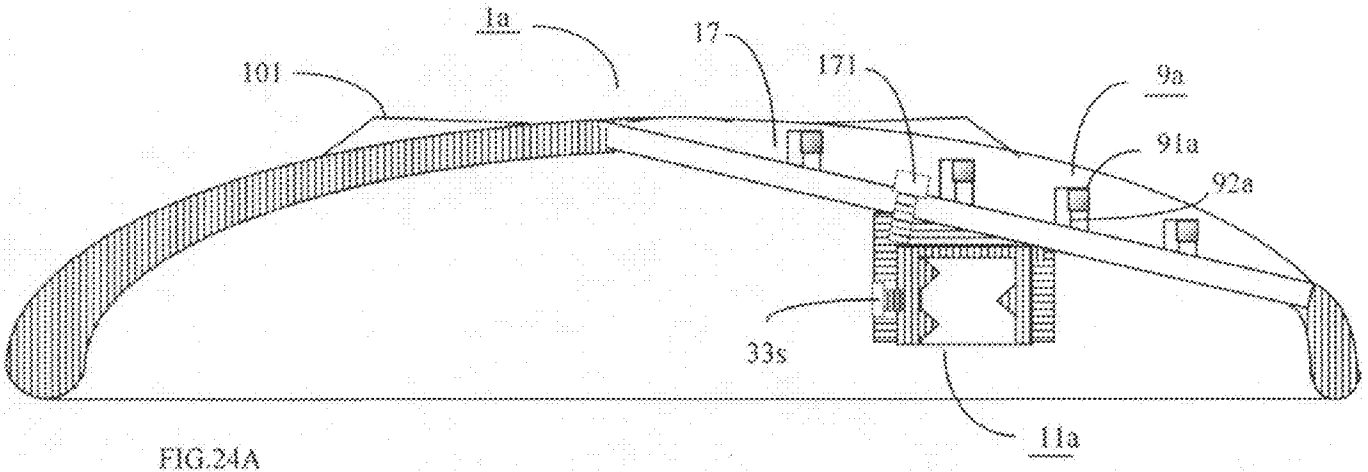
Figure 24B:
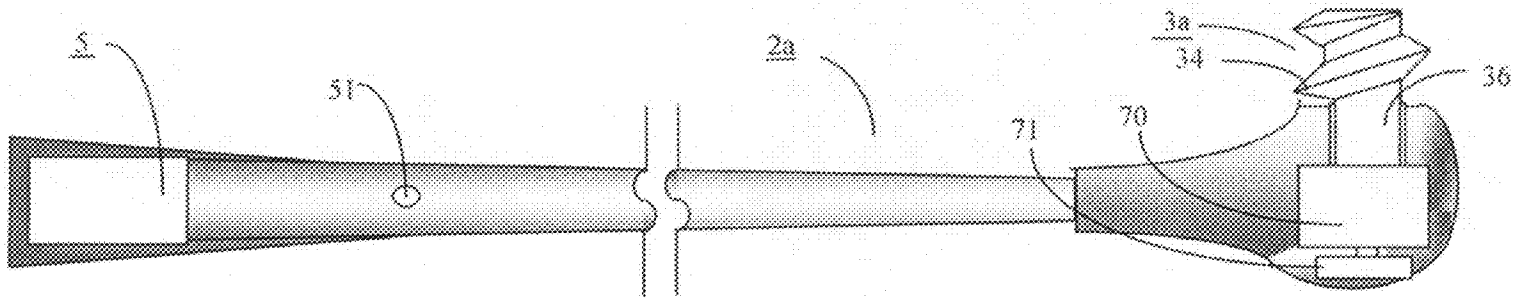
Figure 24C:
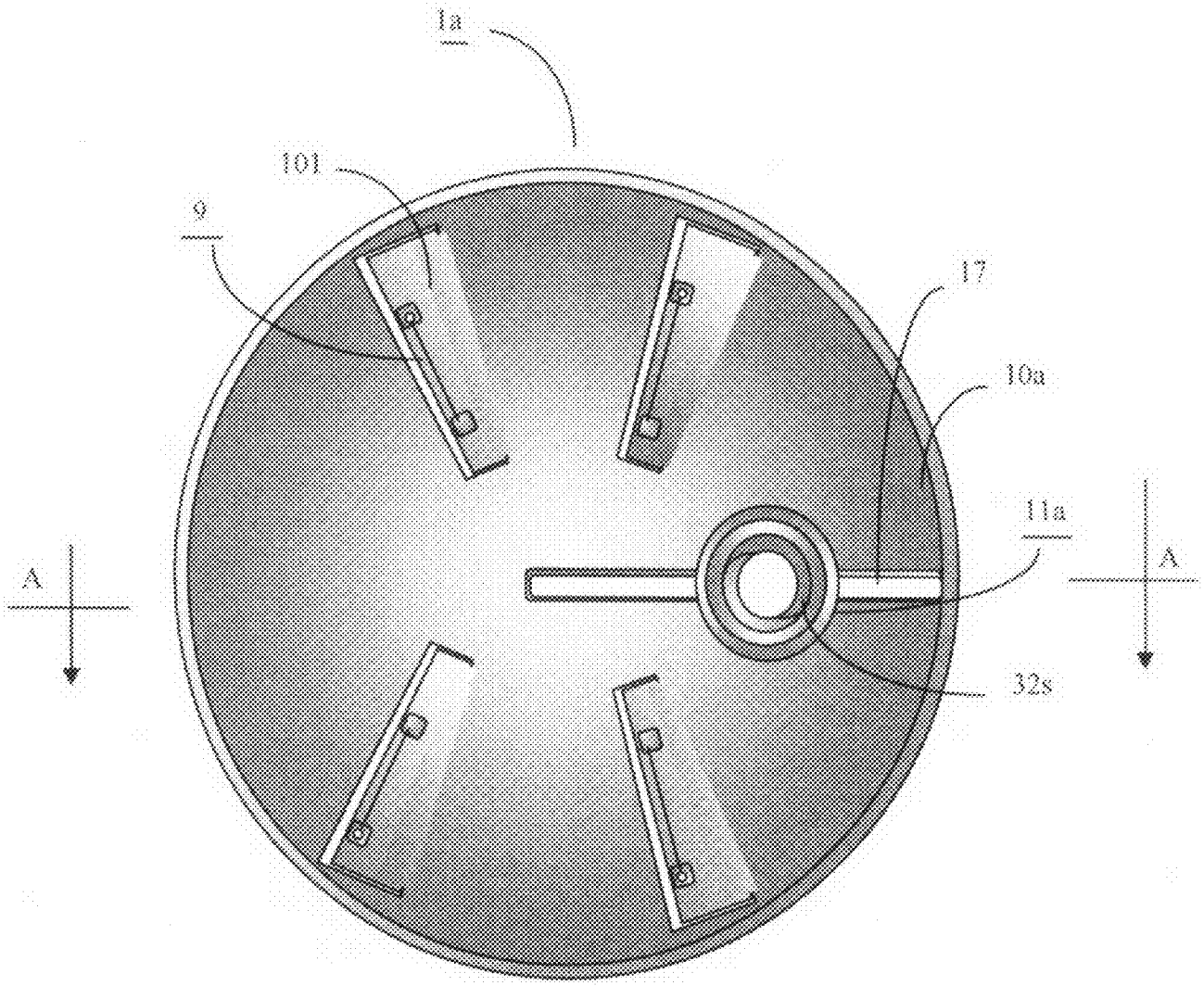

As shown in FIG. 24, it shows the adjustable golfrisbee 1*a*. Depending on the position of the fitting cap 11*a*, the golfrisbee disk can fly as an airplane or a helicopter. As the fitting cap 11*a* is located at the center, the golfrisbee 1*a* flies as the helicopter does. As the fitting cap 11*a* is located at the rim, the golfrisbee 1*a* flies as the airplane does. Referring to FIG. 24A and FIG. 24C, the blockless snapping lock and launch means of fit means 11*a* can be adjusted from the rim of the golfrisbee disk 1*a* to the center of the golfrisbee disk 1*a*. As shown in FIG. 24A, releasing the locking screw 171, the adjustable fitting cap 11*a* can slide on the slot 17. On the vertical wall of the guiding slot, there are the multimedia means 9*a*. The integrated multimedia device 9*a* has the similar structure as the integrated multimedia device 9 as shown in FIG. 12. The opening on the vertical wall for the multimedia means 9*a* not only reduces the aerodynamic drag but also has the multimedia effects. The adjustable golfrisbee 1*a* is launched to fly with the motor enhanced club 2*a* as shown in FIG. 24B.

As the golfrisbee 1 flies into the bush or fall into the pond, the pick-and-throw club 17 is needed. As shown in FIG. 26, the pick-and-throw club 17 is constituted of the finger 135 and the palm 178 to grasp the rim of the golfrisbee to pick up the golfrisbee and throw the golfrisbee. The finger 135 is pivotally mounted on the axle 171. Pressing on the handle 176, the steel wire 172 slides inside the guide tube 173 to pull the finger 135 to grasp the golfrisbee disk. The extension pole 174 slides in the handle pole 175 to adjust the pole length. The locker 176 is to lock the extension pole 174. As the locker 176 is released, the extension pole 174 can slide in the handle pole 175.

As the golfrisbeer does not have enough room to swivel the golfrisbee club, the golfrisbee has to fly out of the limited space as the helicopter does. Referring to FIG. 25, the club 2*h* having no screw, the club 2*h* must be the motor enhanced club. The launching point can be at any point on the swiveling trajectory of the club 2*h*.

As shown in FIG. 25A, the golfrisbee 1*h* has the fitting cap 275 locating at the center. The fitting cap 275 fits on the cone 270 of the club 2*h*. The motor 232 slides on the pole of the golfrisbee club 2*h*. The motor 232 drives the steel wire 235 to rotate in the guided tube 234. The steel wire 235 drives the flat key 271 to rotate. The key 271 is inside the cone 270 to drive the cone 270 to rotate. Attaching to the flat key 271, there are two wires 236 having the hooked ends to grasp the protrude 276 at the top of the cone 275. First, mount the golfrisbee 1*h* with the fitting cap 275 fitting on the cone 270. As the motor 232 is pulled backward, the steel wire 235 pulls the wire 236 downward. Under the constraint of the tube confinement 237, the steel wire hooks 236 close to grasp the protrude 235. Pressing on the button 51*h*, the motor 232 drives the steel wire 235 to rotate. The steel wire 235 drives the key 271 to rotate. The key 271 drives the cone 270 to rotate. The cone 270 drives the golfrisbee 1*h* to rotate. As the motor 232 is pushed forward, the spring 272 pushes the key 271 upward. The hooks 236 will push the golfrisbee 1*h* to launch and release the golfrisbee 1*h* to fly. Under the lift force of the blade 101, the helicopter type golfrisbee 1*h* takes off to fly.

As shown in FIG. 12D or FIG. 24A, as the air passes the slot blowing on the integrated multimedia device 9 or 9*a*, it generates the multimedia effects. The multimedia device 9 can be as simple as the string 91 tied to the pole 92 or as complex as the integrated multimedia device 9*m* as shown in FIG. 27. For the simple string 91, it can be string ties two ends of poles 92. As the wind blows on it, it will generate sound. For the multimedia means 9*m*, it is a flat tongue means has one free end to vibrate.

As shown in FIG. 27, the integrated multimedia means comprises a vibration tongue 90 for providing sound and vibration to a vibration enlightened means 83. The vibration enlightened means 83 is attached to the vibration tongue 90. A vibration of the vibration tongue 90 stimulates the vibration-enlightened means 83 to light. The air flows through the vibration tongue 90 and transfers energy to the vibration tongue 90 to be vibration energy of the vibration tongue 90. The vibration tongue 90 vibrates and transfers vibration energy to vibration enlightened means 83 to be electrical energy. The electrical energy is convened to be light energy. The vibration tongue 90 enhances the energy conversion from the airflow to be light.

As shown in FIG. 27, the integrated multimedia device 9*m* is constituted of the vibration lighting LED 83, the magnets 801 and 802, the vibration tongue 90 and/or the vibration fork 911. The principle of the vibration enlightened LED 83 has already fully disclosed in the FIG. 19 of U.S. Pat. No. 6,193,620. In this patent, we further integrate the harmonic vibration sound mechanism with the vibration-enlightened mechanism to be an integrated multimedia mechanism 9*m*. As the airflow 950 flows through the slot, it blows on the vibration tongue 90 and/or the vibration fork 911 to generate the harmonic vibration and sound. The vibration enlightened LED 83 can be either attached to the free end of the vibration tongue 90 or attached to the vibration fork 911. There are many different designs and alignments. As the wind 95 blows on the tongue 90, it generates the harmonic vibration of whistle sound. The vibration of the tongue 90 will make the fork 911 to have the harmonic resonance. The harmonic resonance of the fork 911 causes the vibration enlightened LED 83 to shine light. As the vibration enlightened LED 83 vibrates in the magnetic field 94 generated by the magnet poles 801 and 802, the coil 81 wrapping around the LED 83 cuts the magnetic field line 94 to generate the electrical voltage. Due to the harmonic oscillator circuit being constituted of the LED and the coil, the electrical voltage will build up and enlighten the LED. The vibration enlightened LED 83 has different colors. As the golfrisbee disk flies and rotates, it looks beautiful.

Figure 28A:
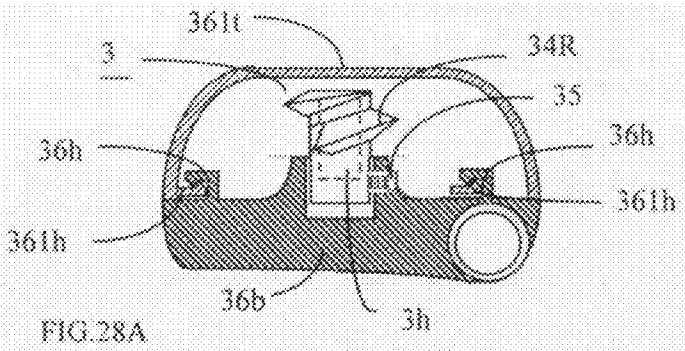
Figure 28B:
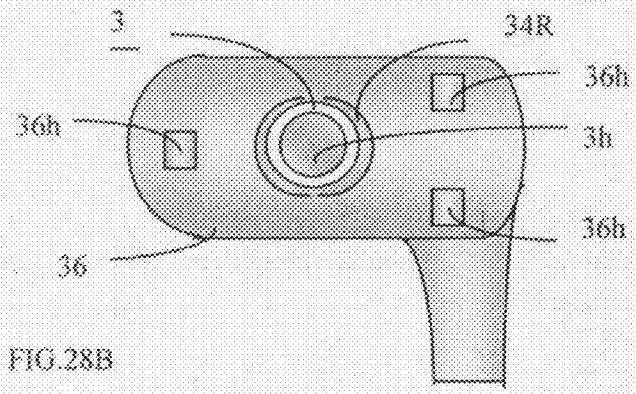
Figure 28C:
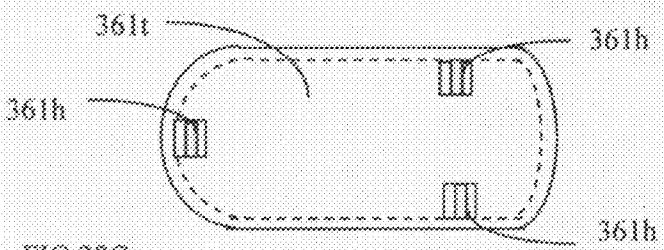
Figure 38B:
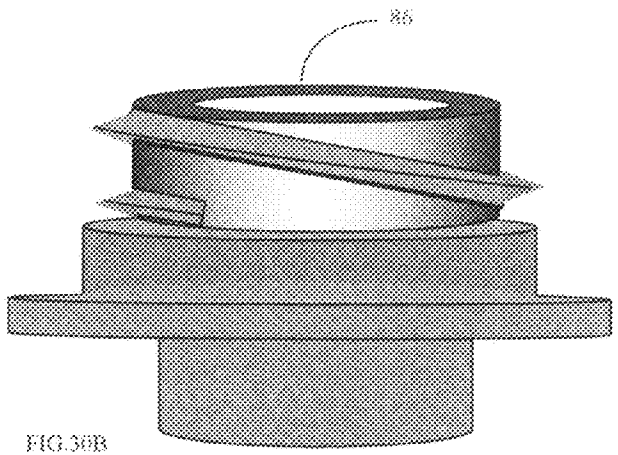
Figure 38A:
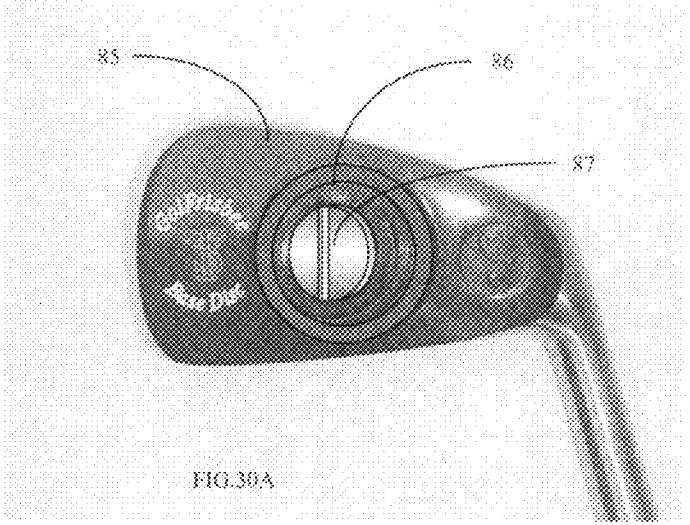
Figure 38C:
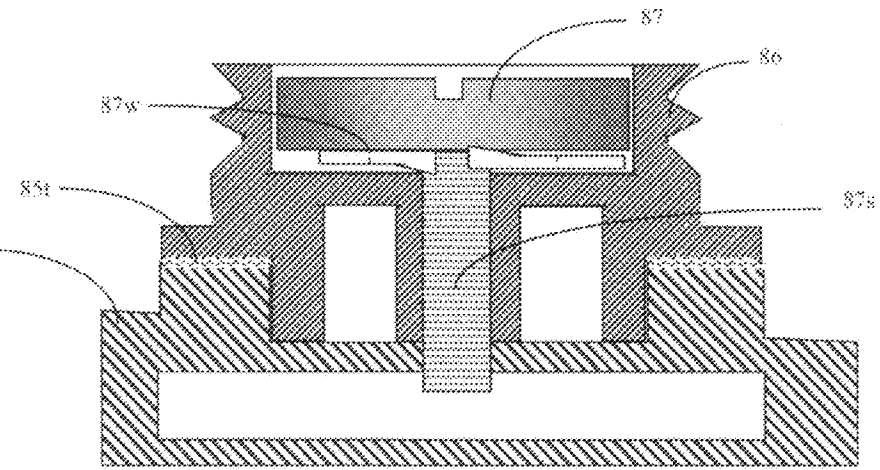

Since the golfrisbee sport adopts the screw mechanism to swivel and launch the golfrisbee to fly with the golh club, we need to protect the screw mechanism. As shown in FIG. 28A, FIG. 28B and FIG. 28C, the dust cover 36*l* sliding mounts on the golh head 36 to protect the screw 3 from the dust. As shown in FIG. 28B and FIG. 28C, mounting the dust cover 36*l* on the golh head 36, then slides the dust cover 36*l* sideward to lock the dust cover 36*l* with club head 36. The dust cover hooks 36*lh* are engaged and locked with the golh head hooks 36*h* as shown in FIG. 28C.

Golfrisbee has several characteristics which are unique to the golh club. We have to make the innovation in the design and manufacture process to make the golfring can be delivered to market.

First, the golfrisbee has much larger momentum than the hand-thrown Frisbee. The impact of the golfrisbee might break the golfring even the hand-thrown Frisbee doesn't break. So not only the material but also the way of manufacture have to make innovations to overcome the breakage of the golfring problem.

Second, the golfrisbee has much larger angular momentum than the hand-thrown Frisbee. Even the minor distortion of the golfrisbee will turn over the flying golfring even the hand-thrown Frisbee doesn't. The yield of good golfring is only 10%. However, the production cost of the golfring is very high. So, it must make the innovation in manufacture of the golfring to have 100% yield.

Third, the angular position of the launching screw is very important to have the golfring to launch at the proper time at the proper position. The tolerance of the angular position is less than 5 degrees. However, it is extremely difficult to ask the vender to make the golfring having the same angular position. So, we have to make the innovation in the golh head that the golfring player can adjust the angular position of the launching screw.

Fourth, as mounting the golfring on the launching screw and as the golfring rotates to launch to fly on the launching screw, the golfring serves as a big wrench. This wrench turns and rotates the launching screw easily. It destroy the launching angle that the screw has to be adjusted. It is a tedious work and each throws becomes non-correlated. The golfring player cannot adjust the way to swing the golh club according to the formal throwing result. So, the adjustable launching screw must be able to fixed even under the large torque of the golfring.

Fifth, the resolution of the adjusting angle step 1 degree is too small for the numerical controlled machine and the casting manufacture. The resolution of the NCM and casting process is 5 degrees.

As shown in FIG. 29 and FIG. 30A, a launching screw 86 is mounted on the golh club head 85 with a coin-operated fixing screw 87. Using a coin to turn the fixing screw 87, the launching screw 86 will be fixed to the golh club head 85 or released to rotate to adjust the launching angle for the golfring. As shown in FIG. 30B, it is the elevational view of the launching screw 86. Inside the launching screw 86, there is one hole to fit for the coin-operated fixing screw 87. FIG. 30C is the partially exposed of the elevational view of the launching screw and the golh club head.

Swinging the club to launch the golfrisbee to fly, there is very large toque force applying on the blockless snapping release screw 86 to rotate the blockless snapping release screw 86. Between the head 85 of golh club 2 and the blockless snapping release screw 86, it has the anti-skid teeth 85*t*. Applying the tightening screw 87 to apply pressure to the blockless snapping release screw 86 to press against to the anti-skid teeth 85*t* of the head 85, it can prevent the blockless snapping release launching screw 86 to rotate.

Figures 30D, 30E, 30F, 30G:
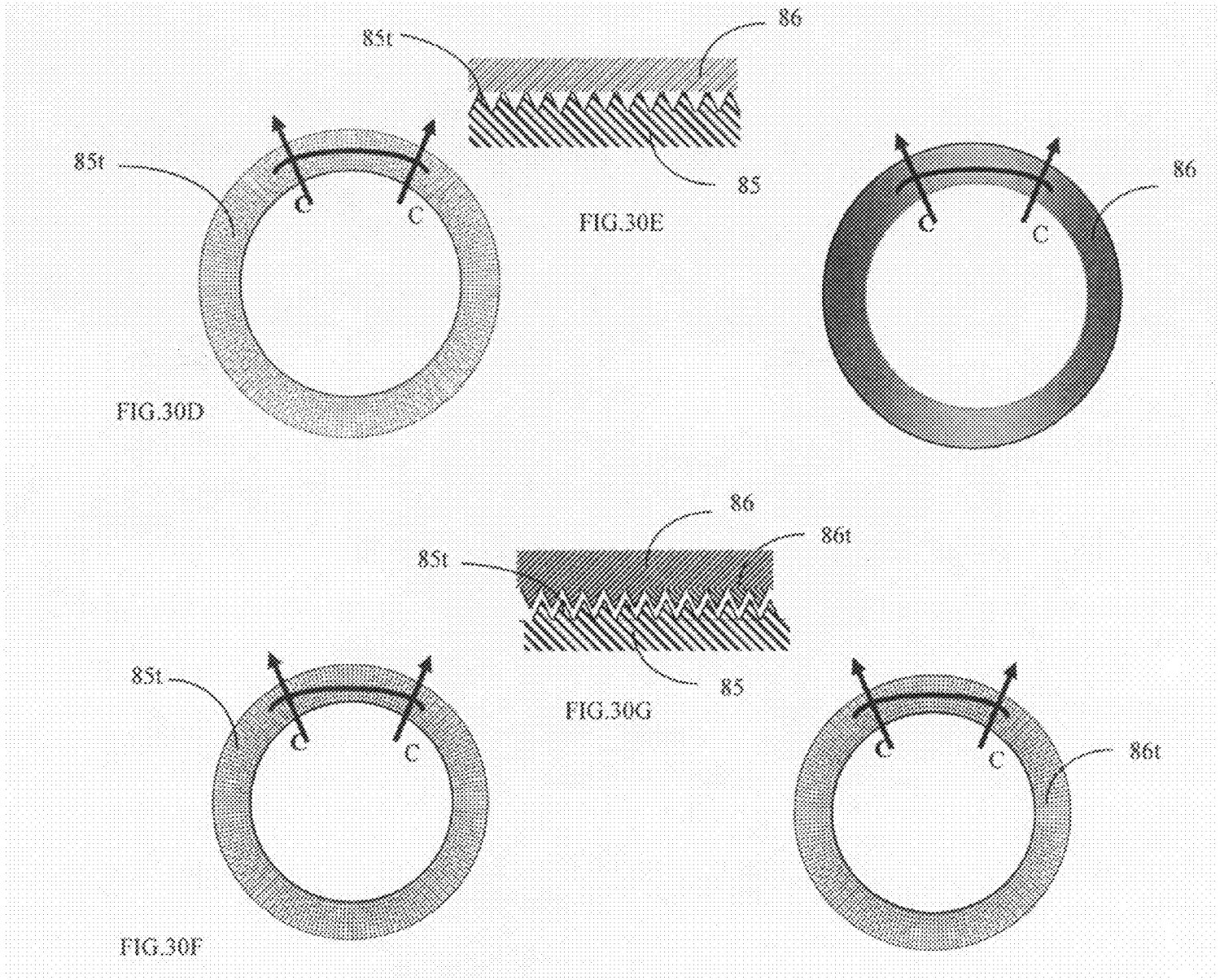

To prevent the launching screw to rotate, as shown in FIG. 30C, FIG. 30D and FIG. 30E, there are the anti-skid teeth 85*t* on the golh club head 85. In this case, the launching screw is made of the hard plastic such as PC material. There is a lock washer 87*w* to apply the pressure to press the plastic launch screw 86 against the sharp teeth 85*t* of the golh club head 85. Turning the coin-operated screw 87, the coin-operated fixing screw 87 squeezes against the lock washer 87*w* and the lock washer 87*w* presses the launching against the sharp teeth 85*t* of the golh club head 85. The sharp teeth 85*t* penetrates into the hard PC launching screw 86 that the launching screw 86 is completely fixed by the golh club head 85. Even under the torque force of the golfring, the launching screw still cannot move or rotate. So, the launching screw 86 can be continuously adjusted to be any degrees to have the finest infinitesimal resolution.

FIG. 30F and FIG. 30G show the alternative design of the launching screw and golh club head. In such case, both the launching screw and golh club head are made of the metal. The metal launching screw 86 has the sharp teeth 86*t* to have the interlaced lock with the sharp teeth 85*t* of the golh club head 85. The interlock between the metal teeth 85*t* and the teeth 86*t* definitely can prevent the rotation of the launching screw 86.

Figure 31A:
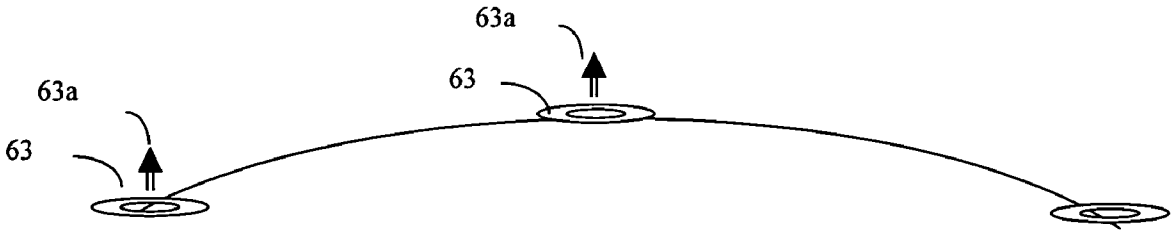
Figure 31B:
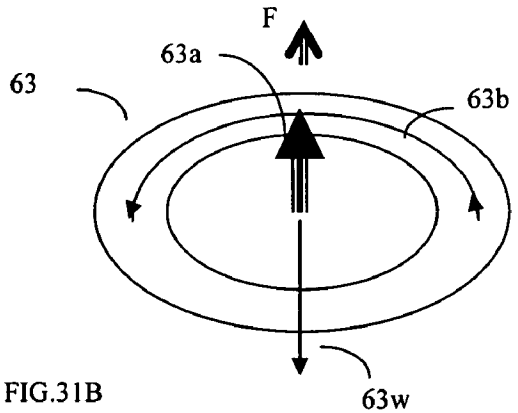
Figure 31C:
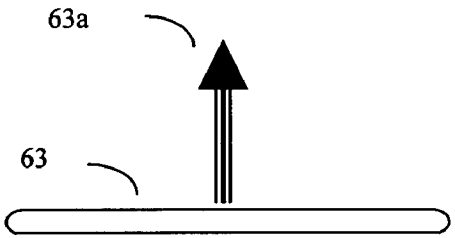
Figure 31D:
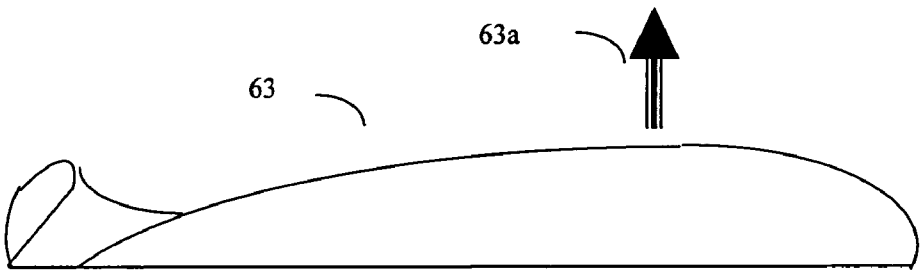

Comparing with the golf sport having only one kind of golfball, there are versatile golfrings for the long-drive, putting, left dogleg and right dogleg. As shown in FIG. 31A is the long drive golfring 63. Comparing with the hitting way to make the golfball to fly, the golfring 63 flying style is much different from the golfball. As shown in FIG. 31B, the golfring 63 is thrown to fly horizontally. The golfring 63 rotates as shown by the arrow 63*b* to stabilize the golfring 63. As the golfring 63 flying horizontally, as shown in FIG. 31D, the wing type aerofoil of the golfring 63 will generate the lift force 63*a*. As shown in FIG. 31A, the lift force 63 raises up the horizontally fly golfring 63 to have the parabolic trajectory. It has the longest flying distance to be the long drive of the golfring.

Figure 32A:
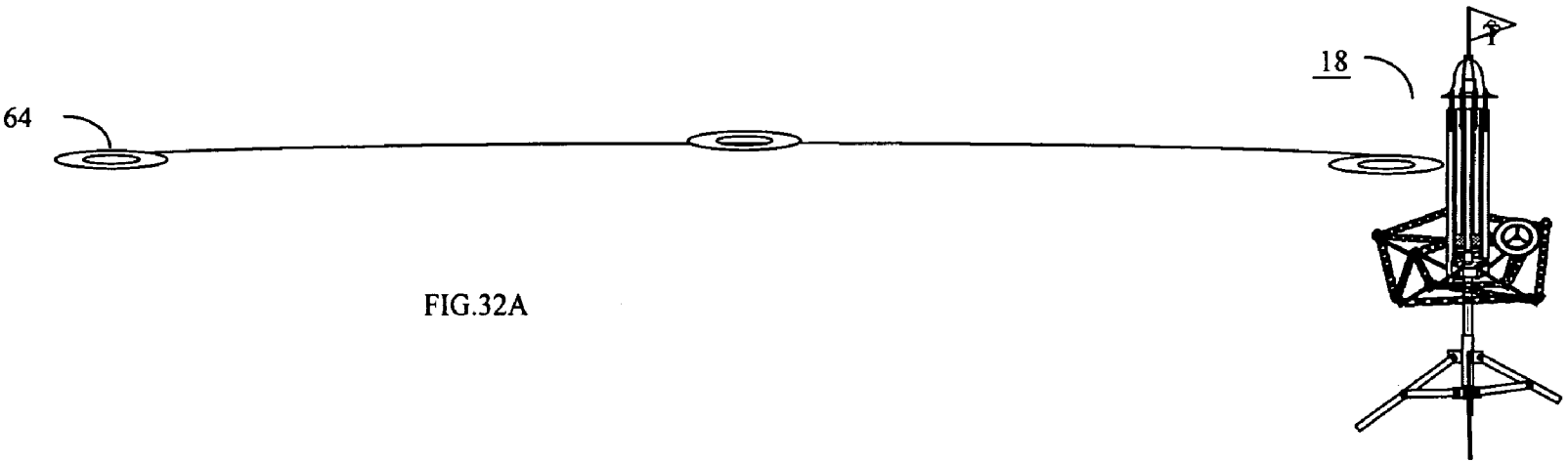
Figure 32B:
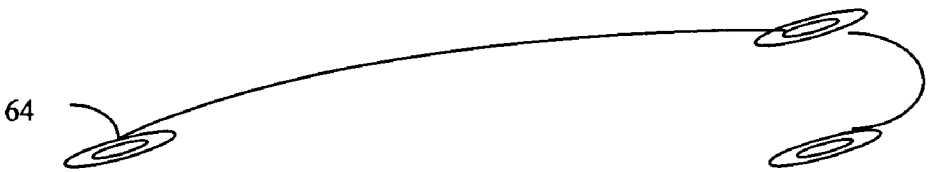
Figure 32C:
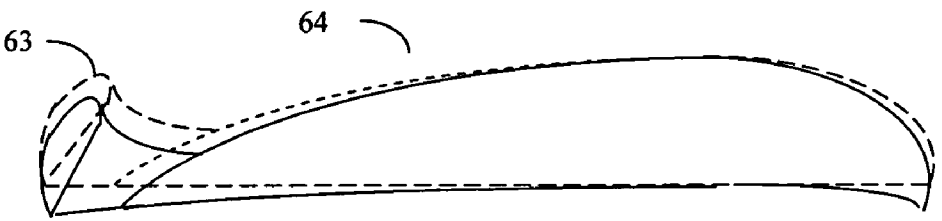

For the putting of the golfing, as shown in FIG. 32A, the flying trajectory needs to be flat to shoot the golfrisbee basket 18. To have the long flat flying trajectory, as shown in FIG. 32C, the aerofoil 64 is a little more curvature than the aerofoil 63 of the long-drive golfing. To have the curvature flying path, as shown in FIG. 32B, the putting golfing can throw with a tiny angle upward. At the peak of the trajectory, the golfring will fly backward and make a curvature flying path.

Figure 33A:
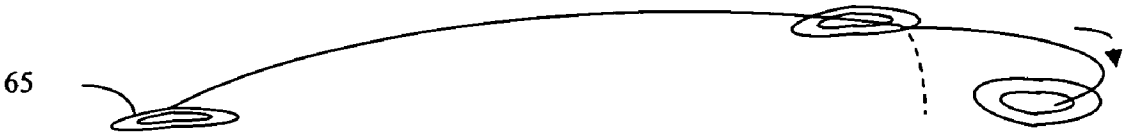
Figure 33C:
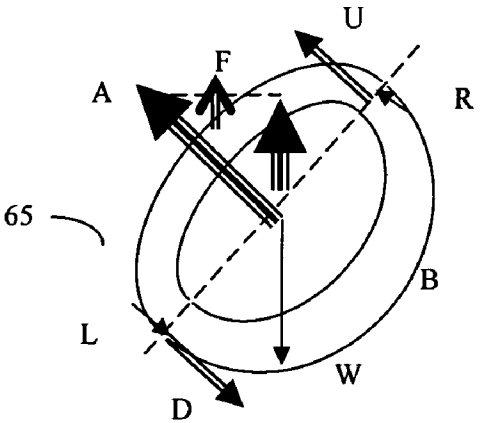
Figure 33B:
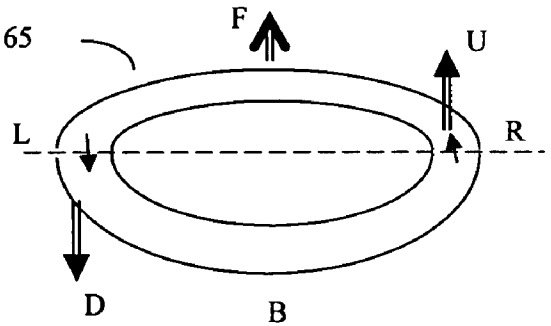
Figure 33E:
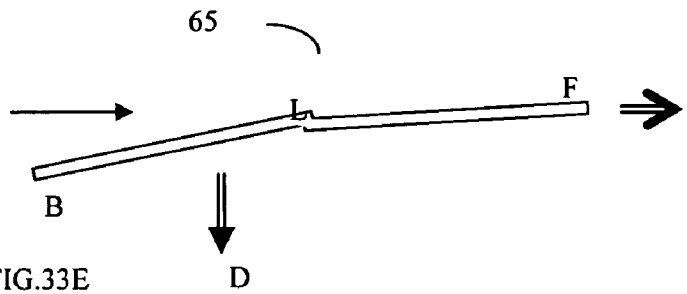
Figure 33D:
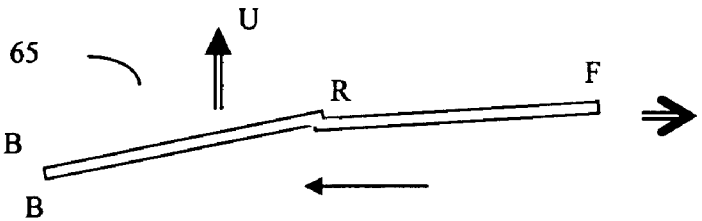

To have the left dogleg turn as shown in FIG. 33A, the golfing 65 needs to have a slightly bend downward as shown in FIG. 33B, As shown in FIG. 33D, the right side of the golfring 65 has lift force U. As shown in FIG. 33E, the left side of the golfring 65 has downward force D. As shown in FIG. 33B and FIG. 33C, the lift force U and the downward force D constitute couple momentum to rotate the golfing 65 to tilt leftward. The golfring 65 will steer to make the left turn to have the left dogleg. The bend downward angle needs to be the well control tiny angle. If the bend downward angle is too large, the golfring 65 will tilt too much to fall to the ground as shown by the dashed line as shown in FIG. 33A. So, it is need to have the special clamping fixture to set the correct bend downward angle.

Figure 34A:
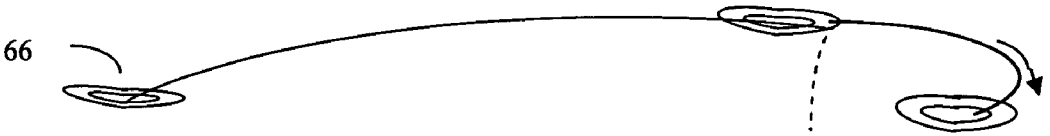
Figure 34C:
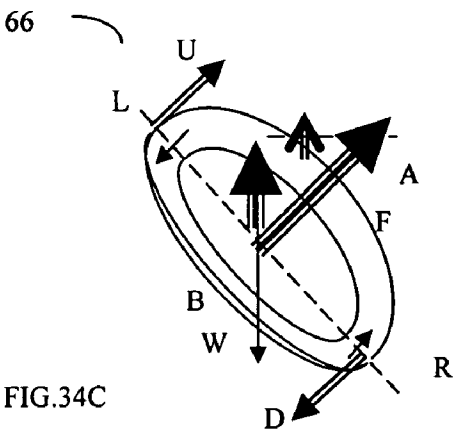
Figure 34B:
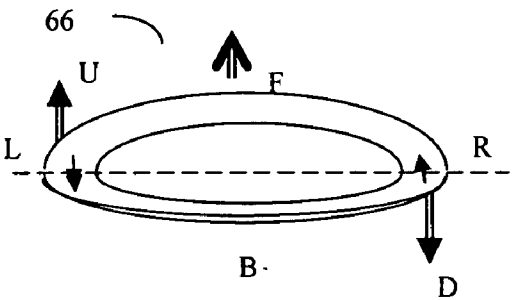
Figure 34E:
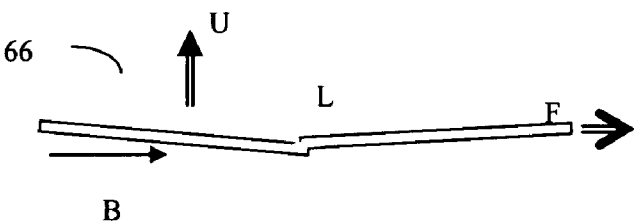
Figure 34D:
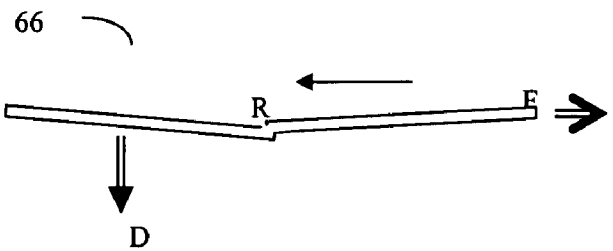

To have the right dogleg turn as shown in FIG. 34A, the golfing 66 needs to have a slightly bend upward as shown in FIG. 34B, As shown in FIG. 34D, the right side of the golfring 65 has downward force D. As shown in FIG. 33E, the left side of the golfring 65 has lift force U. As shown in FIG. 34B and FIG. 34C, the lift force U and the downward force D constitute a couple momentum to rotate the golfring 65 to tilt rightward. The golfring 66 will steer to make the right turn to have the right dogleg. The bend upward angle needs to be the well control tiny angle. If the bend upward angle is too large, the golfring 66 will tilt too much to fall to the ground as shown by the dashed line as shown in FIG. 34A. So, it is need to have the special clamping fixture to set the correct bend upward angle.

Since the golfring needs to have both the perfect streamline shape and the elasticity to resist the large impact force. However, there are no such plastic injection module process to satisfy these two requirements at the same. For the low temperature and short time module injection process, the golfring has the perfect streamline shape. However, the golfring is fragile and is easily broken as the golfring hit on the rigid surface such as stone and wall. For the high temperature and long time injection module process, the golfring has the wrinkle surface but can resist the high impact force. We have to make the innovation in the plastic injection module manufacture process.

As shown in FIG. 35 and FIG. 36, the golfrisbee means has two step of plastic injection module process to have high performance golfring 1. The $1^{st}$ step being fast chilling module injection process to have rigid streamline outer shape: the $2^{nd}$ step being slow warm clamping fixture process to prevent wrinkle of said golfring and having interior plastic being resilient to resist impulse impact.

First, we divide the single step plastic injection module manufacture process to be the two steps plastic injection manufacture processes: (1) the fast cold plastic module injection as shown in FIG. 35 or FIG. 36; and (2) the slow warm clamping fixture as shown in FIG. 37. The fast cold plastic module injection is to have the outside perfect streamline shape. The slow warm clamping fixture is to have the interior resilient plastic to resist the impact. It is very similar to the sword manufacture process. For the good sword, the outside metal is rigid and the inside metal is resilient that the sword is sharp and can resist the impact. The golfring has the similar characteristics. The outside is perfect streamline shape to have the superior flying performance and the interior is resilient to resist the impact of impulse force.

Figure 11A:
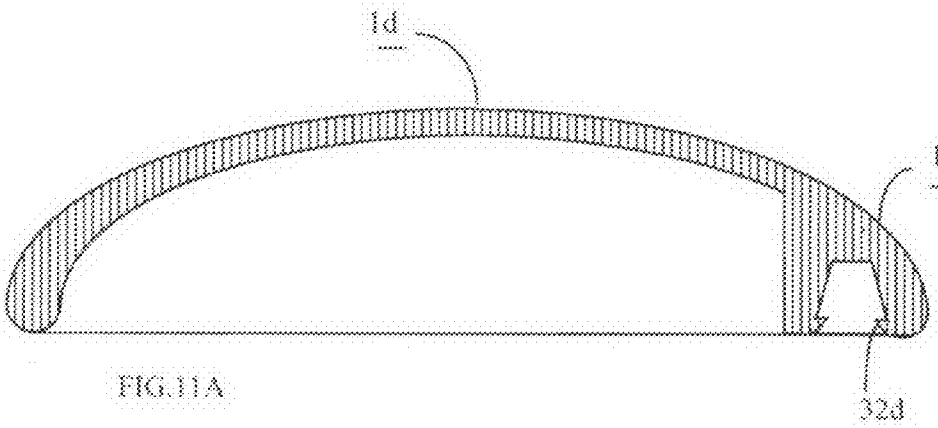
Figure 11B:
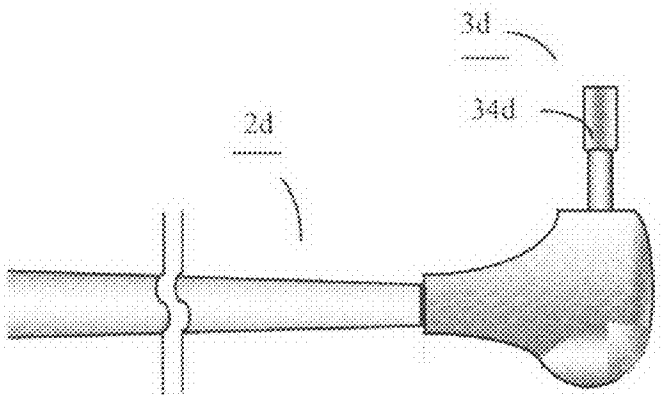
Figure 11C:
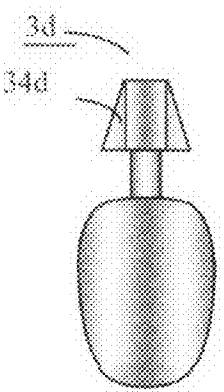
Figure 11D:
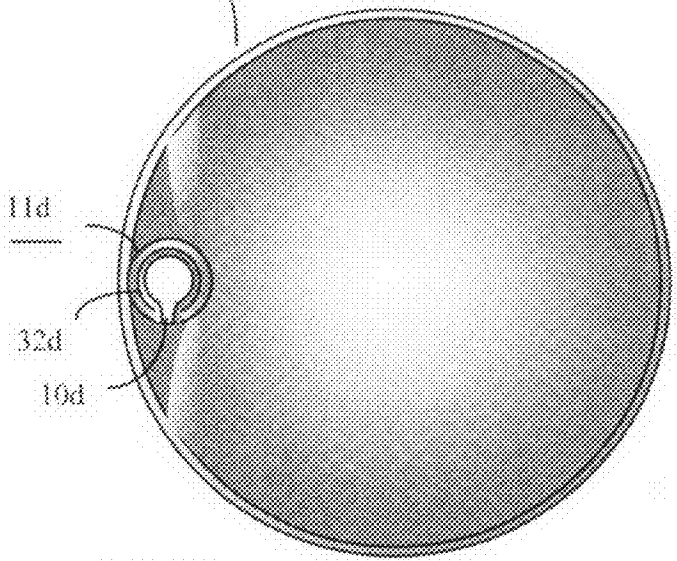
Figure 18C:
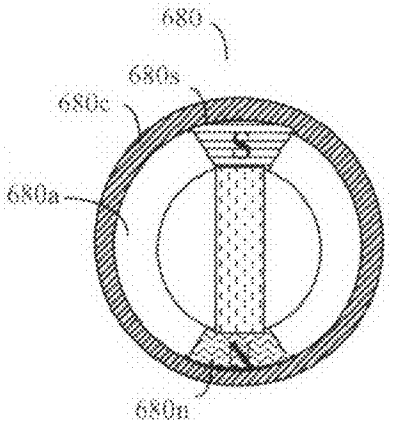
FIG. 18 is the magnetic head and magnetic cap of the golfrisbee; (A) is the top view of the magnetic head; (B) is the side view of the magnetic head; (C) is the top view of the magnetic cap; (D) is the side view of the magnetic cap.
Figure 18D:
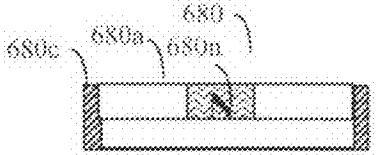
Figure 18A:
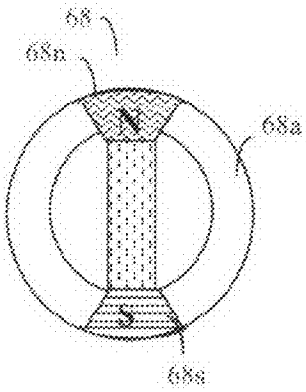
Figure 18B:
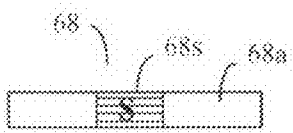
Figures 19A, 19B, 19C, 19D, 20A, 20B, 20C, 20D:
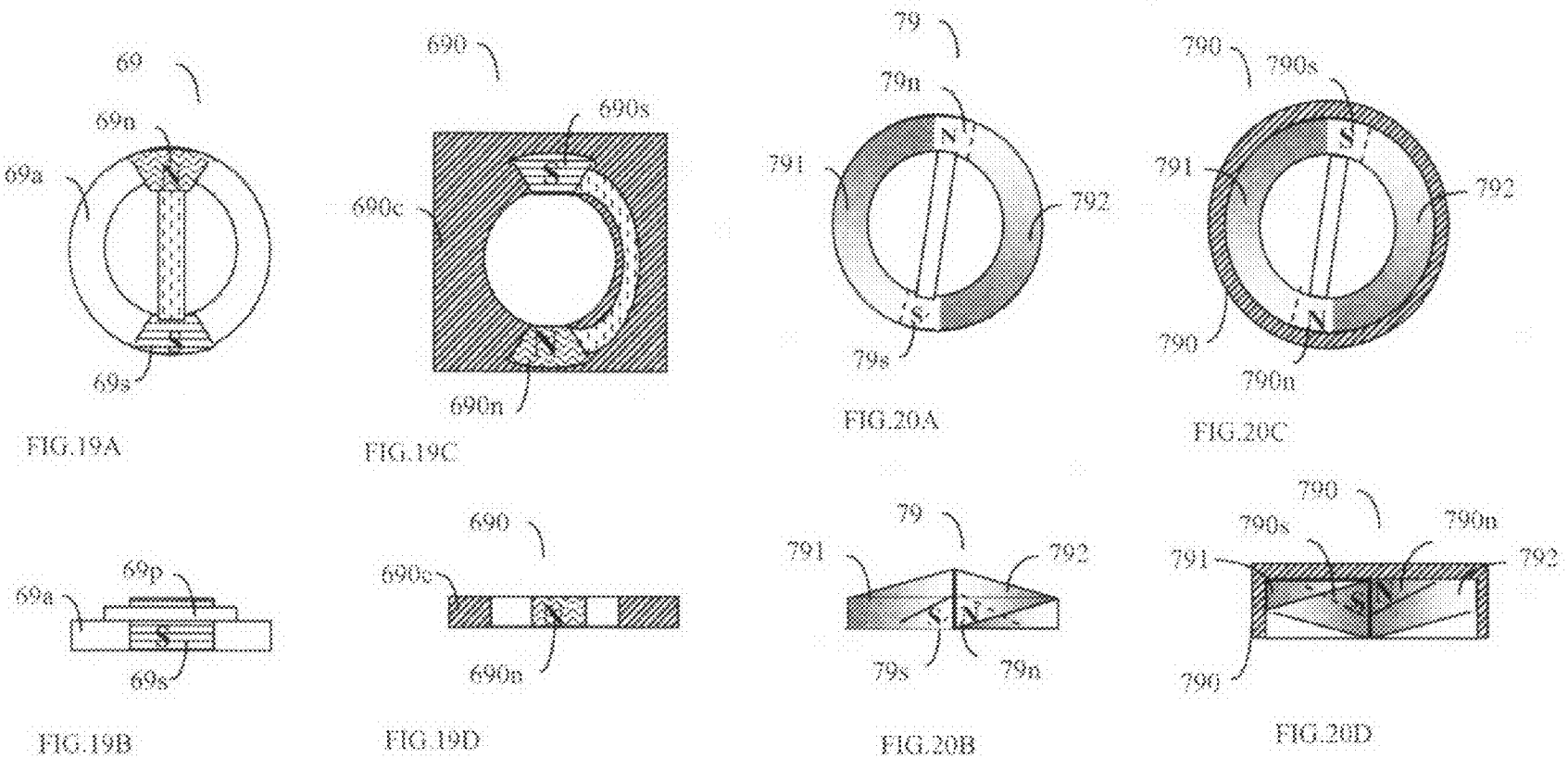
FIG. 19 is the alternative design of the magnetic head and magnetic cap of the golfrisbee. (A) is the top view of the magnetic head; (B) is the side view of the magnetic head; (C) is the top view of the magnetic cap; (D) is the side view of the magnetic cap.
FIG. 20 is the magnetic and mechanical head and cap of the golfrisbee. (A) is the top view of the magnetic and mechanical head; (B) is the side view of the magnetic and mechanical head; (C) is the top view of the magnetic and mechanical cap; (D) is the side view of the magnetic and mechanical cap.
Figure 35C:
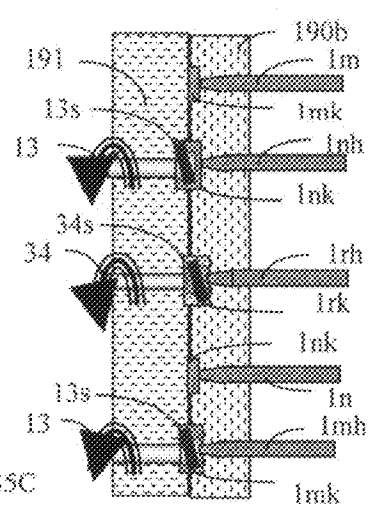
Figure 35D:
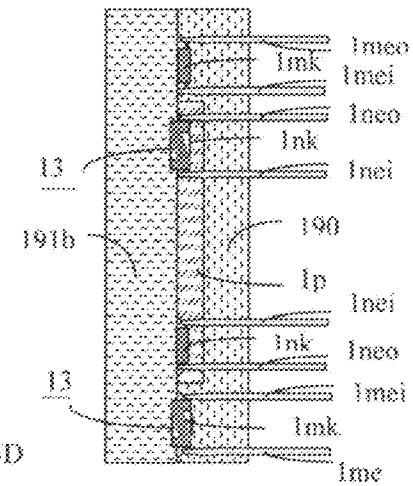
Figure 35A:
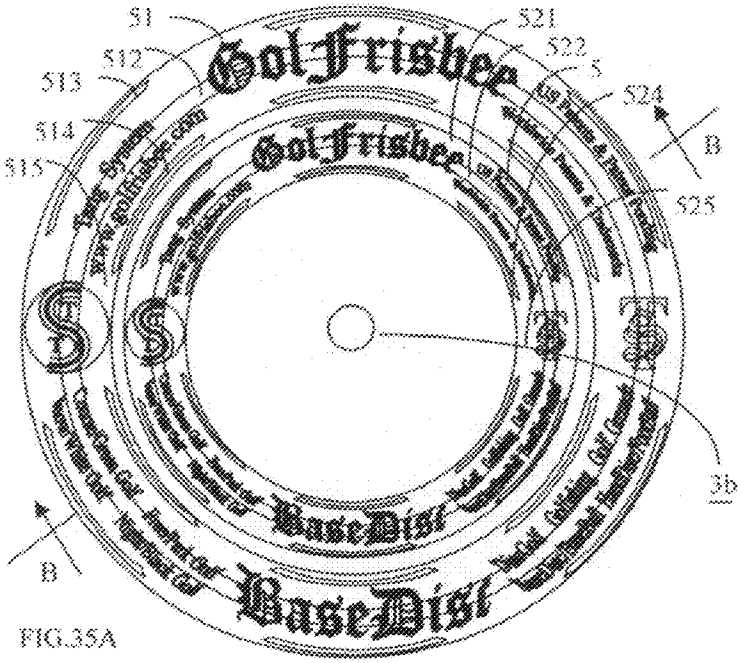
Figure 35B:
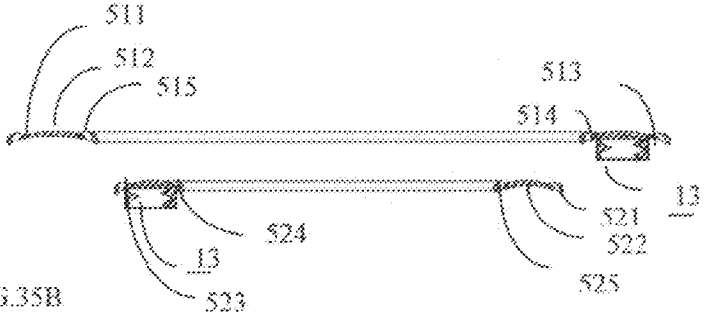
Figure 36A:
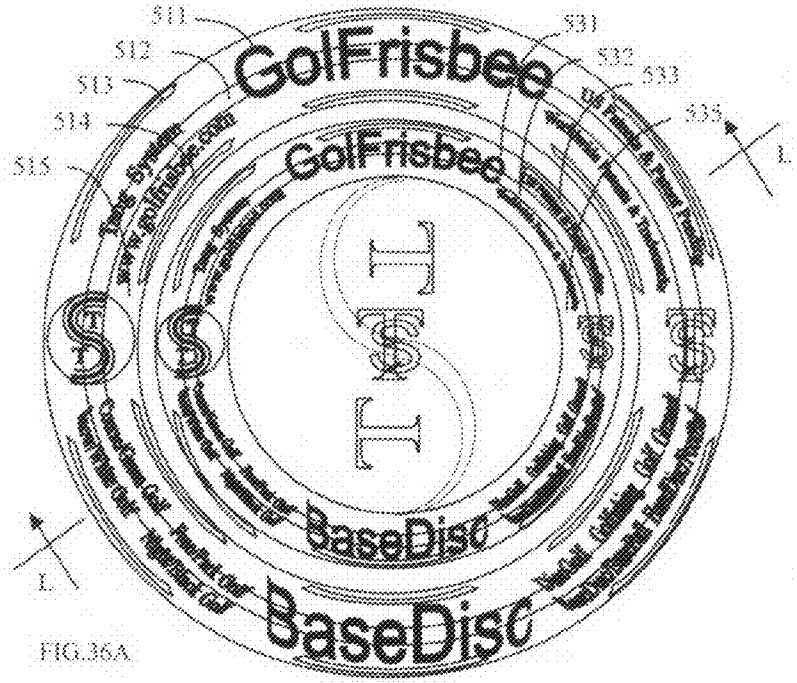
Figure 36B:
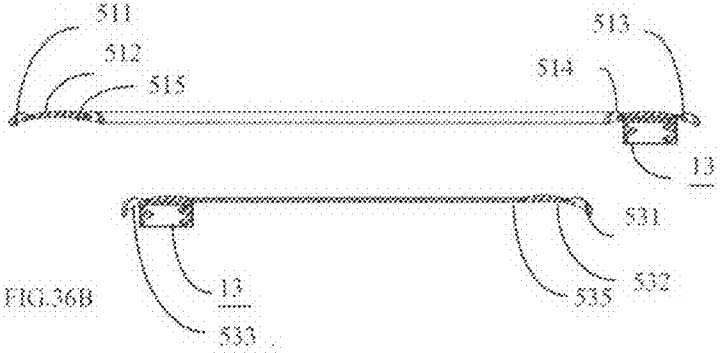
Figure 36C:
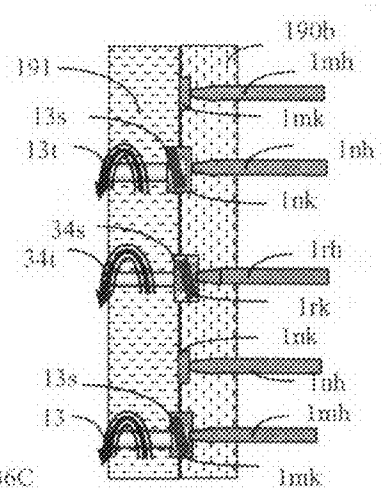
Figure 36D:
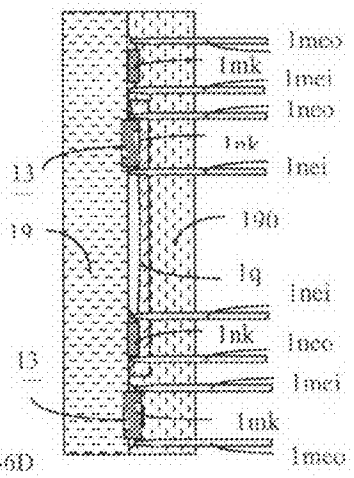

In the product phase, to reduce the production cost, the golfrisbee ring in FIG. 18C can have two rings as shown in FIG. 35A and FIG. 35B. The launching screw 3*b* is located in the center of the plastic injection module to save the manufacture cost. The corresponding backbone plastic modules are shown in FIG. 35C and the foam plastic modules are shown in FIG. 35D. The golfrisbee ring in FIG. 18C and golfrisbee disk FIG. 11C are aligned as shown in FIG. 36A and FIG. 36B. The corresponding backbone plastic module is shown in FIG. 36C and the foam plastic module is shown in FIG. 36D. The golfrisbee products not only can be one set to share one package but also share one set of plastic modules. As shown in FIG. 35C and FIG. 36C, the backbone plastic module is one module with three cavities: the launching screw cavity 1*rk*, the large golfrisbee backbone cavity link and the small golfrisbee backbone cavity 1*rk*. To minimize the number of plastic modules, the FIG. 35C is the same as FIG. 36C. The sub-module 1*p* for the ring in FIG. 35D is replaced with the sub-module 1*q* in FIG. 36D. With this approach, the plastic modules are reduced from 7 modules to be 2 modules. The plastic injection is reduced from 7 times to be 2 limes. The production cost reduces two thirds. Furthermore, the gaps 513, 514, 523,524, 533 reduce the material, reduce the weight and increase the aerodynamic performance. The golfrisbee is made of the composite material of backbone and skirt. The backbone 512 in the large golfrisbee ring is corresponding to polycarbonate plate 1*mk* in the module injected with tube 1*mh*. The backbone 522 in the small golfrisbee ring and the backbone 532 in the golfrisbee disk are corresponding to polycarbonate plate 1*nk* in the module injected with tube 1*nh*. The female screw 13 of the golfrisbee is corresponding to 1*nk* injected with the tube 1*nh* injecting over the male screw 13*s* driven by the rod 13*t*. The male screw 34 of the launch screw is corresponding to 1*rk* is injected with the tube 1*rh* injecting into the female screw 34 driven by the rod 34*t*. As shown in FIG. 35A, FIG. 35B and FIG. 35D, the external skirt 511 in the large golfrisbee ring is corresponding to the foam envelop in the module injected with tube 1*meo*. The internal skirt 515 in the large golfrisbee ring is corresponding to the foam envelop in the module injected with tube 1*mei*. The external skirt 521 in the small golfrisbee ring is corresponding to foam envelop in the module injected with tube 1*neo*. The internal skirt 525 in the small golfrisbee ring is corresponding to the foam envelop in the module injected with tube 1*nei*. As shown in FIG. 50A, FIG. 36B and FIG. 36D, the external skirt 531 in the golfrisbee disk is corresponding to the foam envelop in the module injected with tube 1*neo*. The internal pan 535 in the golfrisbee disk is corresponding to foam envelop in the module injected with tube 1*nei*.

Figure 37A:
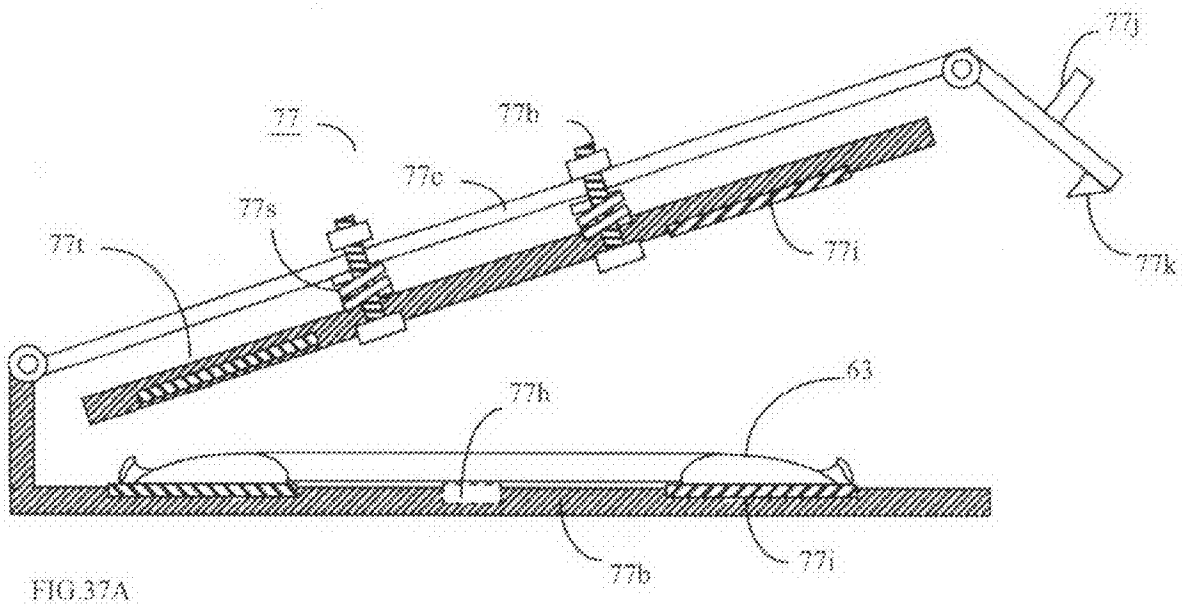
Figure 37B:
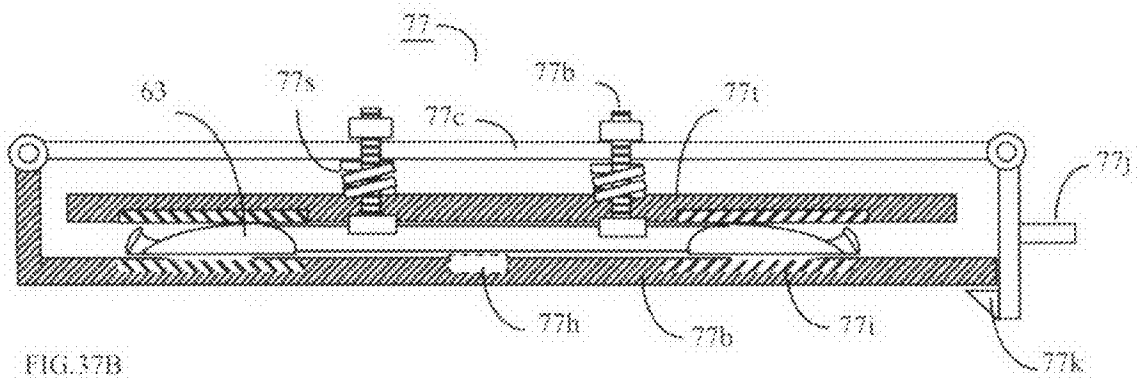
Figure 37F:
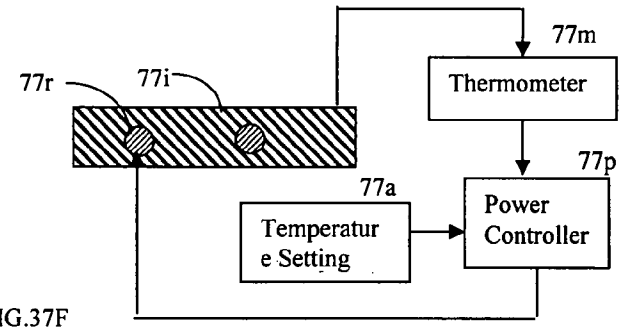
Figure 37E:
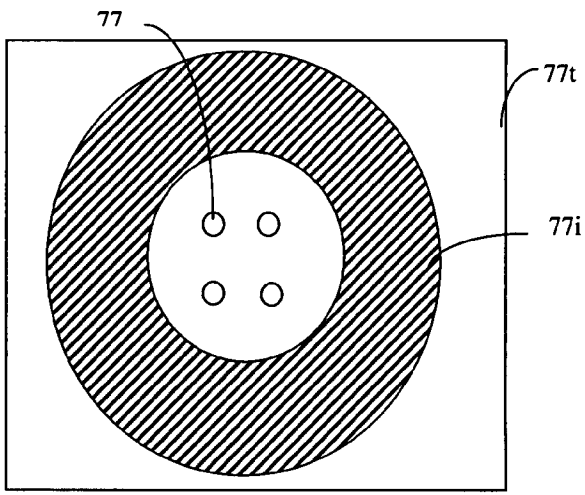
Figure 37C:
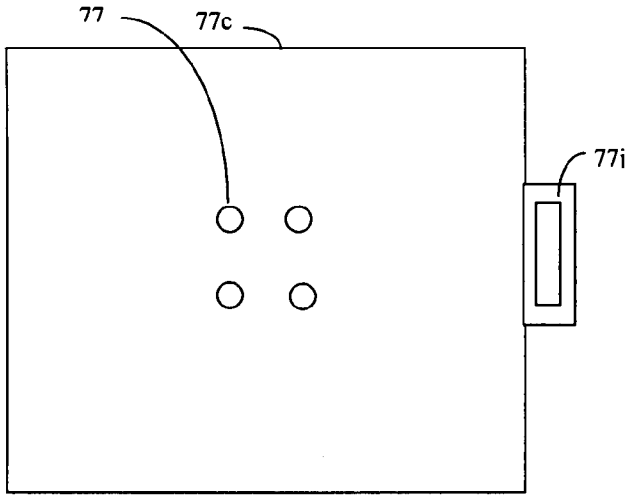
Figure 37D:
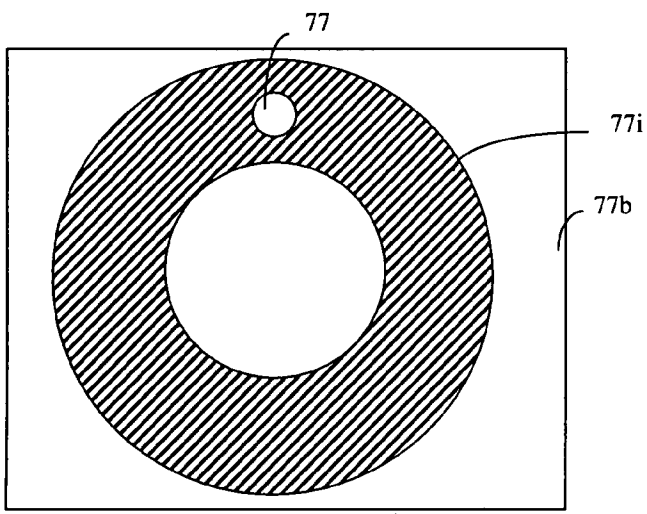

To have the streamline outer surface of the golfring 63, the plastic injection module must use the cold temperature to solidify the outer surface of the golfring 63 quickly. As shown in FIG. 37A and FIG. 37C, as soon as the outside of the golfring 63 is formed in the cold plastic module, the golfring 63 is put in the warm golfring clamping fixture 77. The operator holds the handle 77*j* and the lock 77*k* is released from the bottom plate 77*b*. The operator put the golfring 63 on the insulator 77*i* and the cap of the golfring 63 in the hole 77*h* as shown in FIG. 37D. Then the operator closes the clamping fixture 77 as shown in FIG. 37B. The looking hook 77*k* locks against the bottom plate 77*b*. The case plate 77*c* biases against the moving top clamping plate 77*t* with the biasing spring 77*s*. The biasing spring 77*s* is mounted on the bolt 77*b* as shown in FIG. 37B and FIG. 37E. Under the biasing force of the biasing spring 77*s*, the top clamping plate 77*t* applies pressure on the golfring 63 to get rid out of the wrinkle of the golfring 63 during the solidification process of the golfring 63.

To have the interior resilient plastic, the solidification of the interior plastic must be slowed down. To slow down the solidification of the solidification of the interior plastic as shown in FIG. 37F, the case not only use the insulator 77*i* to keep the golfring 63 temperature but also buries the thermal resistor 77*r* in the insulator to adjust the clamping fixture temperature to be the optimum solidification temperature. The thermometer 77*m* reads out the temperature of the insulator 77*i*. The power controller 77*p* compares the read out insulator temperature of the thermostat 77*m* with the setting temperature 77*a* to adjust the power delivering to the insulator pad 77*i* of the clamping fixture 77.

While the invention has been particularly shown and described with reference to the preferred embodiments thereof, it will be understood by those skilled in the art that various changes in form and details may be made therein without departing from the spirit and scope of the invention.

We claim:

1. A golfrisbee sport comprising a golfrisbee means, a golh club means and a golfrisbee basket means wherein said golh club means is used in the launching of the said golfrisbee means toward the a target of the said golfrisbee basket means with an eccentric force means and a tangent force means provided to said golfrisbee means by the golh club means and wherein said basket means comprises:

a foldable basket and net;

said golh club means comprises:

a shaft having a proximal and distal end, a handle connected to the proximal end, a fixed screw mechanism with external threads for the direct attachment of said golf frisbee to said golh club;

said golf frisbee means comprises:

a cup shaped disk having a threaded bore on one side of said disk and wherein said fixed screw mechanism of said gohl club is removably attached to said cup's threaded bore.

2. A golfrisbee sport according to claim 1 of which said golfrisbee basket means comprising wind chiming means, top hat means and post means, said top hat means being installed on a top position of said post means, said wind-bell-chiming means comprising a plural of tubes hanging below said top hat means around said post means, distance of said tubes of said wind chiming means being so close and narrow that no flying golfrisbee means being able to pass through said tubes of said wind chiming to protect said golfrisbee means to be hit on said post means to be destroyed by said post means;

as an optional to have a free swiveling chime block means with a central hole to hit and be hit by said tubes of wind chiming means, said post means passing through said dangling block;

as said flying golfrisbee means hitting on tubes of said wind chiming means, said tubes being hit by said flying golfrisbee of said wind chiming means swiveling to absorb impact energy of said golfrisbee and generating melody, as said tubes hit by said flying golfrisbee hitting on said free swiveling chime block, said free swiveling chime block continuing moving and hitting other said tubes, other said tubes swiveling back and forth and hitting on said free swiveling chime block, this process continuing until all said tubes swiveling and generating harmonic melody.

3. A golfrisbee sport according to claim 2 said basket means further comprises a foldable basket means, said foldable basket means having a plural of links with one end being pivotally hinged to a hinge means mounted on said post means, said link having an end being biased against to a hinge means mounted on said post means, an option of plural of chain means being hooked to said links to form a web means, said foldable basket being open with weight of said links and said web means.

4. A golfrisbee sport according to claim 2 said basket means further comprises a foldable basket means, said foldable basket means having a plural of truss means, said truss means having a first link with one end being pivotally hinged to said post means and a second link with one end being pivotally hinged to middle portion of said first link and another end being pivotally hinged to a sliding tube means; said truss being in an umbrella type structure, a plural of chain means being hooked on said links to form a webs means, said web means and said link means constituting of a portable basket means;

pushing said sliding tube means to open up said web and truss means and locking it with said post means to open said foldable basket means; releasing said locking with said post means, said a foldable basket means being in fold position due to weight of said foldable basket means.

5. A golfrisbee sport according to claim 1 of which golfrisbee basket means comprises of a portable golfrisbee basket means for disk means being thrown into said portable basket means with naturally spreading due to gravity capability, said portable golfrisbee basket means comprising a naturally spreading basket means and a standing pole target means;

said naturally spreading basket means comprising a net means and cantilever means;

said basket means for catching and holding said disk means being thrown in said portable golfrisbee basket means, said net means being supported by said cantilevers means for spreading said net means to catch and hold said disk means, said cantilevers means having one end being hinged and biased to said standing pole target means for supporting said cantilever means and net means and said cantilevers being free to rotate and falling to spread said net naturally due to gravity, said cantilever means being retractable with pivotal rotation at hinges that said portable golfrisbee basket means being portable.

6. A golfrisbee sport means comprises of a portable golfrisbee basket means according to claim 5 of which said standing pole target means further comprises a sliding ring for these said cantilever means being hinged at said sliding ring, said sliding ring sliding on said pole means and said cantilever means having one end being hinged to said sliding ring;

said portable golfrisbee basket being actively grasping basket with moveable cantilevers and flexible net to absorb kinetic energy of golfrisbee and actively grasp the golfrisbee to have the soft landing, said naturally spreading basket means further comprising flexible string means to absorb momentum of throwing disc means to be an active grasping basket means, said cantilever means having middle portion being hinged to an end of said flexible string means and other end of said flexible string means being hinged to a top portion and supported by said pole to have soft hit on said flexible string means, said flexible strings for absorbing impact of said flying disk means, as said flying disc means hitting on said standing pole target means, said flexible string means pulling and raising up said cantilever means and said net means to actively catching said flying disc means, said cantilever means and net means falling back together to said naturally spreading position with said disc means to have soft landing in said active grasping basket means.

7. A golfrisbee sport means comprises of a portable golfrisbee basket means according to claim 5 of said portable golfrisbee basket means further comprising an extendable pole sliding in one base pole and being locked with a locking means, said pole means has tripod hinged to one sliding ring, locking said sliding ring with a locking means, releasing said locking means, said extendable pole being sliding into said base pole for carry, said tripod standing on ground; releasing said locking means, said tripod being retractable to be portable.

8. A golfrisbee sport means according claim 1 of which throwing target of golfrisbee basket means further comprises of a universal portable putt and hole means for putting a disk means to roll and for providing a hole target means for rolling ball means to roll into it;

said universal put and hole means comprising a seat means and two wedge type plug means;

said seat means comprising a slot means at center of said seat means;

said two wedge type plug means being fit in said slot means to form a hole means at a center of said universal portable putt and hole means to provide a hole target means for rolling ball means to roll into it;

pulling out said two wedge type plugs from said seat means, said slot means being formed for said disk means being inserted in said slot means for said disc means being putted to push to roll with club mean;

said disk means being mounted in said slot means on said universal portable put and hole means and being pushed to roll with a club means;

said club means being for swiveling a disk means to fly and pushing said disk means mounted on said slot means to roll into a cavity and putting a ball means to roll into a hole of said universal put and hole means.

9. A golfrisbee sport according to claim 1 of which said golfrisbee means being a golh grenade means, said golh grenade means comprising a smart grenade means and a handle with club head adapting means, said smart grenade means further comprising explosive and smart controlling means, said golh grenade means pivotally mounting on said golh club head with said club head adapting means, swiveling said golh club means, said golh grenade pivotally rotating due to eccentric force and taking off to fly to throw toward an enemy target.

10. A golfrisbee sport according to claim 1 of which golh club means being golh-gun club means, said golh-gun club means being constituted of gun and golh head means, said golh head means being mounted at top of said gun;

pivotally mounting said golfrisbee means on said golh head means on said gun, swiveling said gun, said golh grenade rotating and taking off to throw on target of enemies.

11. A golfrisbee sport according to claim 1 of which said golfrisbee means being a water grenade means, said water grenade means comprising a water balloon means and a handle;

at one end of said handle having a golh club head adapting means;

at another end of said water balloon means being mounted on said handle;

swiveling said golh club means, said water grenade means rotating due to eccentric force and taking off from said golh club head means flying in the sky and being thrown toward other party kids in water game.

12. A golfrisbee sport according to claim 1 of which golh club being water gun golh club, said water gun golh club comprising water gun means and said golh club head means, said golh club head means being mounted on said water gun means;

swiveling said water gun means, said water grenade means rotating due to eccentric force and taking off from said water gun golh club flying in the sky and being thrown toward other party kids in water game.

13. A golfrisbee sport according to claim 1 of which golfrisbee means, golh club means have a mechanical wedge type head mounting on said golh club head and a mechanical wedge type cap mounting on said golfrisbee;

in a mounting position, said mechanical wedge type head fitting with said mechanical wedge type cap;

rotating from said mounting position, said mechanical wedge type head pushing said mechanical wedge type cap away and disengage with said mechanical wedge type cap.

14. A golfrisbee sport according to claim 1 of which golfrisbee means, golh club means have magnetic type head mounting on said golh club head and a magnetic type cap mounting on said golfrisbee;

in a mounting position, said magnetic type head attracting and fitting with said magnetic type cap;

rotating from said mounting position, said magnetic type head pushing said magnetic type cap away and disengage with said magnetic type cap.

15. A golfrisbee sport means according to claim 1 of which golfrisbee means further comprises an integrated multimedia means, said integrated multimedia means comprising a vibration tongue means for providing sound and vibration to a vibration enlightened means, said vibration enlightened means being attached to said vibration tongue means, a vibration of said vibration tongue means stimulating said vibration-enlightened means to light, air flow flowing through said vibration tongue means and transferring energy to said vibration tongue means to be vibration energy of said vibration tongue means;

said vibration tongue means vibrating and transferring vibration energy to vibration enlightened means to be electrical energy, said electrical energy being converted to be light energy, said vibration tongue means enhanced said energy conversion from said airflow to be light.

16. The golfrisbee sport means of claim 1 including a golfrisbee basket means comprising wind chiming means, top hat means, portable golfrisbee basket means and post means, said top hat means being installed on a top position of said post means, said wind chiming means comprising a plural of tubes hanging below said top hat means with string means around said post means, said portable golfrisbee basket means comprising a naturally spreading basket means and a standing pole target means;

said naturally spreading basket means comprising a net means and cantilever means;

said basket means for catching and holding said disk means being thrown in said portable golfrisbee basket means, said net means being supported by said cantilevers means for spreading said net means to catch and hold said disk means, said cantilever means having middle hinges being hinged at end of said wind chiming means and biased to said standing pole target means with sliding ring means for supporting said cantilever means and net means and said cantilevers being free to rotate and falling to spread said net naturally due to gravity, said cantilever means being retractable with pivotal rotation at middle hinges that said portable golfrisbee basket means being portable.

17. A golfrisbee sport means comprises of a portable golfrisbee basket means according to claim 16 of said portable golfrisbee basket means further comprising an extendable pole sliding in one base pole and being locked with a locking means, said pole means has tripod hinged to one sliding ring, locking said sliding ring with a locking means, releasing said locking means, said extendable pole being sliding into said base pole for carry, said tripod standing on ground; releasing said locking means, said tripod being retractable to be portable.

18. The golfrisbee sport means of claim 1 including a golfrisbee means being pivotally mounted on a head means of said golh club means with a fitting means, a directional lock and release mechanism of said fitting means and head means and launch being a blockless snapping release screw means, as said golfrisbee means being pivotally mounted on said golh head of said club means with said fitting means, said snap release screw means engaging said golfrisbee means with said head means of golh club means and said golfrisbee means being resiliently grasped on said head of club means, swiveling said club means, said golfrisbee means rotating due to said eccentric force launching said blockless snapping release screw means releasing said golfrisbee means to launch said golfrisbee means to fly, swiveling said golh club with hand in circle movement, said golfrisbee means pivotally rotating due to said eccentric force of a circle of said swivel of club means, said snap release screw means transferring translation momentum to said golfrisbee means and said eccentric force generating angular momentum of said golfrisbee means, as said blockless snapping release screw means disengaging said golfrisbee means from said head means of golh club means, at said disengaging position, said golfrisbee means being released by said blockless snapping release screw means on said head means of club means, said golfrisbee means being released to fly due to translation momentum and rotation due to eccentric force, rotation from lock to release position and said rotation making said golfrisbee means have gyroscopic force to stabilize flight of said golfrisbee means.

19. A golfrisbee sporting means according to claim 18 wherein said snap release screw means further comprising dual half-ring screws means, said dual half-ring screws means being separated from each other, said disk means mounting on said head means of said club means at the extension line of said club means, rotating that said disk means being in said tight engaging position with resilient material means or composite material means of resilient material means and hard backbone means, in said snap release screw means there being resilient layer to hold said disk means tightly, in said engaging position, rotating said disk means in a reverse direction, said disk means in disengaging position, swiveling said club means, said disk means rotation having snap release of said disk means with said fast release screw means; with said snap release screw means, the flight distance of the golfrisbee being double with the efficient transmission of the momentum of club means to said golfrisbee sporting means.

20. A golfrisbee sporting means according to claim 18 wherein said head means of said golh club means and said snap release screw means further comprising anti-skid teeth means between said head means and said snap release screw means;

applying tighten means to apply pressure to said snap release screw means to said head means to prevent the launching screw to rotate.

* * * * *